US009549253B2

(12) United States Patent
Alexandridis et al.

(10) Patent No.: US 9,549,253 B2
(45) Date of Patent: Jan. 17, 2017

(54) SOUND SOURCE LOCALIZATION AND ISOLATION APPARATUSES, METHODS AND SYSTEMS

(71) Applicant: Foundation for Research and Technology—Hellas (F.O.R.T.H) Institute of Computer Science (I.C.S.), Crete (GR)

(72) Inventors: Anastasios Alexandridis, Crete (GR); Anthony Griffin, Crete (GR); Athanasios Mouchtaris, Crete (GR)

(73) Assignee: Foundation for Research and Technology—Hellas (FORTH) Institute of Computer Science (ICS), Heraklion (GR)

( * ) Notice: Subject to any disclaimer, the term of this patent is extended or adjusted under 35 U.S.C. 154(b) by 58 days.

(21) Appl. No.: 14/556,038

(22) Filed: Nov. 28, 2014

(65) Prior Publication Data

US 2015/0156578 A1 Jun. 4, 2015

Related U.S. Application Data

(63) Continuation-in-part of application No. 14/294,095, filed on Jun. 2, 2014, which is a continuation-in-part of application No. 14/038,726, filed on Sep. 26, 2013.

(Continued)

(51) Int. Cl.
*H04R 3/00* (2006.01)

(52) U.S. Cl.
CPC ..... *H04R 3/005* (2013.01); *H04R 2420/07* (2013.01); *H04R 2430/03* (2013.01); *H04S 2420/01* (2013.01)

(58) Field of Classification Search
CPC ..... H04R 3/00; H04R 3/005; H04R 1/326; H04R 1/406; H04R 2430/03; H04R 2430/20; H04R 2430/21; H04R 25/407; H04R 29/005
See application file for complete search history.

(56) References Cited

U.S. PATENT DOCUMENTS 7,555,161 B2 6/2009 Haddon et al.
2008/0089531 A1 4/2008 Koga et al.
(Continued)

OTHER PUBLICATIONS

B. Loesch et al., "Multidimensional localization of multiple sound sources using frequency domain ICA and an extended state coherence transform," *IEEE/SP 15th Workshop Statistical Signal Processing* (*SSP*), pp. 677-680, Sep. 2009.

(Continued)

*Primary Examiner* — Thang Tran
(74) *Attorney, Agent, or Firm* — Chadbourne & Parke LLP

(57) ABSTRACT

A processor-implemented method for spatial sound localization and isolation is described. The method includes segmenting, via a processor, each of a plurality of source signals detected by a plurality of sensors, into a plurality of time frames. For each time frame, the method further includes obtaining, via a processor, a plurality of direction of arrival (DOA) estimates from the plurality of sensors, discretizing an area of interest into a plurality of grid points, calculating, via the processor, DOA at each of grid points, comparing, via the processor, the DOA estimates with the computed DOAs. If the number of sources is more than 1, the method includes obtaining via the processor, a plurality of combinations of DOA estimates, from amongst the plurality of combinations, estimating, via the processor, one or more initial candidate locations corresponding to each of the combinations, selecting location of the sources from amongst the initial candidate locations.

19 Claims, 36 Drawing Sheets

Related U.S. Application Data

(60) Provisional application No. 61/909,882, filed on Nov. 27, 2013, provisional application No. 61/706,073, filed on Sep. 26, 2012.

(56) References Cited

U.S. PATENT DOCUMENTS

| | | | | |
|---|---|---|---|---|
| 2009/0080666 | A1 | 3/2009 | Uhle et al. | |
| 2010/0135511 | A1 | 6/2010 | Pontoppidan | |
| 2010/0142327 | A1 | 6/2010 | Kepesi et al. | |
| 2010/0217590 | A1* | 8/2010 | Nemer | G01S 3/8006 704/233 |
| 2010/0278357 | A1* | 11/2010 | Hiroe | G10L 21/0272 381/111 |
| 2011/0091055 | A1* | 4/2011 | LeBlanc | H04S 7/301 381/303 |
| 2011/0110531 | A1* | 5/2011 | Klefenz | H04R 3/005 381/92 |
| 2012/0020485 | A1* | 1/2012 | Visser | H04R 3/005 381/57 |
| 2012/0114126 | A1 | 5/2012 | Thiergart et al. | |
| 2012/0140947 | A1 | 6/2012 | Shin | |
| 2012/0221131 | A1 | 8/2012 | Wang et al. | |
| 2013/0108066 | A1 | 5/2013 | Hyun et al. | |
| 2013/0216047 | A1* | 8/2013 | Kuech | G10L 19/008 381/26 |
| 2013/0259243 | A1* | 10/2013 | Herre | G10L 19/02 381/57 |
| 2013/0268280 | A1* | 10/2013 | Del Galdo | G10L 19/02 704/500 |
| 2013/0272548 | A1 | 10/2013 | Visser et al. | |
| 2013/0287225 | A1* | 10/2013 | Niwa | H04R 3/00 381/92 |
| 2014/0172435 | A1* | 6/2014 | Thiergart | G01S 3/80 704/500 |
| 2014/0376728 | A1* | 12/2014 | Ramo | G06T 19/006 381/56 |
| 2015/0310857 | A1* | 10/2015 | Habets | G10L 25/78 704/240 |

OTHER PUBLICATIONS

A. Lombard et al., "TDOA estimation for multiple sound sources in noisy and reverberant environments using broadband independent component analysis," *IEEE Transactions on Audio, Speech, and Language Processing*, pp. 1490-1503, vol. 19, No. 6, Aug. 2011.

H. Sawada et al., "Multiple source localization using independent component analysis," *IEEE Antennas and Propagation Society International Symposium*, pp. 81-84, vol. 4B, Jul. 2005.

F. Nesta and M. Omologo, "Generalized state coherence transform for multidimensional TDOA estimation of multiple sources," *IEEE Transactions on Audio, Speech, and Language Processing*, pp. 246-260, vol. 20, No. 1, Jan. 2012.

C. Blandin et al., "Multi-source TDOA estimation in reverberant audio using angular spectra and clustering," in *Signal Processing*, vol. 92, No. 8, pp. 1950-1960, Aug. 2012.

D. Pavlidi et al., "Real-time multiple sound source localization using a circular microphone array based on single-source confidence measures," in *International Conference on Acoustics, Speech and Signal Processing* (*ICASSP*), pp. 2625-2628, Mar. 2012.

O. Yilmaz and S. Rickard, "Blind separation of speech mixtures via time-frequency masking," *IEEE Transactions on Audio, Speech, and Language Processing*, pp. 1830-1847, vol. 52, No. 7, Jul. 2004.

E. Fishier et al., "Detection of signals by information theoretic criteria: General asymptotic performance analysis," in *IEEE Transactions on Signal Processing*, pp. 1027-1036, vol. 50, No. 5, May 2002.

M. Puigt and Y. Deville, "A new time-frequency correlation-based source separation method for attenuated and time shifted mixtures," in *8th International Workshop on Electronics, Control, Modelling, Measurement and Signals 2007 and Doctoral School* (*EDSYS,GEET*), pp. 34-39, May 28-30, 2007.

G. Hamerly and C. Elkan, "Learning the *k* in *k*-means," in *Neural Information Processing Systems*, Cambridge, MA, USA: MIT Press, pp. 281-288, 2003.

B. Loesch and B. Yang, "Source No. estimation and clustering for underdetermined blind source separation," in *Proceedings International Workshop Acoustic Echo Noise Control* (*IWAENC*), 2008.

S. Araki et al., "Stereo source separation and source counting with MAP estimation with dirichlet prior considering spatial aliasing problem," in *Independent Component Analysis and Signal Separation, Lecture Notes in Computer Science. Berlin/Heidelberg, Germany: Springer* , vol. 5441, pp. 742-750, 2009.

A. Karbasi and A. Sugiyama, "A new DOA estimation method using a circular microphone array," in *Proceedings European Signal Processing Conference* (*EUSIPCO*), 2007, pp. 778-782.

S. Mallat and Z. Zhang, "Matching pursuit with time-frequency dictionaries," *IEEE Transactions on Signal Processing*, vol. 41, No. 12, pp. 3397-3415, Dec. 1993.

D. Pavlidi et al., "Source counting in real-time sound source localization using a circular microphone array," in *Proc. IEEE 7th Sensor Array Multichannel Signal Process. Workshop* (*SAM*), Jun. 2012, pp. 521-524.

A. Griffin et al., "Real-time multiple speaker DOA estimation in a circular microphone array based on matching pursuit," in *Proceedings 20th European Signal Processing Conference* (*EUSIPCO*), Aug. 2012, pp. 2303-2307.

P. Comon and C. Jutten, Handbook of Blind Source Separation: Independent Component Analysis and Applications, ser. Academic Press. Burlington, MA: Elsevier, 2010.

M. Cobos et al., "On the use of small microphone arrays for wave field synthesis auralization," *Proceedings of the 45th International Conference: Applications of Time-Frequency Processing in Audio Engineering Society Conference*, Mar. 2012.

H. Hacihabiboglu and Z. Cvetkovic, "Panoramic recording and reproduction of multichannel audio using a circular microphone array," in *Proceedings of the IEEE Workshop on Applications of Signal Processing to Audio and Acoustics* (*WASPAA 2009*), pp. 117-120, Oct. 2009.

K. Niwa A. et al., "Encoding large array signals into a 3D sound field representation for selective listening point audio based on blind source separation," in *Proceedings of the IEEE International Conference on Acoustics, Speech and Signal Processing* (*ICASSP* 2008), pp. 181-184, Apr. 2008.

V. Pulkki, "Spatial sound reproduction with directional audio coding," *Journal of the Audio Engineering Society*, vol. 55, No. 6, pp. 503-516, Jun. 2007.

F. Kuech et al., "Directional audio coding using planar microphone arrays," in Proceedings of the Hands-free Speech Communication and Microphone Arrays (HSCMA), pp. 37-40, May 2008.

O. Thiergart et al., "Parametric spatial sound processing using linear microphone arrays," in *Proceedings of Microelectronic Systems*, A. Heuberger, G. Elst, and R.Hanke, Eds., pp. 321-329, Springer, Berlin, Germany, 2011.

M. Kallinger et al., "Enhanced direction estimation using microphone arrays for directional audio coding," in *Proceedings of the Hands-free Speech Communication and Microphone Arrays* (*HSCMA*), pp. 45-48, May 2008.

M. Cobos et al., "A sparsity-based approach to 3D binaural sound synthesis using time-frequency array processing," *Eurasip Journal on Advances in Signal Processing*, vol. 2010, Article ID 415840, 2010.

S. Rickard and O. Yilmaz, "On the approximate w-disjoint orthogonality of speech," in *Proc. Of ICASSP*, 2002, vol. 1, pp. 529-532.

N. Ito et al., "Designing the wiener post-filter for diffuse noise suppression using imaginary parts of inter-channel cross-spectra," in *Proc. Of ICASSP*, 2010, pp. 2818-2821.

D. Pavlidi et al., "Real-time sound source localization and counting using a circular microphone array," *IEEE Trans. on Audio Speech, and Lang. Process*, vol. 21, No. 10, pp. 2193-2206, 2013.

(56) References Cited

OTHER PUBLICATIONS

L. Parra and C. Alvino, "Geometric source separation: merging convolutive source separation with geometric beamforming," *IEEE Transactions on Speech and Audio Processing*, vol. 10, No. 6, pp. 352-362, 2002.
V. Pulkki, "Virtual sound source positioning using vector based amplitude panning," *J. Audio Eng. Soc.*, vol. 45, No. 6, pp. 456-466, 1997.
J. Usher and J. Benesty, "Enhancement of spatial sound quality: A new reverberation-extraction audio upmixer," *IEEE Trans. on Audio Speech, and Lang. Process*, vol. 15, No. 7, pp. 2141-2150, 2007.
C. Faller and F. Baumgarte, "Binaural cue coding-part ii: Schemes and application," *IEEE Trans. on Speech and Audio Process*, vol. 11, No. 6, pp. 520-531, 2003.
M. Briand, et al., "Parametric representation of multichannel audio based on principal component analysis," in *AES 120th Conv.*, 2006.
M. Goodwin and J. Jot., "Primary-ambient signal decomposition and vector-based localization for spatial audio codding and enhancement," in *Proc. Of ICASSP*, 2007, vol. 1, pp. 1-9.
J. He et al., "A study on the frequency-domain primary-ambient extraction for stereo audio signals," in *Proc. Of ICASSP*, 2014, pp. 2892-2896.
J. He et al., "Linear estimation based primary-ambient extraction for stereo audio signals," *IEEE Trans. on Audio, Speech and Lang. Process.*, vol. 22, pp. 505-517, 2014.
C. Avendano and J. Jot, "A frequency domain approach to multichannel upmix," *J. Audio Eng. Soc*, vol. 52, No. 7/8, pp. 740-749, 2004.
O. Thiergart et al. "Diffuseness estimation with high temporal resolution via spatial coherence between virtual first-order microphones," in *Applications of Signal Processing to Audio and Acoustics* (*WASPAA*), 2011, pp. 217-220.
G. Carter et al, "Estimation of the magnitude-squared coherence function via overlapped fast fourier transform processing," *IEEE Trans. on Audio and Electroacoustics*, vol. 21, No. 4, pp. 337-344, 1973.
Santamaria and J. Via, "Estimation of the magnitude squared coherence spectrum based on reduced-rank canonical coordinates," in *Proc. Of ICASSP*, 2007, vol. 3, pp. III-985.
D. Ramirez, J. Via and I. Santamaria, "A generalization of the magnitude squared coherence spectrum for more than two signals: definition, properties and estimation," in *Proc. Of ICASSP*, 2008, pp. 3769-3772.
B. Cron and C. Sherman, "Spatial-correlation functions for various noise models," *J. Acoust. Soc. Amer.*, vol. 34, pp. 1732-1736, 1962.
Cox et al., "Robust adaptive beamforming," *IEEE Trans. on Acoust., Speech and Signal Process.*, vol. 35, pp. 1365-1376, 1987.
L.M. Kaplan et al., "Bearings-only target localization for an acoustical unattended ground sensor network," Proceedings of Society of Photo-Optical Instrumentation Engineers (SPIE), vol. 4393, pp. 40-51, 2001.
A. Bishop and P. Pathirana, "Localization of emitters via the intersection of bearing lines: A ghost elimination approach," IEEE Transactions on Vehicular Technology, vol. 56, No. 5, pp. 3106-3110, Sep. 2007.
A. Bishop and P. Pathirana, "A discussion on passive location discovery in emitter networks using angle-only measurements," International Conference on Wireless Communications and Mobile Computing (IWCMC), ACM, pp. 1337-1343, Jul. 2006.
J. Reed et al., "Multiple-source localization using line-of-bearing measurements: Approaches to the data association problem," IEEE Military Communications Conference (MILCOM), pp. 1-7, Nov. 2008.
M. Swartling et al., "Source localization for multiple speech sources using low complexity non-parametric source separation and clustering," Signal Processing, vol. 91, Issue 8, pp. 1781-1788, Published Aug. 2011, Available Online Feb. 2011.
A. Alexandridis et al., "Directional coding of audio using a circular microphone array," IEEE International Conference on Acoustics, Speech and Signal Processing (ICASSP), pp. 296-300, May 2013.
A. Alexandridis et al., "Capturing and Reproducing Spatial Audio Based on a Circular Microphone Array," Journal of Electrical and Computer Engineering, vol. 2013, Article ID 718574, pp. 1-16, 2013.
M. Taseska and E. Habets, "Spotforming using distributed microphone arrays," IEEE Workshop on Applications of Signal Processing to Audio and Acoustics, Oct. 2013.

* cited by examiner $$\psi_{\epsilon,n} = \begin{bmatrix} \psi_{1,n} \\ \psi_{2,n} \\ \psi_{3,n} \\ \psi_{4,n} \end{bmatrix}$$

SOUND SOURCE LOCALIZATION AND ISOLATION APPARATUSES, METHODS AND SYSTEMS

CROSS-REFERENCE TO RELATED APPLICATIONS

This application claims priority under 35 U.S.C. §119 to U.S. Provisional Patent Application No. 61/909,882, filed Nov. 27, 2013, which is expressly incorporated by reference herein in its entirety.

This application is a continuation-in-part of U.S. patent application Ser. No. 14/294,095 (Inventors: Anastasios Alexandridis, Anthony Griffin, and Athanasios Mouchtaris) titled, "Sound Source Characterization Apparatuses, Methods and Systems," filed on Jun. 2, 2014, which in turn is a continuation-in-part of U.S. patent application Ser. No. 14/038,726 (Inventors: Despoina Pavlidi, Anthony Griffin, and Athanasios Mouchtaris) titled, "Sound Source Characterization Apparatuses, Methods and Systems," filed on Sep. 26, 2013, which claims benefit of U.S. Provisional Patent Application No. 61/706,073, filed on Sep. 26, 2012, all of which are expressly incorporated by reference herein in their entirety.

This application may contain material subject to copyright or other intellectual property protection. The respective owners of such intellectual property have no objection to the facsimile reproduction of the disclosure as it appears in documents published by the U.S. Patent and Trademark Office, but otherwise reserve all rights whatsoever.

BACKGROUND

The subject matter disclosed herein relates generally to apparatuses, methods, and systems for sound source characterization and more particularly to SOUND SOURCE LOCALIZATION AND ISOLATION APPARATUSES, METHODS, AND SYSTEMS ("SSL").

SUMMARY

This summary is not intended to identify essential features of the claimed subject matter nor is it intended for use in determining or limiting the scope of the claimed subject matter.

A spatial sound localization system is described. The system includes a memory, a network and a processor. The processor is in communication with the memory and the network, and configured to issue a plurality of processing instructions stored in the memory, wherein the processor issues instructions to obtain a plurality of direction of arrival (DOA) estimates from the plurality of sensors, discretizes an area of interest into a plurality of grid points, calculates, via the processor, DOA at each of grid points, comparing, via the processor, the DOA estimates with the computed DOAs. If the number of sources is more than 1, the system obtains via the processor, a plurality of combinations of DOA estimates, from amongst the plurality of combinations, estimates one or more initial candidate locations corresponding to each of the combinations, and selects location of the sources from amongst the initial candidate locations.

BRIEF DESCRIPTION OF THE DRAWINGS

Exemplary embodiments of the SSL are described with reference to the accompanying figures. In the figures, the left-most digit(s) of a reference number identifies the figure in which the reference number first appears. The same numbers are used throughout the figures to reference like features and components.

Figure 1A:
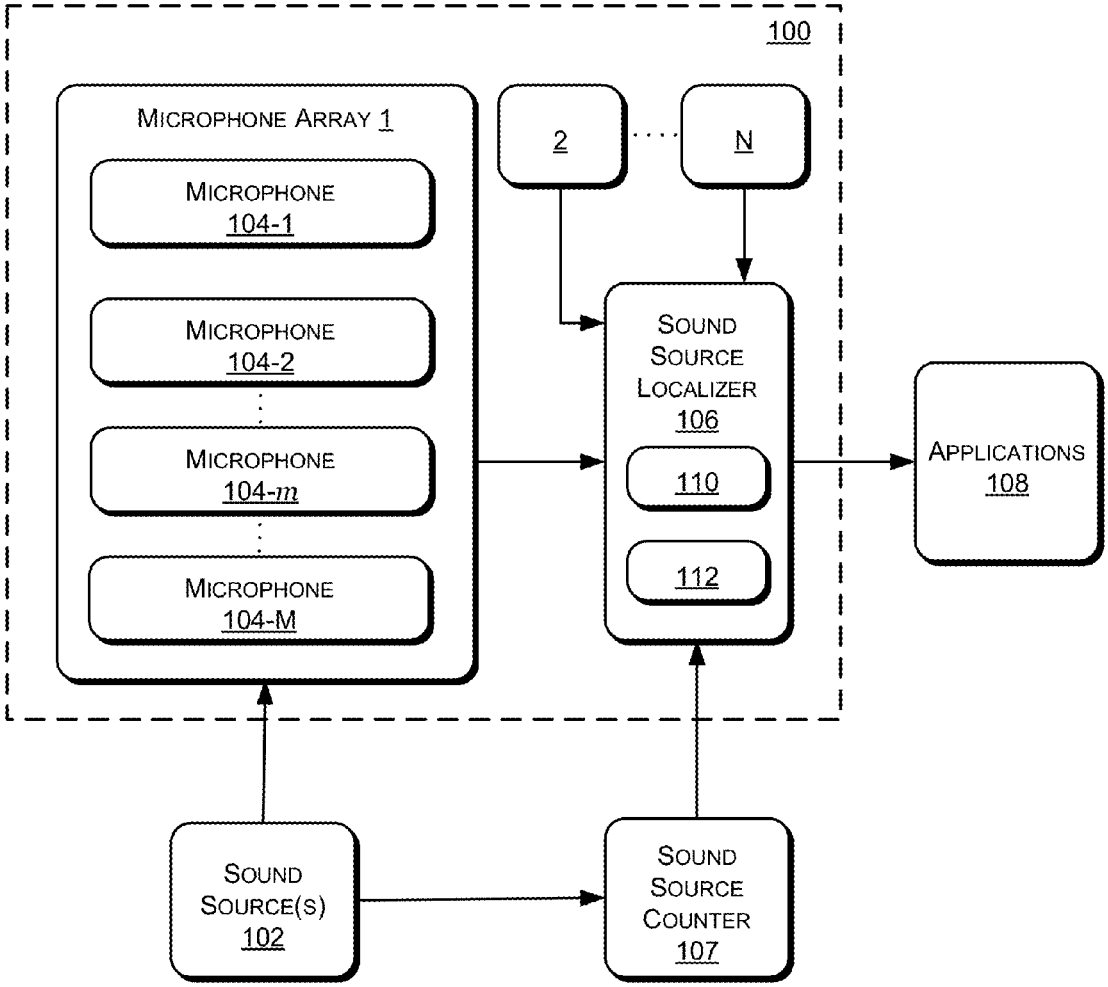
FIGS. 1A and 1B are exemplary block diagrams of an SSL system configured to obtain and process sound signals to capture spatial sound characterization information, according to an embodiment of SSL.

It should be appreciated by those skilled in the art that any block diagrams herein represent conceptual views of illustrative systems. The order in which the methods are described are not intended to be construed as a limitation, and any number of the described method blocks can be combined in any order to implement the methods, or an alternative method. Additionally, individual blocks may be deleted from the methods without departing from the spirit and scope of the subject matter described herein. Furthermore, the methods can be implemented in any suitable hardware, software, firmware, or combination thereof.

DETAILED DESCRIPTION

SOUND SOURCE LOCALIZATION AND ISOLATION APPARATUSES, METHODS AND SYSTEMS ("SSL") are described herein. Localization of a source from its acoustic emissions, such as a voice, cries, movement noise, footsteps, sound of an instrument, etc., may be useful to determine the position of an entity. Further, spatial sound recording and reproduction may be useful to provide surround sound experience to a listener. Examples of applications for sound source localization include, but are not limited to, entertainment systems for reproducing concerts, playing movies, playing video games, and teleconferencing.

To reproduce a soundscape, spatial information need to be preserved. The soundscape is usually encoded into a plurality of channels and reproduction is performed using a plurality of loudspeakers or headphones. In order to do this accurately and in a manner that does not require a very dense distribution of microphones throughout the area to be monitored, microphones may be treated as a plurality of arrays to jointly process the sound signals. The use of microphone arrays for spatial audio recording has attracted attention, due to their ability to perform operations such as Direction-of-Arrival (DOA) estimation and beamforming.

The microphone or microphone arrays may be used in conjunction with various methods to determine the direction of arrival (DOA) of signals from the sound sources to perform many operations, such as beam-forming, speech enhancement, and distant sound acquisition. However, in many scenarios both the DOA and the actual location of a sound source in space are desired. For example, methods may be used to determine the location of speakers in a room during a teleconference. Additionally, a richer set of inputs, such as DOA and actual location information, allows for an efficient capture of spatial sound and amplification, localization and isolation of sound sources. Generally, methods either focus on scenarios where only a single sound source or microphone is active, or provide computationally intensive solutions that cannot be executed efficiently in real-time where a plurality of sound sources are active simultaneously. Some methods rely on the assumption that the microphone arrays are part of wired sensor networks. Some other methods are based on wireless acoustic sensor networks (WASNs), where a number of microphones or microphone arrays are distributed over an extended area. WASNs offer flexibility in sensor placement and are also able to provide better spatial coverage and localization information.

Generally, source localization in a WASN is challenging as the sensor network poses many constraints related to time-synchronization, power and bandwidth limitations, and the like. For these reasons, approaches that require the transmission of the full audio signals to a central processing node are often unsuitable as they are bandwidth consuming, and the required transmission power can reduce the battery-life of the sensors. Moreover, such approaches require the signals to be synchronized. Certain approaches circumvent the problem of synchronization by using special nodes that use internal Global Positioning System (GPS) chips to resample the audio samples with a network-common time-stamp. However, the full audio signals still need to be transmitted to a central processing node that may be coupled to a plurality of microphone arrays.

By allowing increased computational ability in the nodes, the absolute minimum transmission bandwidth can be attained when each sensor node only transmits DOA estimates to the central processing node. Localization using bearing-only (i.e., DOA) estimates can also tolerate unsynchronized outputs provided that the sources are static or that they move at a slow rate relative to the analysis frame.

The bearing-only localization can be determined using closed-form solutions such as the Stansfield estimator, a weighted linear least squares estimator. While simple in their implementation, these linear least squares methods suffer from increased estimation bias.

Furthermore, the aforementioned methods typically only consider the problem of localizing a single source. However, in many realistic scenarios a plurality of sources may co-exist in an area and the location of all sources may be required. Similar to single-source localization, bearing-only source localization of acoustic sources poses many challenges. First of all, there is the so-called data association problem, where the central processing node receiving DOA estimates for a plurality of sources from the different sensors cannot distinguish to which source the DOA estimates belong. Erroneous DOA combinations across the sensors can result in "ghost sources" that do not correspond to real sources. Localization of a plurality of sources by angle and frequency measurements has been considered, but such methods fail if the sources contain overlapping frequencies, and thus cannot be applied to the case of acoustic sources. A method for localization of a plurality of sources using non-linear least squares that tries to overcome the data association problem have also been examined. In this method, however, the problem of ghost sources is not eliminated, leading to severe performance degradation. Additionally, when the sources are close together, some arrays may only detect one source. As a result, the DOAs of some sources from some sensors may be missing, making them computationally inefficient.

Embodiments of SSL offer computationally efficient solutions to at least the problems identified above while providing additional features and advantages. For example, SSL addresses the problem of the missing DOA estimates as a function of the sources' locations. Embodiments of SSL disclose methods and systems for localizing one or more sources using, for example, far-field DOA measurements in an indoor or outdoor WASN. Moreover, SSL discloses an iterative grid-based DOA estimator for providing localization information. Other iterative solutions for source localization have been used in the past, such as Steered Response Power (SRP) based approaches; however, when applied to a WASN, these approaches require a significantly higher amount of information to be transmitted to the central processing node.

Some embodiments of SSL include methods and systems to localize single sources and a plurality of sources in an acoustic network. In one implementation, the computational efficiency of SSL allows SSL to be extended to localize a plurality of sources. In one implementation, the single-source grid-based method is applied to each possible combination of DOA measurements from the sensors. Then, to decide on the actual source locations, the data association is determined using exemplary methods, which may be based on the estimated source locations and the corresponding DOA combinations. Embodiments of SSL can be implemented in real-time to provide accurate results.

The exemplary simulations implemented by the SSL to model the DOA estimation error and consider the problem of missing DOAs as a function of source location, makes the simulations more realistic than simulations considered thus far.

Additionally, in one implementation of SSL, only DOA estimates are transmitted to the central processing node, keeping bandwidth requirements to the minimum. When localizing a single source, the exemplary grid-based DOA estimator maintains the accuracy of standard approaches, such as Non-Linear Least Square DOA estimator, while performing much better in terms of computation time.

Further, according to an embodiment, the SSL includes methods and systems for capturing and reproducing spatial audio information based at least on sound localization information from a single or a plurality of simultaneously active sources, and where the sources may be coupled to a single or a plurality of sensor arrays. According to an implementation, the SSL may be configured to: count the number of active sources at each time instant or at predefined time intervals; estimate the directions of arrival of the active sound sources on a per time-frame basis; and perform source separation with a beamformer. For example, a fixed superdirective beamformer may be implemented, which results in more accurate modeling and reproduction of the recorded acoustic environment.

In one implementation, the separated source signals can be filtered as per W-disjoint orthogonality (WDO) conditions. According to one definition, WDO assumes that the time-frequency representation of multiple sources do not overlap. In one implementation, the separated source signals are downmixed into one monophonic audio signal, which, along with side information, can be transmitted to the reproduction/decoder. In one implementation, reproduction is possible using either headphones or an arbitrary loudspeaker configuration or any other means.

In one implementation, source counting and corresponding localization estimation may be performed by processing a mixture of signals/data received by a plurality of sensing devices, such as microphones arranged in one or more arrays, and by taking into account the known array geometry and/or correlation between signals from one or more pairs or other combinations of sensing devices in the array. In one implementation, the SSL may partition the incoming signals/data from the sensing devices in overlapping time frames. The SSL may then apply joint-sparsifying transforms to the incoming signals in order to locate single-source analysis zones. In one implementation, each single-source analysis zone is a set of frequency adjacent time-frequency points. The SSL may assume that for each source there exists at least one single-source constant time analysis zones, interchangeably referred to as single-source analysis zone, where that source is dominant over others. The cross-correlation and/or auto-correlation of the moduli of time-frequency transforms of signals from various pairs of microphones are analyzed to identify single-source analysis zones based at least on a correlation coefficient/measure.

In some embodiments, a strongest frequency component of a cross-power spectrum of time-frequency signals from a pair of microphones may be used to estimate a DOA for each of the sources relative to a reference axis. This may be performed either simultaneously or in an orderly manner for each of the detected single-source analysis zones. In other embodiments, a selected number of frequency components may be used for DOA estimation. The estimated DOAs for each sound source may be clustered and the DOA density function may be obtained for each source over one or more portions of the signals. A smoothed histogram may be obtained by applying a filter having a window length $h_N$ and a predetermined number of frames. Additionally or alternatively, in one implementation, the number of sources may also be estimated from the histogram of DOA estimates, such as by using peak search or linear predictive coding. In some embodiments, the number of sources may be estimated from the histogram of DOA estimates using a matching pursuit technique. Additionally, refined and more accurate values of DOAs are generated corresponding to each of the estimated sources based at least on the histogram. While certain implementations may have been described to estimate the number of sources and their respective locations, it will be understood that other implementations are possible.

In some embodiments, the localization information relating to source locations and count may be specified by a user or obtained from a storage device. Some embodiments described herein allow for joint DOA estimation and source counting. The number of sources and directional information so obtained may be sent to the following processing stages. For example, the localization information from the DOA estimator and source counter may be used to separate source signals using spatial filtering methods and systems, such as at least one beamformer. In some embodiments, for example in cases where the number of sound sources is large (e.g., orchestra), the beamformer may scan the sound field at received locations. This may occur either based on locations specified by a DOA estimation module or by a user. In some embodiments, the beamformer may use both types of localization information, i.e., estimated and user-specified, in parallel and then combine the results in the end. In yet another embodiment, the beamformer may use a mix of localization information from the module and user, by identifying dominant directional sources and less directional or spatially-wide/extended sound sources, to yield beamformer output signals.

In some embodiments, SSL may include a post-filter to apply binary masks on the beamformer output signals to enhance the source signals. For example, in one implementation, source signals may be multiplied with corresponding orthogonal binary masks to yield estimated source signals.

Some embodiments include a downmixer or a reference signal generator to combine the estimated source signals into a single reference signal. The combination may be a logical summation or any other operation. Furthermore, weights may be added to certain signals. Further, side information may also be extracted. In one implementation, the side information includes the direction of arrival for each frequency bin. In one implementation, the side information and the time-domain downmix signal are sent to the decoder for reproduction. Both of these types of information may be encoded. For example, the side information may be encoded based on the orthogonality of binary masks.

Some embodiments of the methods and systems described herein method consider only the spatial aliasing-free part of the spectrum to estimate the DOAs, so spatial aliasing does not affect the DOA estimates. Spatial aliasing may affect the beamformer performance, degrading source separation. However, as experimental results indicate, such degradation in source separation is unnoticeable to listeners. Moreover, since a different DOA for each time-frequency element is not estimated, the method does not suffer from erroneous estimates that may occur due to the weakened W-disjoint orthogonality (WDO) hypothesis when a plurality of sound sources are active. The listening test results show that this approach to modeling the acoustic environment is more effective certain array-based approaches. Moreover, based on the downmixing process, the separated source signals and thus the entire sound field are encoded into one monophonic signal and side information. During downmixing, the method assumes WDO conditions, but at this stage the WDO assumption does not affect the spatial impression and quality of the reconstructed sound field. One of the reasons is that compared to other methods, WDO conditions are not relied upon to extract the directional information of the sound field, but only to downmix the resulting separated source signals. Another issue is that source separation through spatial filtering results in musical noise in the filtered signals, a problem which is evident in almost all blind source separation methods. However, in some embodiments, the separated signals are rendered simultaneously from different directions, which eliminates the musical distortion.

Some embodiments of the methods and systems can be extended to a plurality of microphone arrays by allowing the arrays to cooperate during spatial feature extraction. Thus, the sound scene can be rendered using both direction and distance information. Further, specific spots of the captured sound scene can be selectively reproduced.

Embodiments of the methods and systems described herein can offer lower computational complexity, higher sound quality, and higher accuracy as compared to existing solutions for spatial sound characterization, can operate in both real-time and offline modes (some implementations operate with less than or about 50% of the available processing time of a standard computer), and provide relaxed sparsity constraints on the source signals compared to conventional methods. Embodiments of SSL are configured to operate regardless of the kind of sensing array, array topologies, number of sources and separations, SNR conditions, and environments, such as, for example, anechoic/reverberant, and/or simulated/real environments. Furthermore, the encoding and decoding of directional sound as described herein allows for a more natural reproduction of sound recording, thereby allowing recreation of the original scene as closely as possible.

SSL may find various applications in the field, such as for teleconferencing, where knowledge of spatial sound can be used to create an immersive and more natural way of communication between two parties, or to enhance the capture of the desired speaker's voice, thus replacing lapel microphones. Other applications include, but are not limited to, gaming, entertainment systems, media rooms with surround sound capabilities, next-generation hearing aids, or any other applications which could benefit from providing a listener with a more realistic sensation of the environment by efficiently extracting, transmitting and reproducing spatial characteristics of a sound field.

Certain embodiments of SSL may be configured for use in standalone devices (e.g., PDAs, smartphones, laptops, PCs and/or the like). Other embodiments may be adapted for use in a first device (e.g., USB speakerphone, Bluetooth microphones, Wi-Fi microphones and/or the like), which may be connected to a second device (e.g., computers, PDAs, smartphones and/or the like) via any type of connection (e.g., Bluetooth, USB, Wi-Fi, serial, parallel, RF, infrared, optical and/or the like) to exchange various types of data (e.g., raw signals, processed data, recorded data and or signals and/or the like). In such embodiments, all or part of the data processing may happen on the first device, in other embodiments all or part of the data processing may happen on the second device. In some embodiments there maybe more than two devices connected and performing different functions and the connection between devices and processing may happen in stages at different times on different devices. Certain embodiments may be configured to work with various types of processors (e.g., ARM, Raspberry Pi and/or the like).

While aspects of the described SSL can be implemented in any number of different systems, circuitries, environments, and/or configurations, the embodiments are described in the context of the following exemplary system(s) and circuit(s). The descriptions and details of well-known components are omitted for simplicity of the description.

The description and figures merely illustrate exemplary embodiments of the SSL. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Aspects of the SSL as described herein may be configured to process the captured signal as a series of short-time segments or time frames. Typical segment lengths range from about five or ten milliseconds to about forty or fifty milliseconds, and the segments may be overlapping (e.g., with adjacent segments overlapping by 25% or 50%) or non-overlapping. In one particular example, the signal is divided into a series of non-overlapping time segments or "frames", each having a length of ten milliseconds. A segment as processed by such a method may also be a segment (i.e., a "subframe") of a larger segment as processed by a different operation, or vice versa.

Reference to an "embodiment" in this document does not limit the described elements to a single embodiment; all described elements may be combined in any embodiment in any number of ways. Furthermore, for the purposes of interpreting this specification, the use of "or" herein means "and/or" unless stated otherwise. The use of "a" or "an" herein means "one or more" unless stated otherwise. The use of "comprise," "comprises," "comprising," "include," "includes," and "including" are interchangeable and not intended to be limiting. Also, unless otherwise stated, the use of the terms such as "first," "second," "third," "upper," "lower," and the like do not denote any spatial, sequential, or hierarchical order or importance, but are used to distinguish one element from another. It is to be appreciated that the use of the terms "and/or" and "at least one of", for example, in the cases of "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

OVERVIEW

Figure 1B:
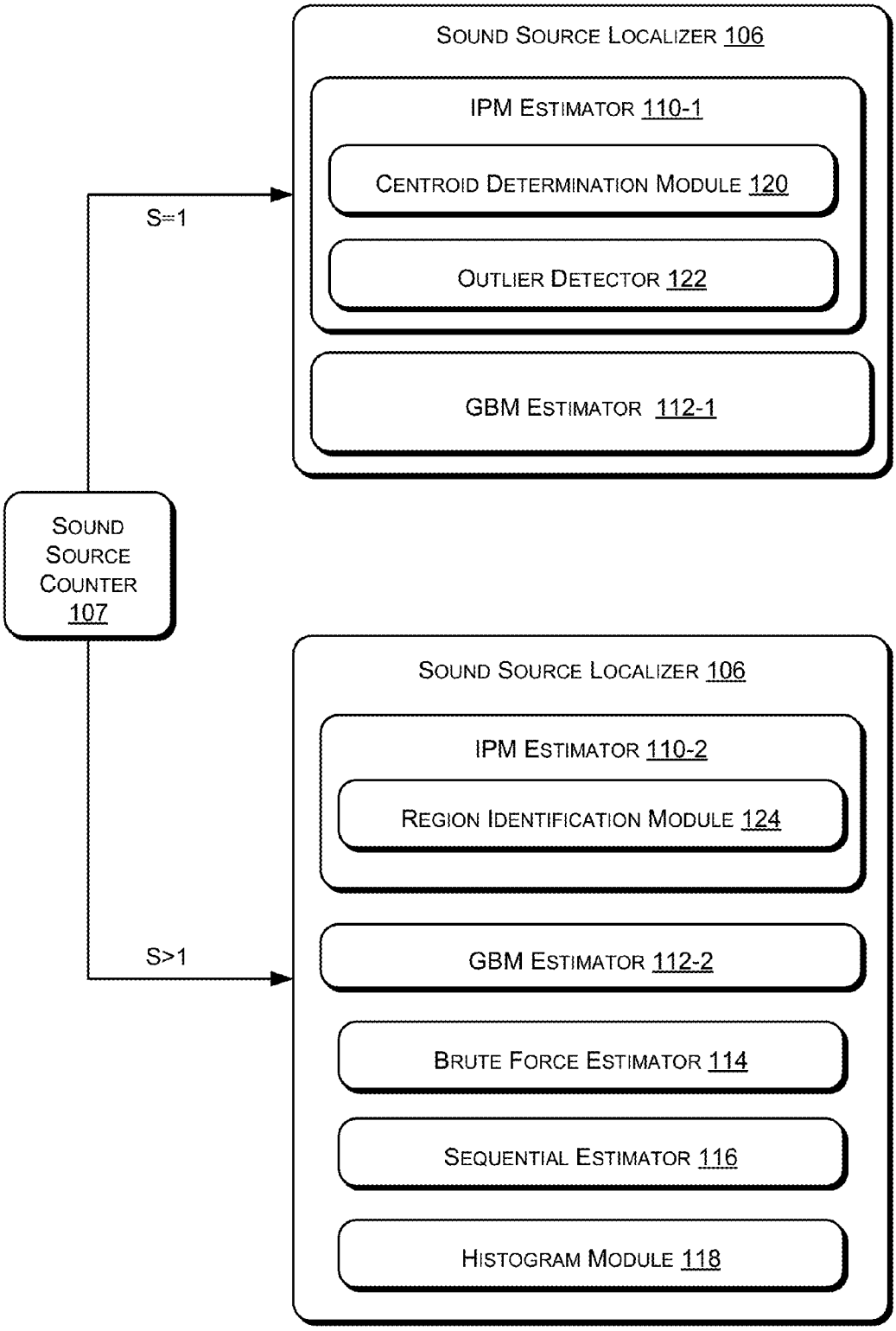

FIGS. 1A and 1B are exemplary block diagrams of SSL configured to receive sound signals generated by one or more S active sound source(s) 102 through a plurality of sound sensing devices, 104-1, 104-2 . . . 104-*m*, . . . 104-M (collectively referred to as 104), which may or may not be arranged in one or more sensor arrays 1, 2, . . . N. It will be understood that even though only one sensor or microphone array is shown to include sensing devices, other microphone arrays also include a distinct arrangement of sensing devices 104.

In one implementation, sensing devices may be microphones, capable of detecting mechanical waves, such as sound, from one or more sources. In one implementation, microphones 104 are arranged in a circular array. In other implementations, microphones 104 may be arranged in other configurations, such as triangle, square, straight or curved line or any other configuration. For example, in some embodiments, microphones 104 may be arranged in a uniform circular array to detect sound signals from at least one sound source. Some embodiments may be configured to work with various types of microphones 104 (e.g. dynamic, condenser, piezoelectric, MEMS and the like) and signals (e.g. analog and digital). The microphones 104 may or may not be equispaced and the location of each microphone relative to a reference point and relative to each other may be known. Some embodiments may or may not comprise one or more sound sources, of which the position relative to the microphones 104 may be known. Even though the following description mostly discusses audible sound waves, it will be understood that the SSL may be configured to accommodate signals in the entire range of frequencies and may also accommodate other types of signals (e.g. electromagnetic waves and the like).

In one implementation, SSL may include an exemplary sound source localizer 106 that can process the signals received from each of the microphone arrays to provide sound localization information, such as DOA corresponding to each source, location of the sound source, location of the microphone and the like. In one implementation, the sound source localizer 106 may be selected based on one or a combination of various factors, such as the number of sound sources, level of computational complexity, computational efficiency, processing time, application, and the like. One such configuration is shown in FIG. 1, where the sound source localizer 106 is selected based on the number of sound sources, and the number of sound sources is provided by the sound source counter 107. In other embodiments, the sound source counter 107 may be replaced by or integrated with a parameter selector (not shown) to allow a user to vary the factors, e.g., to simulate and monitor SSL's behavior and adapt the SSL for different environments and sensor arrangements. The localization information from the sound source localizer 106 can be used in a variety of applications 108, such as sound source separation, for example.

In one embodiment, SSL includes an acoustic network 100, e.g., a wireless acoustic sensor network (WASN), whose M nodes are each equipped with a microphone array, interchangeably referred to as a sensor. Each node can generate a DOA estimate for any source that it can detect or any source whose signal-to-noise ratio (SNR) at the node is high enough to be detected. In one implementation, each of the node's estimates consist of direction only, and no range information, thus a single node's DOA estimates may not be sufficient to obtain absolute positions for sources. In one implementation, the x- and y-coordinates of the locations of the $m^{th}$ node may be given by $q_m$:

$$q_m=[q_{x,m}q_{y,m}]^T \tag{1}$$

and, similarly, the x- and y-coordinates of the location of the $s^{th}$ source can be given by $p_s$:

$$p_s=[p_{x,s}p_{y,s}]^T \tag{2}$$

Given S active sound sources, the 2S×1 position vector of all the sources can be written as:

$$p_s=[p_1^T p_2^T \ldots p_s^T \ldots p_S^T]^T \tag{3}$$

and the DOA vector of the $m^{th}$ node can be defined as:

$$\theta_m(p) = [h_{m,1}\ h_{m,2}\ \ldots\ h_{m,s}\ h_{m,s}]^T \tag{4}$$

where $$h_{m,s} = \arctan\frac{p_{y,s} - q_{y,m}}{p_{x,s} - q_{x,m}} \tag{5}$$

with arctan(.) denoting the four-quadrant arctangent function of the argument that returns an angle in the range of [0, 2π).

In the ideal scenario where the microphone array at each node is able to detect all sources, the $m^{th}$ array outputs an S×1 vector of noisy DOA measurements:

$$\hat{\theta}_m=\theta_m(p)+\eta_m \tag{6}$$

where $\theta_m$ is the DOA noise at the $m^{th}$ sensor, which is assumed to be zero-mean Gaussian with covariance matrix $\Sigma_m=\mathrm{diag}(\sigma_{m,1}^2, \sigma_{m,2}^2, \ldots, \sigma_{m,S}^2)$. The variance of the DOA noise at each node can depend on several factors, such as the DOA estimation method used and the SNR of the source signals at the nodes. Moreover, reverberation can also affect the DOA estimation method, resulting in estimates with a greater amount of noise.

Even though the description may assume localization in the two dimensions, it will be understood that the systems and methods disclosed herein can be extended to situations when the sound sources are located at different elevation angles from the microphone arrays, as long as the arrays and the sources lie approximately in the same plane. As shown in FIG. 1B, in one implementation, the sound source counter 107 provides a count of the sources (S). Accordingly, the sound source localizer 106 adapted for a single source or a plurality of sources may be used. For example, if S=1, the sound source localizer 106 includes an Intersection Point Method (IPM) estimator 110-1 and/or a Grid-Based Method (GBM) estimator 112-1, which are configured to localize single sources. In one implementation, the IPM estimator 110-1 may further include a centroid determination module 120 and an outlier detector 122. In practical scenarios, it is possible that some sensors may only detect one source, for example when the sources are too close to one another. As a result, some of the DOAs of some sources may be missing. Therefore, in one implementation, the sound source localizer 106 is configured to localize a plurality of sources as well. Therefore, in another example, if S>1, the sound source localizer 106 includes IPM estimator 110-2 and/or GBM estimator 112-2, which are configured to localize a plurality of sources. The IPM estimator 110-2 may include a region identification module 124, and the GBM estimator 112-2 may further include a brute force estimator 114, a sequential estimator 116, and/or a histogram module 118, all configured to resolve the data association problem. In other implementations, the brute force estimator 114, a sequential estimator 116, and/or a histogram module 118, may be associated with the IPM estimator 110-2 or other such estimators. The IPM estimators 110-1 and 110-2, in one implementation, may be based on an intersection-point (IP) method while the GBM estimators 112-1 and 112-2 may be based on a grid-based (GB) method (static or iterative), both of which are the described in the foregoing paragraphs.

Figure 2:
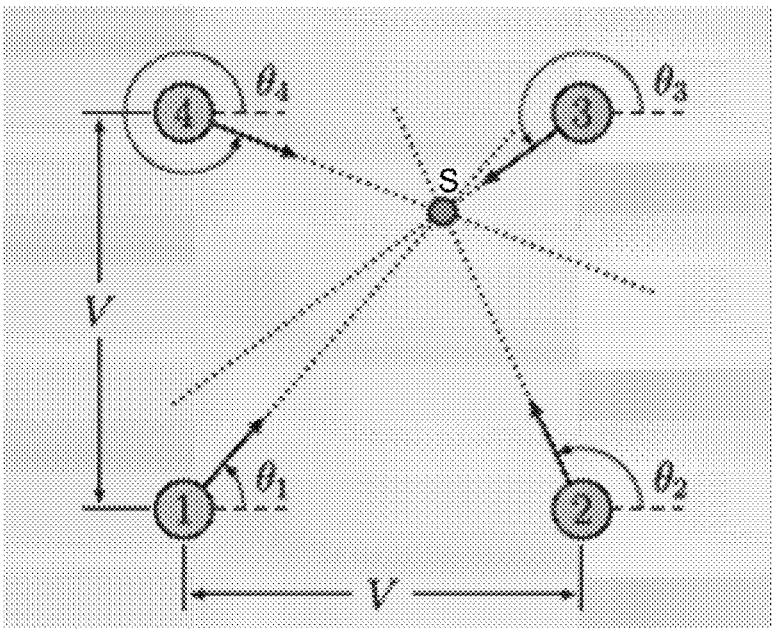
FIG. 2 is an exemplary network cell diagram having four sensor nodes that are V distance apart, and are associated with DOA estimates (θ) to a lone source, according to an embodiment of SSL.

Single-Source Localization from a Plurality of DOA Estimates:

FIG. 2 is an example network cell diagram having four sensor nodes labeled 1, 2, 3, and 4 that are V distance apart, and having DOA estimates ($\theta_1$, $\theta_2$, $\theta_3$, and $\theta_4$) associated with the lone source, labeled S. In an ideal case, for example a case where DOA estimates match the actual DOA values, the source can be localized by finding the points where lines passing through the DOA estimates intersect. But, in practice or in any realistic simulation, the DOA estimates may not be perfect and may not intersect at the same point.

Since, only one source is being considered, (2) and (3) reduce to:

$$p=[p_x p_y]^T \tag{7}$$

Generally, DOA estimators such as, Linear Least Square (LLS) estimator and Non-Linear Least Square (NLS) estimator, have known to be used for localization of the single source. However, both of these approaches have performance limitations, which are discussed in the subsequent paragraphs.

In its simplest form, the linear least squares (LLS) estimator can be described in the following manner. Given the DOA measurement $\hat{\theta}_m$ from the $m^{th}$ microphone array, the source is assumed to be located on the line described by:

$$q_{x,m} \sin \hat{\theta}_m - q_{y,m} \cos \hat{\theta}_m = p_x \sin \hat{\theta}_m - p_y \cos \hat{\theta}_m \tag{8}$$

Using all the DOAs from the M sensors leads to the following system of linear equations with two unknowns:

$$Ap = b \tag{9}$$

where $$A = \begin{bmatrix} \sin\hat{\theta}_1 & -\cos\hat{\theta}_1 \\ \vdots & \vdots \\ \sin\hat{\theta}_M & -\cos\hat{\theta}_M \end{bmatrix}$$

and

-continued $$b = \begin{bmatrix} q_{x,1}\sin\hat{\theta}_1 - q_{y,1}\cos\hat{\theta}_1 \\ \vdots \\ q_{x,M}\sin\hat{\theta}_M - q_{y,M}\cos\hat{\theta}_M \end{bmatrix}$$

As the DOA measurements are contaminated by noise, an exact solution to (9) cannot be found, so the linear least squares solution is used and the location estimate is found as:

$$\hat{p}_{LLS}=(A^TA)^{-1}A^Tb \tag{10}$$

While simple in their implementation, the LLS estimators suffer from increased estimation bias. For this reason, maximum-likelihood (ML) and non-linear least squares (NLS) estimators have been investigated. The NLS estimator for the single-source case is the maximum-likelihood estimator when the DOA noise standard deviation is the same at all sensors. This approach aims at finding the location estimate $\hat{p}_{NLS}$ that minimizes the following cost function:

$$C(p) = \sum_{m=1}^{M} \left|\hat{\theta}_m - \hat{\theta}_m(p)\right|^2 \tag{11}$$

The minimization can be solved by using recursive gradient-descent methods and the location estimate from the linear least squares estimator can be used as an initial point to initialize the search.

However, as mentioned before, both these approaches suffer from certain performance limitations. To that end, some embodiments of SSL include DOA estimators, such as IPM estimators and GBM estimators, e.g., IPM estimator 110-1 and 110-2 (collectively referred to as 110) and GBM estimators 112-1 and 112-2 (collectively referred to as 112), as shown in FIG. 1B.

In one implementation of a single source localization, the IPM estimator 110-1 can estimate location of a single source by excluding one or more outliers from a pool of intersection points and evaluating a centroid from the remaining points of intersection. In one example, outliers may be defined as a pair of DOA estimates that are capable of erroneously estimating source location. In other words, outliers are caused by lines passing through the DOA estimates, hereinafter referred to as DOA lines, which are almost parallel. For this, the IPM estimator 110 may include a centroid determination module 120 to determine the centroid of the intersections of pairs of DOA lines, which may be formed by lines passing through pairs of DOA estimates. By one definition, centroid can be the mean of the set of intersection points, and minimize the sum of squared Euclidean distances between itself and each point in the set. The IPM estimator 110 further includes an outlier detector 122 that identifies intersection points that are a result of DOA lines that are substantially parallel. In one implementation, such determination may be based on a predefined parallelness threshold or slope value.

Figure 3A:
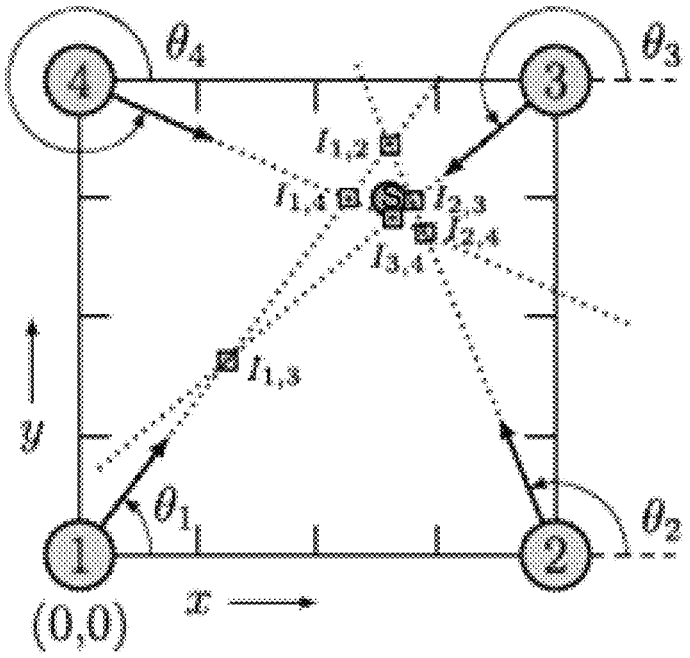
FIG. 3A is an exemplary network cell diagram for an intersection point based estimator, according to an embodiment of SSL.

The IPM estimator 110 is further explained with the example in FIG. 3A, that is an exemplary network cell having four sensor nodes where the DOA estimates have an error of up to ±5°, and the intersection points are labeled $I_{1,2}$-$I_{3,4}$. The locations of sensors 1-4 in said example are (0, 0), (4, 0), (4, 4), (0, 4), respectively, and the source, S, is at (2.6, 3.0). The estimated location from the centroid of the intersection points is (2.40, 2.77), which is a distance error of 0.43, or 11% of the inter-sensor spacing, V. FIG. 2 shows that the effect of $I_{1,3}$, an outlier, is significant. Such outliers are caused by DOA lines that are almost parallel. A small change in the slope of either of these lines, e.g., due to DOA estimation error, can move their point of intersection significantly. Thus, excluding the intersection points of pairs of DOA lines that are almost parallel improves the accuracy of the location estimation. In one implementation, the IPM estimator 110 detects and excludes outliers, such as $I_{1,3}$. In said example, by excluding this point from the centroid, the estimated location becomes (2.64, 2.99) and the error drops to 0.03, or 1% of V.

In one implementation, the IPM estimator 110 can also define the function A(X, Y), the minimum angular distance between X and Y, whose output will be in the range [0, π]. A simple and programmatically efficient implementation is to first ensure that X and Y are in the range [0, 2π), then by defining $$A_{X,Y}=(X-Y)(\text{mod } 2\pi) \tag{12}$$

$$A_{Y,X}=(Y-X)(\text{mod } 2\pi) \tag{13}$$

the minimum angular distance is given by:

$$A(X,Y)=\min(A_{X,Y},A_{Y,X}) \tag{14}$$

monitoring, health care for the elderly, etc.

Figure 3B:
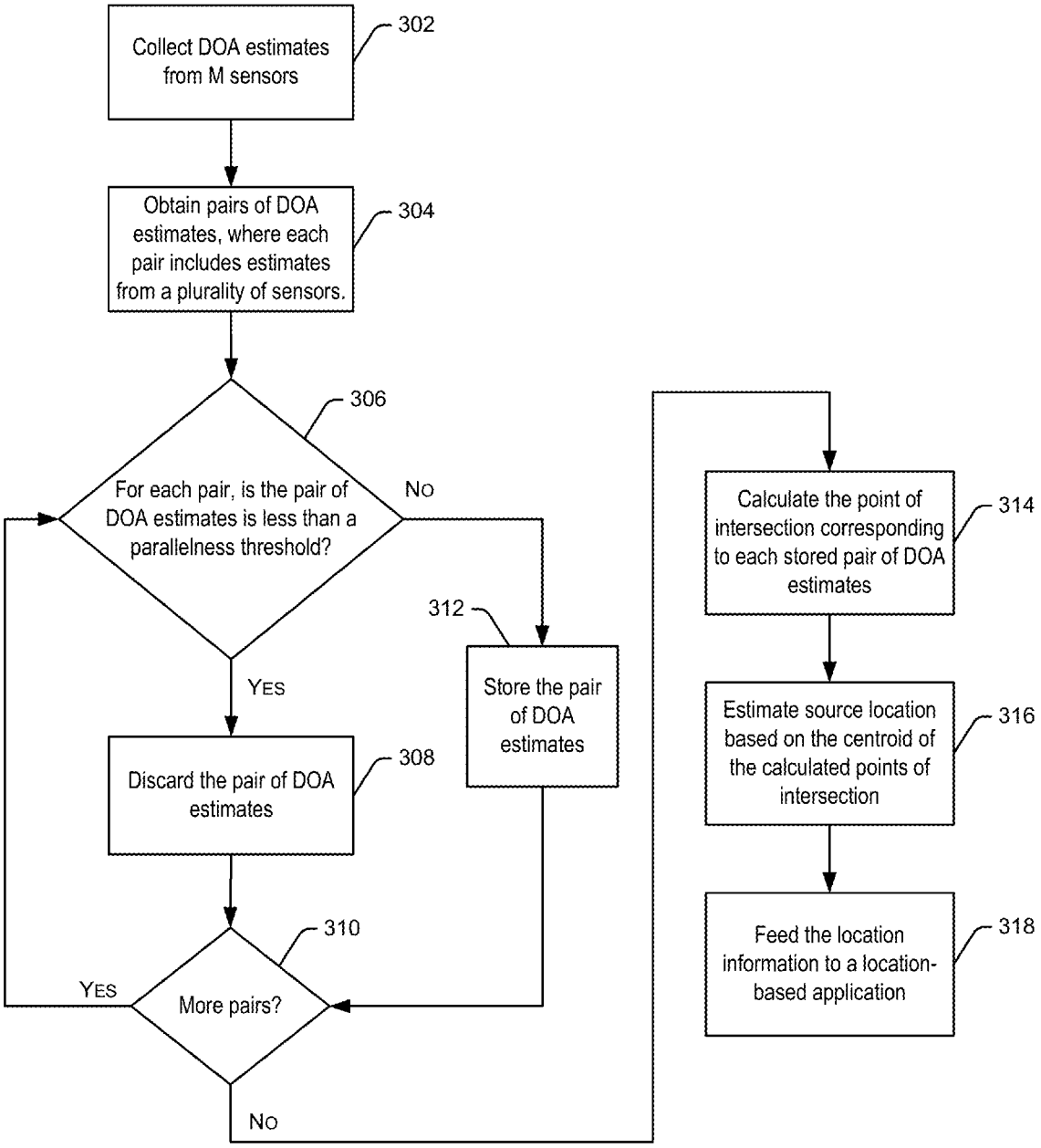
FIG. 3B is an exemplary flow chart of an intersection point based method for localizing a single-source using a multi-sensor array, according to an embodiment of SSL.

Given a "parallelness" threshold, $\gamma_{\|}$, the source localization implemented by an estimator, such as the IPM estimator 110 can be explained with the help of FIG. 3B. Referring to FIG. 3B, IPM estimator 110 collects M DOA estimates from sensors at block 302. At block 304, IPM estimator 110 obtains pairs of DOA estimates, where each pair is obtained from a distinct pair of sensors. In one implementation, the IPM estimator 110 can then determine intersection points based on the DOA estimates. For example, the IPM estimator 110 evaluates all possible pairs of DOA estimates $(\theta_{m_i}\theta_{m_j})$, $i\neq j$ obtained from sensors $m_i$ and $m_j$. At block 306, IPM estimator determines one or more intersection point outliers by comparing the DOA estimates with the parallelness threshold. For example, the estimator determines whether:

$$A(\theta_{m_i}\theta_{m_j})<\gamma_{\|} \tag{15}$$

OR $$A(\theta_{m_i}\theta_{m_j})<\pi-\gamma_{\|} \tag{16}$$

monitoring, health care for the elderly, etc.

If the answer to the determination is "Yes," i.e., if either of these conditions are met, the estimator discards that pair of DOA estimates at block 308 and moves to block 310. However, if the answer to that determination is "No," the estimator 110 stores the pair of DOA estimates that did not meet the threshold criterion, and then goes on to block 310 to further determine whether there are more pairs.

At block 310, it is determined whether more pairs are available. If yes, the pair is again subjected to the parallelness threshold test at block 306 and the process continues until no more pairs are available. When no more pairs exist ("No" branch of block 310), points of intersection are computed based on the stored DOA estimates computed at block 312 are used. This is shown at block 314.

At block 316, the estimator 110 estimates a source location $\hat{p}_{IP}$ based on the centroid of the calculated points of intersection, which in one implementation, do not include the intersection point outliers.

At block 318, the estimator 110 may feed the location information to a variety of sound based application, including but not limited to, security, wild-life monitoring, health care for the elderly, etc. Embodiments of SSL, as defined above, are computationally efficient and the resolution has no inherent limitations, since the resolution is only affected by the accuracy of the DOA estimates.

As shown in FIG. 1B, additionally or alternatively, some embodiments of SSL can include a GBM estimator, such as GBM estimator 112, to provide information related to single source localization. This is further explained with the help of FIGS. 4A and 4B. As described in the foregoing paragraphs, unlike the NLS estimator, the GBM estimator 112 does not need a good initial point to avoid convergence to a local minimum, and alleviates the computational burden of the minimization procedure implemented by the NLS in equation 11.

In one implementation, the GBM estimator 112 can discretize the search space by constructing a grid of N points over an area of interest. The estimator 112 then determines a grid point whose DOAs most closely match the estimated DOAs. In cases where the measurements are in angles, angular distances may be used as a measure of similarity than absolute distance. When compared to approaches that use absolute distances, this approach may provide a greater level of computationally efficiency and accuracy, particularly in the multiple source case.

Figure 4A:
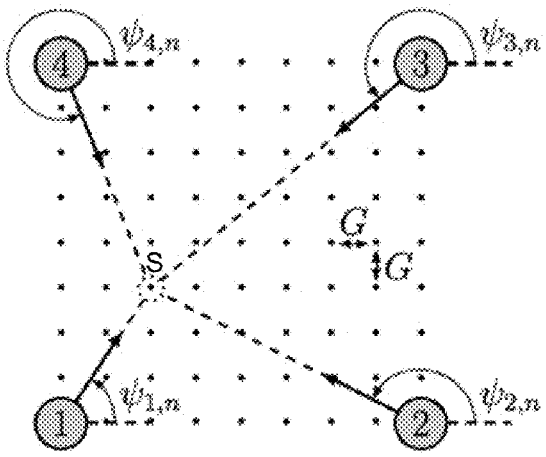
FIG. 4A is an exemplary network cell diagram for a grid based estimator, according to an embodiment of SSL.

The GBM estimator 112 can further be explained with the example FIG. 4A, that shows a cell with four nodes and DOAs to the $n^{th}$ grid point, and their associated column vector of Ψ. In one implementation, Ψ can be a (M×N) matrix, wherein $\Psi_{m,n}$ is the DOA from the $m^{th}$ sensor to $n^{th}$ grid point.

$$\Psi = \begin{bmatrix} \psi_{1,1} & \cdots & \psi_{1,n} & \cdots & \psi_{1,N} \\ \psi_{2,1} & \cdots & \psi_{2,n} & \cdots & \psi_{2,N} \\ \vdots & & \vdots & & \vdots \\ \psi_{m,1} & \cdots & \psi_{m,n} & \cdots & \psi_{m,N} \\ \vdots & & \vdots & & \vdots \\ \psi_{M,1} & \cdots & \psi_{M,n} & \cdots & \psi_{M,N} \end{bmatrix} \tag{17}$$

The $n^{th}$ column of Ψ is formed from the M DOAs to the $n^{th}$ grid point, as illustrated in FIG. 4A. In one implementation, the GBM estimator 112 determines the index of the grid point whose DOAs most closely match the estimated DOAs by solving:

$$n^* = \underset{n}{\operatorname{argmin}} \sum_{m=1}^{M} \left[A\left(\hat{\theta}_m \psi_{m,n}\right)\right]^2 \tag{18}$$

where A(X, Y) is the angular distance function defined in (12)-(14). In one implementation, the source position estimate $\hat{p}_{GB}$ is then given by the coordinates of the $n^{*th}$ grid point. This method is hereinafter referred to as static grid-based method.

Even if there are no DOA errors in the method above, the method may exhibit localization error due to discretization of the area. The localization error is hereinafter referred to as the bias introduced from the use of the grid. As mentioned before, consider grid points that are uniformly spaced, where G is the inter-point spacing in the x and y directions. Without loss of generality, consider a grid point at (0,0), then due to symmetry, the squared error is analyzed in the square defined by (0,0) and (G/2,G/2). Assuming that a source may be located anywhere in the square under consideration, and that a uniform probability density function is given by $$p(x, y) = p(x) \cdot p(y) = \frac{2}{G} \cdot \frac{2}{G} = \frac{4}{G^2}$$

due to the independence between p(x) and p(y). The mean squared error is then given by $$E_{GB}^2 = \int_0^{\frac{G}{2}} \int_0^{\frac{G}{2}} (x^2 + y^2) p(x, y) dx dy = \frac{G^2}{6}$$

with the root mean square being $$E_{GB} = \frac{G}{\sqrt{6}}$$

If the inter-sensor spacing in the x (and y) direction is defined as V (see FIG. 1), the number of grid points can be written as $$N\left(\frac{V}{G} + 1\right)^2$$

and therefore, the resultant root mean square error can then be defined as:

$$E_{GB} = \frac{V}{\sqrt{6}\left(\sqrt{N} - 1\right)} \tag{19}$$

As shown in (19), for a network cell of given dimensions, the number of grid points N, determined by the resolution of the grid G, determine the estimator's bias, as per one implementation. Increasing N can decrease the position estimation error, as it can make the error due to sampling the area significantly small, but it can also increase the complexity of the method.

To maintain a computationally efficient method when a very dense grid, i.e., large number of N, is considered, a variant to the static grid-based method—an iterative grid-based method and system, which starts with a coarse grid (low value of N) is disclosed herein. The iterative grid-based method can be implemented by GBM estimator 112. In one implementation, the estimator 112 determines best grid point, e.g., based on the index of grid point in equation 18. Once the best grid point is found, a new grid centered on this point is generated with a smaller spacing between grid points, but also a smaller scope. Then, the best grid point in the new grid is found. This may be repeated until the desired accuracy is obtained, while keeping the complexity under control as it does not require an exhaustive search over all grid points of the final resolution grid. An implementation of the iterative grid-based method can be summarized through FIG. 4B.

At block 402, values of parameters, such as initial grid resolution, final grid resolution, and a factor for increase in resolution r, are received. For example, GBM estimator 112 receives values corresponding to the initial resolution of the grid as $G_{initial}$, the target resolution as $G_{target}$, and r as the factor of increase in resolution (i.e., decrease in the grid-point spacing) after each iteration.

At block 404, G is set to $G_{initial}$. At block 406, GBM estimator 112 constructs a grid over the area of interest with resolution set to G. At block 408, a grid point n* is determined, for example by using (18). At block 410, GBM estimator 112 determines whether $G \leq G_{target}$. If "Yes," the method flow transitions to block 416 where the coordinates of the grid point are output as source location. However, if the answer to the determination block is "No," the block transitions to block 412, where V is set to G, and G is set to G/r. At block 414, the GBM estimator 112 constructs a square grid of dimensions V and resolution G on the index point and goes back to block 408. In one implementation, the latest square grid is smaller than the initial grid. The process runs until the condition, e.g., resolution limit, in block 410 is met.

The iterative version, as explained above, finds a solution in a fixed number of iterations which depend at least on the initial and target grid resolution and the increasing resolution rate r. In one implementation, the number K of iterations desired can be calculated as:

$$K = \left\lceil \log_r \frac{G_{initial}}{G_{target}} \right\rceil \tag{20}$$

where [x] denotes the smallest integer number, greater or equal to x.

Additionally, as the simulation results indicate, the iterative version achieves the same performance to its brute force counterpart, thus being able to find the optimal solution to static grid-based method without requiring an exhaustive search over all grid points of the target resolution grid.

Embodiments of the exemplary grid-based methods and systems can be extended to 3D localization, as long as DOA estimation methods able to estimate both azimuth and elevation angles are employed. The localization method can easily be extended by employing a grid in three dimensions, and considering the angular distance of both the azimuth and the elevation angles in (18).

Performance Limitations: Cramer-Rao Lower Bound

The Cramér-Rao Lower Bound CRLB) represents the minimum localization error covariance for any unbiased estimator and is defined as the inverse of the Fisher Information Matrix (FIM), J(p)

$$\mathbb{E}\{(\hat{p}-p)(\hat{p}-p)^T\} \geq J^{-1}(p) \tag{21}$$

where $\hat{p}$ is the estimate of p and $\mathbb{E}\{.\}$ is the expectation operator. Under the Gaussian assumption for the measurement noise, the FIM is derived as:

$$J(p) = \sum_{m=1}^{M} \frac{1}{\sigma_m^2} \nabla_p \theta_m(p) [\nabla_p \theta_m(p)]^T \tag{22}$$

Note that for the multiple source case, the gradient $\nabla_p \theta_m(p)$ is simply replaced by the Jacobian of $\theta_m(p)$ and the noise variance at sensor m, $\sigma_m^2$, is replaced by the noise covariance matrix $\Sigma_m$.

Multiple Source Localization from a Plurality of DOA Estimates:

Referring to FIG. 1B, consider cases where more than one sources (S>1) are identified by the source counter 107. The localization of a plurality of sound sources from DOA estimates is a considerably more challenging problem than its single source counterpart. The presence of a plurality of sources introduces further problems above those of the single-source case. For example, the LLS estimators, NLS estimators, and other estimators that use bearing-only estimation may consider the problem of localizing a single source do not consider realistic scenarios, for example, a plurality of sources may co-exist in an area and the location of all sources may need to be known. Furthermore, while bearing-only localization has been investigated for single-source, bearing-only a plurality of source localization problem of sound sources poses many challenges. For example, the so-called data association problem occurs, where the central processing node receiving DOA estimates for a plurality of sources from the different sensors cannot distinguish to which source they belong. Erroneous DOA combinations across the sensors will result in "ghost sources" that do not correspond to real sources. Some solutions are available but they have been found to be Non-deterministic Polynomial-time hard (NP-hard) when the number of sensors is ≥3. Some solutions are designed only for noise-less scenarios. Some solutions are based on statistical clustering of the intersection of bearing lines. However, they again consider idealized scenarios of no missed detections and no spurious measurements. Localization of a plurality of sources by angle and frequency measurements have also been considered but such methods fail if the sources contain the same frequencies, and thus cannot be applied to the case of acoustic sources. A method for localization of the plurality of sources using non-linear least squares that tries to overcome the data association problem have also been discussed. However, ghost sources are not eliminated, leading to severe performance degradation.

To this end, some embodiments of SSL include DOA estimators, such as IPM estimator 110-2 and GBM estimator 112-2, as shown in FIG. 1B to localize a plurality of sources coupled, in a wired or wireless manner, to a plurality of microphone arrays are described herein.

Figure 5:
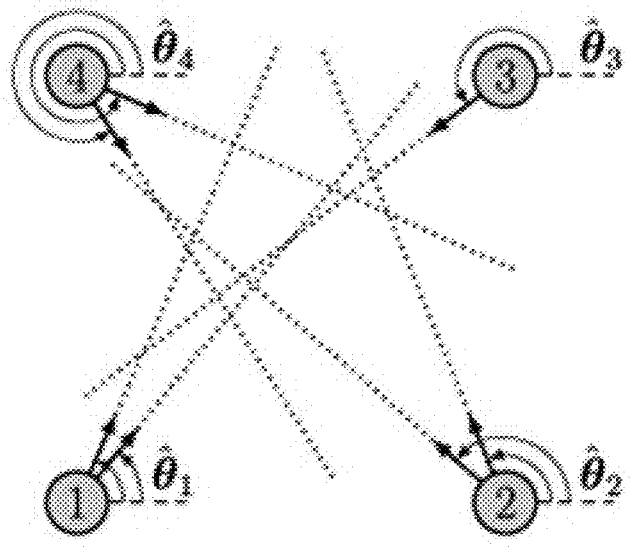
FIG. 5 is an exemplary network cell diagram of noisy DOA estimates from two sources, according to an embodiment of SSL.

Consider FIG. 5, which is a diagram of an example network cell having four sensor nodes (numbered 1-4) with noisy DOA estimates from two sources (not shown in this figure). In conventional systems, the central processing node receiving the DOA estimates ($\hat{\theta}_1$-$\hat{\theta}_4$) may not know to which source they belong, and the localization method generally does not take this into account. An additional complication is that some sensor nodes may only detect one source, as the sources' DOAs may be too close together for that node to discriminate between them. For example, see node number 3, which detects only one source. The distance that determines the ability of a node to detect a source can be an angular distance, referred to as minimum angular source separation (MASS). Therefore, if the angular distance between two sources is less than the MASS, the sensor node only detects one source. In one implementation, the DOA estimation method used by a sensor node, the spectral content of the source signals, and the array geometry determine the MASS at this node. Thus, the exemplary localization systems and methods, such as the IPM estimator 110-2 and the GBM estimator 112-2, deals with the ambiguity that each DOA estimate may originate from either source, and that some (or even all) of the sensor nodes may underestimate the number of sources.

In the following discussion, let $S_m$ denote the number of sources detected by the $m^{th}$ sensor. Then let the maximum value of $S_m$ be S, which is the highest number of sources detected by at least one sensor. Let $X_s$ be the set of sensors surrounding a cell detecting S sources in that cell, and let $C_S$ be the size of that set: $C_S=|X_S|$ Generally, NLS method or variations of position non-linear least squares (P-NLS) are used for localization of a plurality of sources. P-NLS works in two stages: in the first stage, all unique combinations of DOA estimates are formed, and a location estimate for each combination is calculated. Then in the second stage, the final locations are estimated by minimizing the following cost function using the estimates from the previous stage as initial guesses:

$$C_{P_NLS}(p) = \sum_{m=1}^{M} \min_i \left|\hat{\theta}_{m,i} - \theta_m(p)\right|^2 \tag{23}$$

where $\hat{\theta}_{m,i}$ is the $i^{th}$ element of $\hat{\theta}_m$. For every DOA combination, the minima of the cost function are expected to correspond to the locations of the true sources, however, some "ghost" sources appear due to spurious intersection of bearing lines from the sensors. In one implementation, the source localizer 106 mitigates such effects by applying a third stage to produce S (or less) final estimate locations.

In one implementation, an IPM estimator, such as IPM estimator 112-2, is implemented for localizing a plurality of sources. The IPM estimator 112-2 assumes that each DOA estimate, obtained from a sensor in $X_s$, can only belong to one source. In one implementation, IPM estimator 112-2 includes a region identification module 124 to divide the possible locations for sources into $S^{C_S}$ unique combinations of DOA estimates thereby yielding up to $S^{C_S}$ regions. It will be understood that some of these regions may be null, depending on the orientation of the DOA estimates.

In one implementation, by counting the number of intersection points in each region, and choosing the one that contains the most intersection points, the IPM estimator 112-2 can obtain a region that is most likely to contain one of the sources. Once a region is chosen, and thus one of the combinations of DOA estimates, the next most likely region is determined. This process may be executed until there is only one remaining possible combination of DOA estimates pointing to the final source.

Figure 6A:
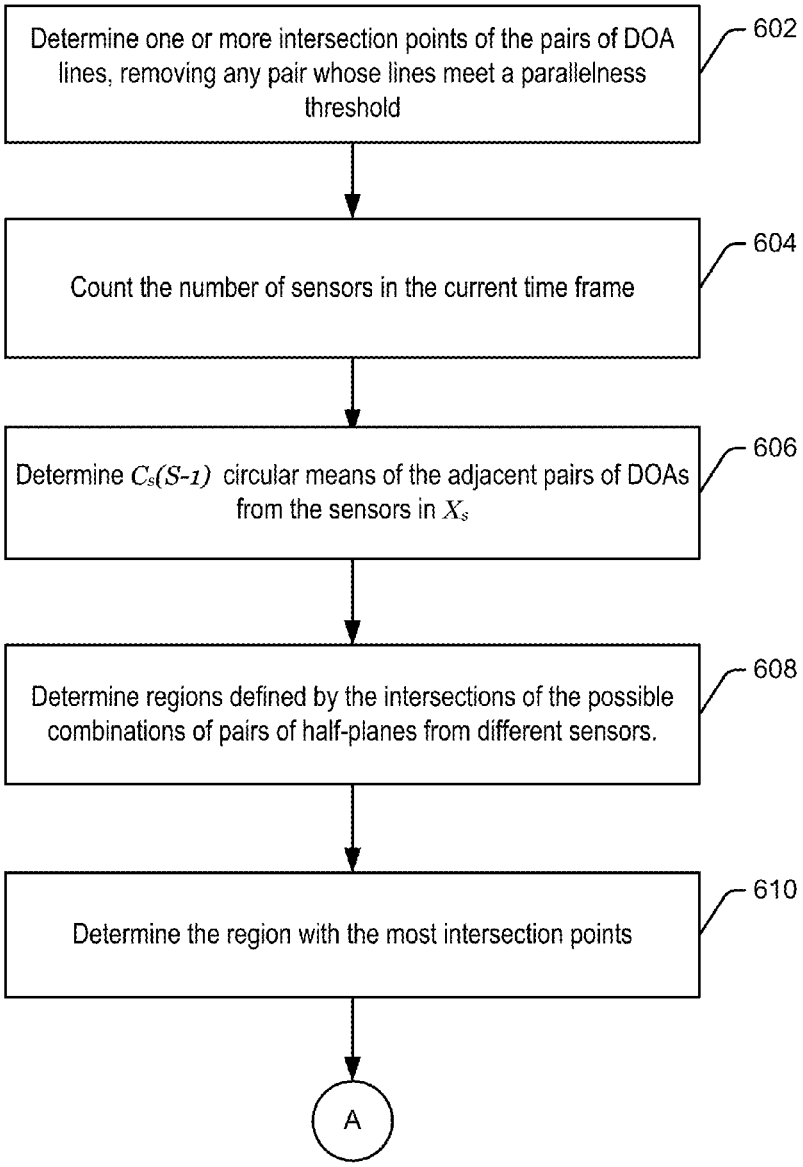
FIGS. 6A and 6B are exemplary flow charts of an intersection point based method of localizing a plurality of sources using a multi-sensor array, according to an embodiment of SSL.
Figure 6B:
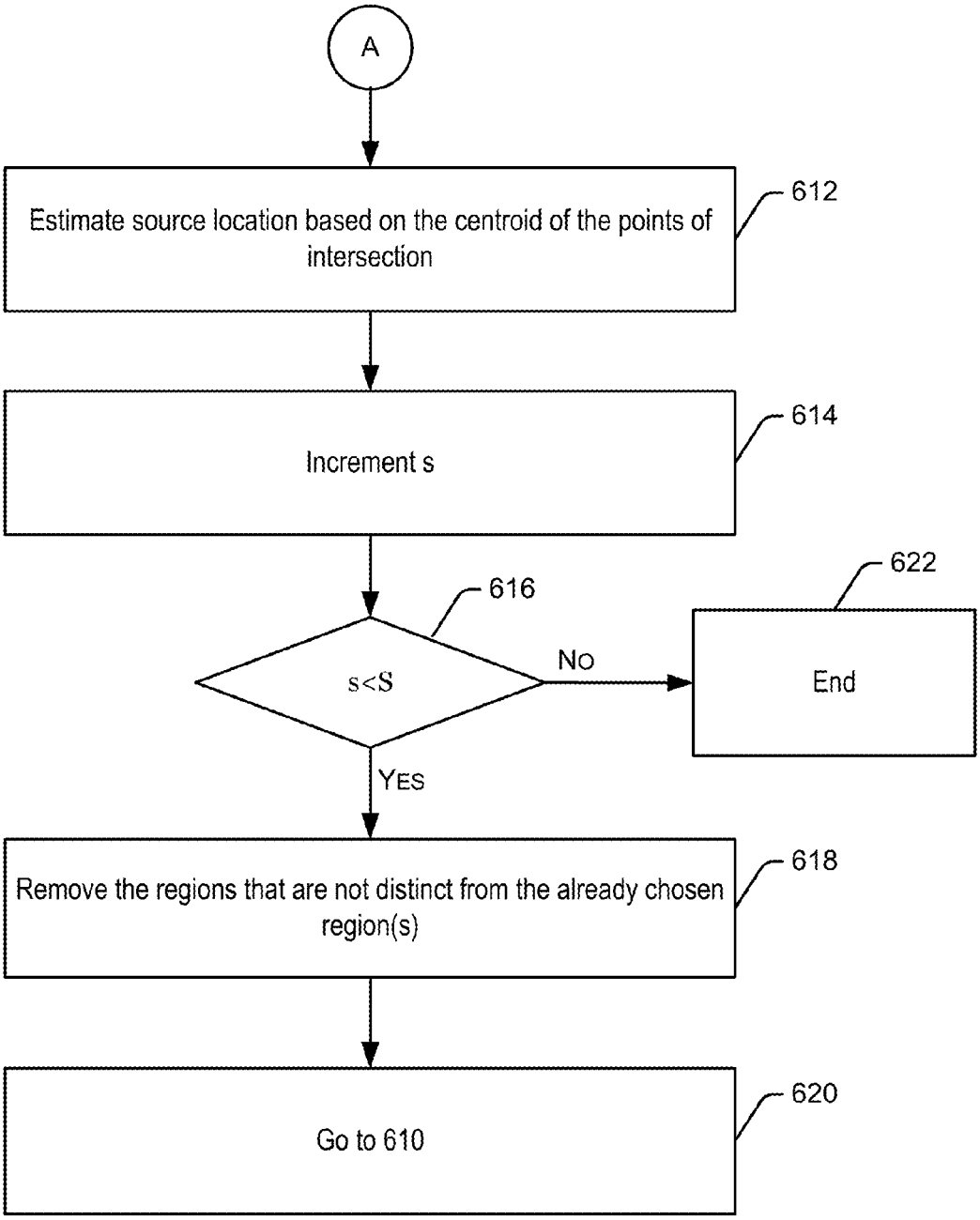

FIGS. 6A and 6B further are exemplary methods to localize a plurality of sources using an exemplary intersection point method, according to an embodiment of SSL. At block 602, the estimator 110-2 finds one or more intersection points of the pairs of DOA lines, removing any pair whose lines satisfy a parallelness threshold, as in step 306 of FIG. 3B.

At block 604, the estimator determines S, $X_s$ and then $C_s$, and sets the counter s to zero. In one implementation, the estimator 110 also obtains and estimate the number of sensors in the current time frame.

At block 606, $C_S(S-1)$ circular means of the adjacent pairs of DOAs from the sensors in $X_s$ are determined.

At block 608, the regions defined by all the intersections of all the possible combinations of pairs of half-planes from different sensors are determined, given that the vectors of the circular means form $C_S S$ half-planes. In another implementation, a selected set of combination of pairs of half-planes may be used to define regions.

At block 610, the region with the most intersection points is determined. If there is a tie, the region whose intersection points have the minimum variance is selected. The location of the $s^{th}$ source is then given by the centroid of the intersection points in this region.

At block 612, the estimator estimates a source location $\hat{p}_{IP}$ based on the centroid of the calculated points of intersection.

At block 614, s is incremented. If s<S, all regions that are not distinct from the already chosen region(s) are removed at block 618 and the process from block repeats until s=S.

Even though the methodology may have been described conceptually, it can be implemented very efficiently by using line tests, testing whether a point is above, below, or on a line, and binary masks.

In one implementation, an estimator, such as GBM estimator 114-2, can be implemented for localizing a plurality of sources. In one implementation, the GBM estimator 114 deals with the ambiguity that each DOA estimate may originate from either source, and that some (or even all) of the sensor nodes may underestimate the number of sources. The GBM estimator 114-2 accounts for the fact that the correct association of DOAs to the sources is unknown. In one implementation, the GBM estimator 114-2 executes a two-step procedure. In the first step, an initial candidate location is estimated for each possible combination of DOA measurements. In the second step, the final S source locations are chosen from the candidate locations.

Let J denote the set of all possible unique combinations of DOA estimates and j enumerate the combinations. Moreover, let be $\hat{\theta}^{(j)}$ be the M×1 vector of DOAs for the $j^{th}$ combination, and let $\hat{\theta}_m^{(j)}$ denote the DOA of sensor m for the $j^{th}$ combination. The cardinality of J depends on the number of sources each sensor is able to detect and can be:

$$|J| = \sum_{s=1}^{S} S^{C_S} \tag{24}$$

Figure 4B:
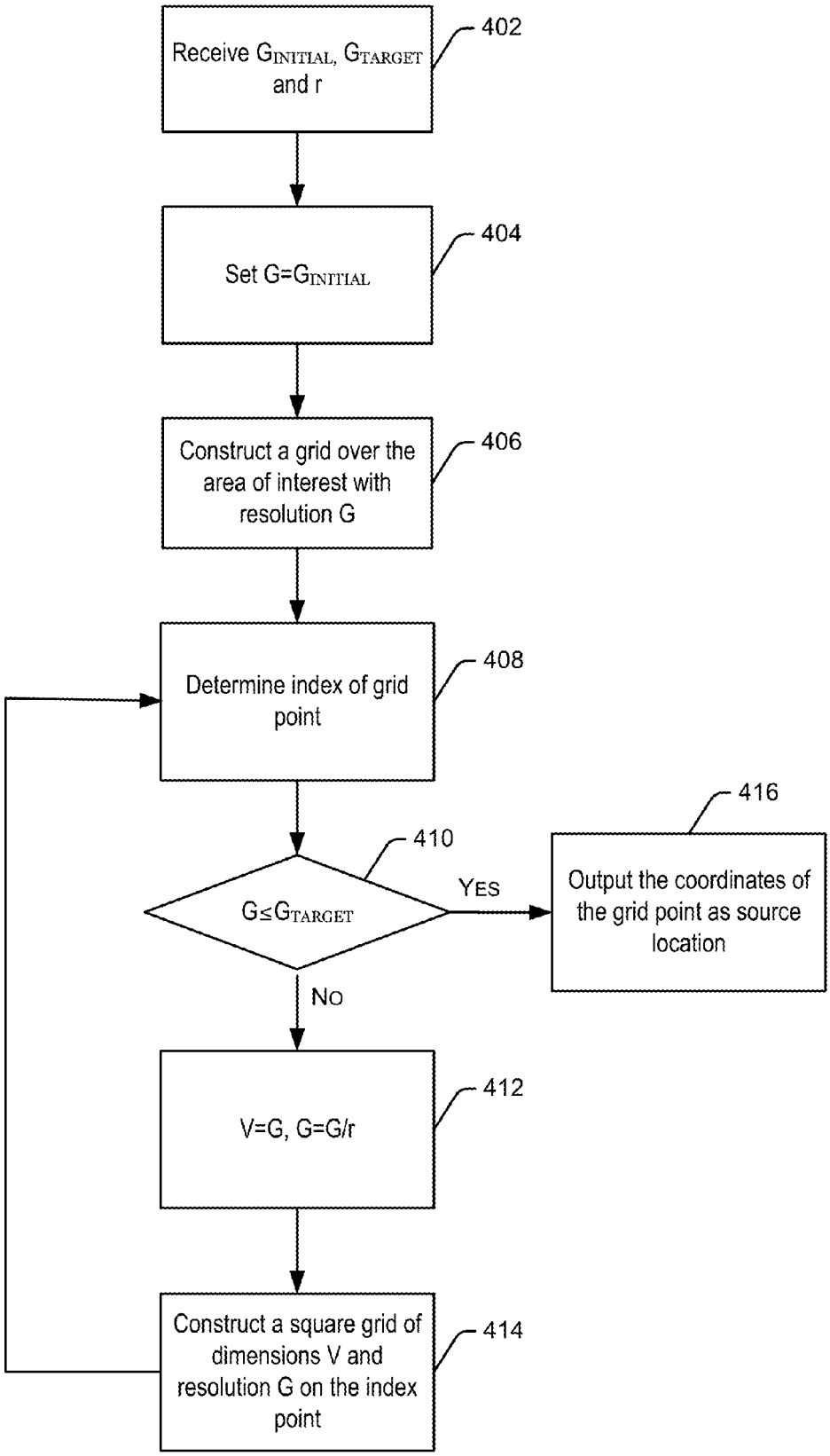
FIG. 4B is an exemplary flow chart of a grid-based method for localizing a single-source using a multi-sensor array, according to an embodiment of SSL.
Figure 7:
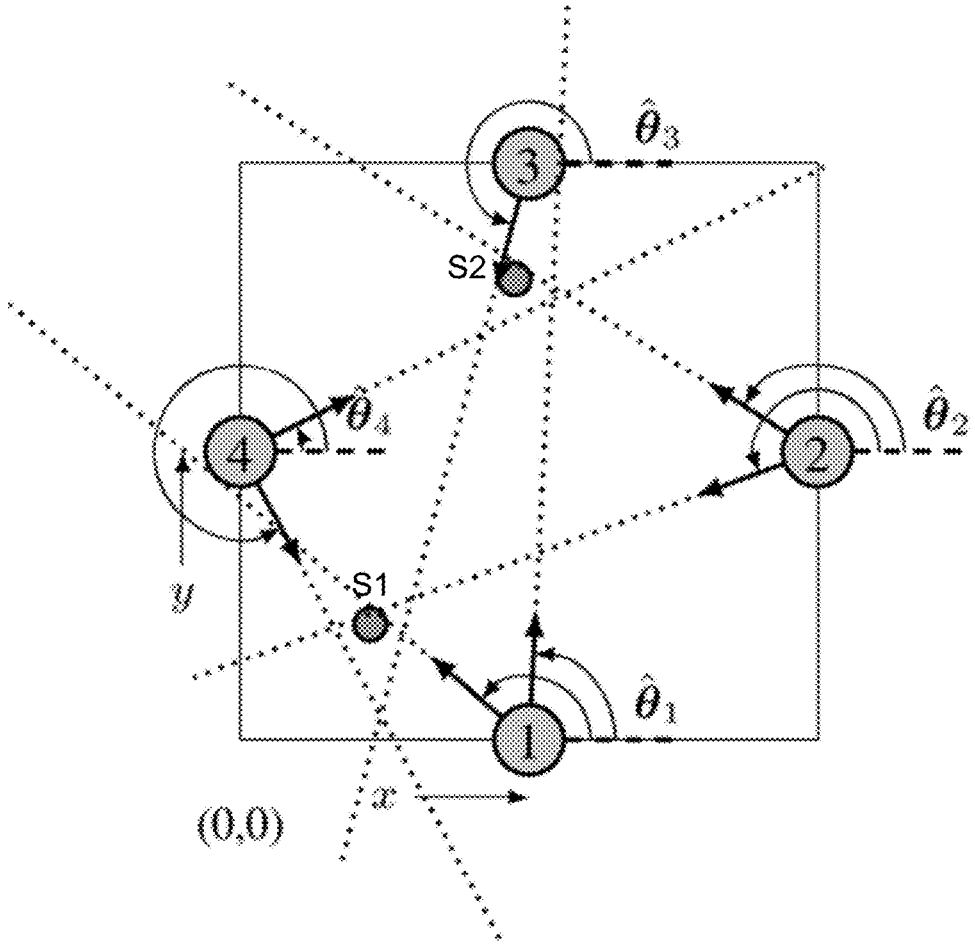
FIG. 7 is an example network cell diagram of noisy DOA estimates from a plurality of sources showing minimum angular source separation (MASS), according to an embodiment of SSL.

As the correct association of the DOAs of each sensor to the sources may not be known, the methodology in FIGS. 4A and 4B is applied to each element of J and the set L of candidate source locations is formed with |L|=|J|. Note that, in some cases, localization of the plurality of sources may increase the complexity by at least |J|−1 times that of the single source method, which makes way for a computationally efficient method to perform the localization of each DOA combination. The iterative grid-based method and systems of SSL, as shown in FIG. 7 minimize the non-linear cost function of static GB method, are significantly more computationally efficient and provide accuracy similar to the numerical search methods for finding the minimum of NLS estimator.

Data Association:

In one implementation, the final S source locations are identified from the set of candidate locations L by determining data association. The data association methods and systems tackle the data association problem by localizing every possible DOA combination and then deciding on the locations of the true sources based on the estimated locations and their corresponding DOA combinations. The method is not restricted to a specific DOA estimation method can be integrated to any DOA estimation method, such as the IP method or the GB method, as long as it can provide the estimated number of active sound sources and their corresponding DOAs, as well as an individual DOA estimate for each frequency. This may be done in a variety of ways, some of which are explained in the foregoing sections.

In one implementation, a brute force module 114 can be implemented to determine data association. The brute force module 114 can perform an exhaustive search over all possible S-tuples of DOA combinations and selects the most likely one. An S-tuple of DOA combinations is defined as the list of S DOA combinations (elements of J) each of them being an M×1 vector of DOA measurements from the M sensors. In forming an S-tuple, each sensor contributes to each of the S DOA combinations with a different estimate, as the same DOA cannot belong to more than one source. In the case where a sensor has not detected all sources, the same DOA can be repeated.

Therefore, the brute force method for data association can be summarized as follows. In one implementation, the brute force module forms all possible s-tuples of DOA combinations by combining the elements of set J (according to equation 24). The $i^{th}$ s-tuple is of the form:

$$T_i=\{\hat{\theta}^{(1)},\hat{\theta}^{(2)},\ldots,\hat{\theta}^{(S)}\} \tag{25}$$

Note that each DOA combination $\hat{\theta}^{(j)}$ is associated with a candidate source location $p^{(j)}=[p_{x_j}p_{y_j}]$ in the set L.

For each s-tuple i, the sum of residuals of each DOA combination in the tuple is calculated as:

$$r_i=\sum_{j=1}^{S}\sum_{m=1}^{M}\left[A(\hat{\theta}_m^{(j)},\theta_m(p^{(j)}))\right]^2 \tag{26}$$

And then the s-tuple that yields the minimum residual is selected and the corresponding candidate locations from that tuple are marked as the final source locations. In some cases, this approach may be associated with high complexity as the number of tuples that need to be tested can grow as high as $O((S!)^M)$, making this method impractical, for example, even when there are a moderate number of sources and sensors.

Therefore, in another implementation, data association can be resolved using a sequential module 116 that is configured to approximate the performance of the brute force module 114 and is much more computationally efficient. The sequential module 116 relies on a sequential method to find the S DOA combinations that approximate the minimum residual of (26) without testing all the possible S-tuples of DOA combinations.

In one implementation, the sequential module 116 for data association includes can create a set J'=J, and then for each DOA combination j in the set J', the residual is computed as:

$$r_i=\sum_{m=1}^{M}\left[A(\hat{\theta}_m^{(j)},\theta_m(p^{(j)}))\right]^2 \tag{27}$$

The sequential module 116 can then select a DOA combination j* with the minimum residual and provide the corresponding location $p^{(j^*)}$ as the location of one of the sources. In one implementation, J' is updated by subtracting all DOA combinations that contain DOAs that are part of the previously chosen combination j*. In some implementations, only DOAs of the sensors that have not detected all sources are allowed to take part in other combinations. The previous steps are repeated until J'=Ø i.e., when all s sources have been found. Note that this approach does not need to test all possible S-tuples of DOA combinations, significantly reducing the computational burden to that of testing only $O(S)^M$ DOA combinations.

In one implementation, the IP and GB systems and methods tackle the data association problem by localizing every possible DOA combination and then deciding on the location of the true sources based on the estimated locations and their corresponding DOA combinations. However, the performance of some methods, such as the static and iterative grid-based method, may degrade when the arrays exhibit missed detections and the method cannot identify the source whose DOA is missing from an array in order to exclude this array when localizing that source. Other methods utilize additional information apart from the estimated DOAs to solve the data association. For example, signal separation information may be used. Each array computes binary masks in the frequency domain that when applied to the microphone signals, source separation is performed. The association of DOAs to the sources may be found by comparing the binary masks. However, the method does not take into account missed detections and is designed to work only for the limiting case of two arrays.

Therefore, in one implementation, data association, which is more robust to missed detections, can be determined through a histogram module 118. The histogram module 118 can also identify the sources whose DOAs are missing from some arrays, offering improved localization accuracy. It is based on the estimation of how the frequencies of the captured signals are distributed to the estimated sound sources. This is achieved by comparing the DOA estimate obtained from each frequency of a given time frame to the final DOAs of the sources that are estimated at that frame. Data association can then be performed by comparing the frequency distributions of the sources at the different arrays. These frequency distributions provide a more reliable feature for data association, being more robust to noise and missed detections. As the evaluation results show, the histogram module and histogram based method to determine data association outperforms other known methods for data association, while the amount of additional information that has to be transmitted in the network remains at low levels.

Referring to FIG. 7, in one implementation, a WASN whose M nodes are each equipped with a microphone array, is considered. The signal received at the $i^{th}$ microphone of the $m^{th}$ array is:

$$x_{m,i}=\sum_{g=1}^{P}a_{m,i,g}s_g(t-t_{m,i}(\theta_{m,g}))+n_{m,i}\quad i=1,\ldots,N_m \tag{28}$$

where P is the true number of active sound sources $s_g$ in the far-field, $a_{m,i,g}$ is the attenuation factor of source $s_g$ to the $i^{th}$ microphone of the $m^{th}$ array, $\theta_{m,g}$ is the DOA of source $s_g$ with respect to the $m^{th}$ array, $t_{m,i}(\theta_{m,g})$ its corresponding time-delay to the $i^{th}$ microphone of the $m^{th}$ array and $n_{m,i}$ is additive noise.

In one implementation, each array estimates the number of active sources $\hat{P}_m$ and their DOAs $\theta_m=[\theta_{m,1},\ldots,\theta_{m,\hat{P}_m}]$, using a DOA estimation method for a plurality of sources with source counting, and transmits them to the central processing node along with additional information as explained subsequently. In one implementation, a scenario with missed detections caused e.g., when the sources are close in terms of their angular separation with respect to an array, is assumed. The estimated number of sources can vary across the arrays. The central processing node is responsible for finding the correct association of DOAs that correspond to the same source and then estimate the sources' locations based on the associated DOAs.

In one implementation, the data association method is based on estimating how the frequencies of the captured signals are distributed to the sources. This can be achieved by comparing the DOA estimate obtained from each frequency of a given time frame to the final DOAs of the sources that are estimated at that frame. As all microphone arrays record the same signal, albeit with relative phase differences, the distribution of frequencies for a given source across the arrays is similar. Then, the correct association of DOAs to the sources can be found by comparing the estimated frequency distributions across all arrays. The method of data association using histograms of localization information is described using FIGS. 8A and 8B. In one implementation, the process described in FIG. 8A occurs within each node, while the process described in 8B occurs at the central processing node, within the network 100.

At block 802, the sound or microphone signals in the $m^{th}$ array are transformed into the Short-Time Fourier Transform (STFT) domain, resulting in the signals $X_{m,i}(\tau,\omega)$ where $\tau$ and $\omega$ denote the time frame and frequency index, respectively. A source counting and DOA estimation method is employed for a plurality of sources, which estimates the number of sources $\hat{P}_m$ and their DOAs $\theta_m$ for every frame $\tau$, at block 804.

Also denoted as $(\tau,\Omega)$ is the set of frequencies or frequency elements $\omega$ for frame $\tau$ up to a maximum frequency $\omega_{max}$. $\tau$ may be omitted from the discussion hereinafter as the procedure is repeated in each time frame. At block 806, the data association determination starts by performing DOA estimation in each frequency element $\omega \in \Omega$, even though the number of sources and their DOAs may be known from the previous step. The maximum frequency $\omega_{max}$ can be set to the spatial-aliasing cutoff frequency, determined by the array geometry, above which ambiguous DOA estimates occur.

At block 808, the frequencies in $\Omega$ can be assigned to the sources according to the following rule. The frequency point $\omega \in \Omega$ is assigned to the source p if:

$$A(\phi(\omega),\theta_p)<A(\phi(\omega),\theta_q)\forall q\neq p \tag{29}$$

$$A(\phi(\omega),\theta_p)<\epsilon \tag{30}$$

where A(X, Y) denotes an angular distance function that returns the difference between X and Y in the range of $[0, \pi]$. (29) and (30) suggest that a frequency point is assigned to the source whose DOA is nearest the estimated DOA in this frequency point, as long as their distance is not above a predefined distance threshold $\epsilon$, where the distance can be either angular or Euclidean. If one of the conditions is not met, then the DOA estimate in this frequency point is considered erroneous and is not assigned to any of the sources. The number of active sources $\hat{P}_m$, their DOAs $\theta_m$ and a vector containing the source assignment in each frequency in $\Omega$ are transmitted to the central processing node for each frame $\tau$.

Figure 8A:
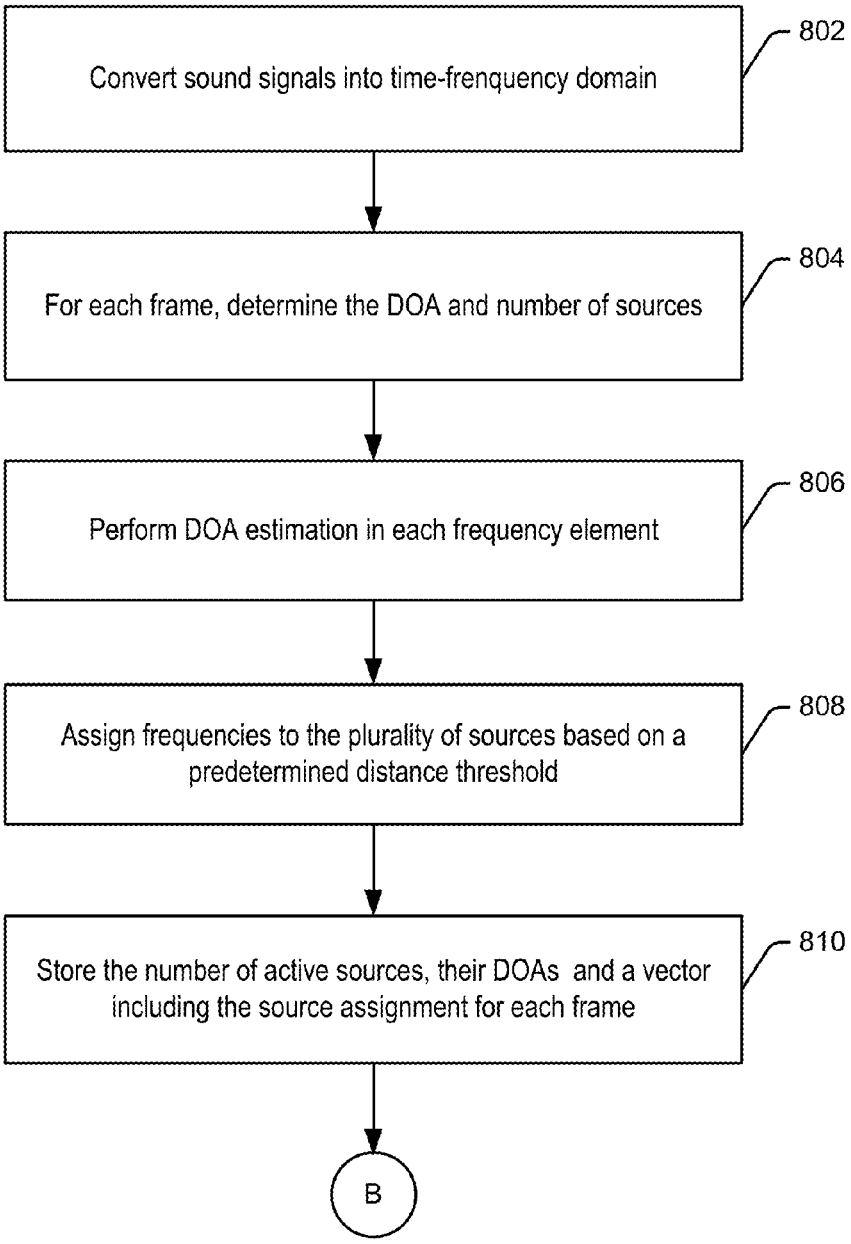
FIGS. 8A and 8B are exemplary flowcharts of a method of data association using histograms of localization information, according to an embodiment of SSL.

In one implementation, the central processing node can perform the data association method. At block 812, the central processing node obtains number of active sources $\hat{P}_m$, their DOAs $\theta_m$ and a vector containing the source assignment in each frequency in $\Omega$. For example, such information can be obtained from all the nodes coupled to the central processing node as the nodes. The nodes may have already processed and stored such information, as shown in FIG. 8A. At block 814, for each time frame of incoming data from array m, the histogram module 118 creates a histogram for each estimated source that counts how many times each frequency point has been assigned to that source using the data of the current frame and B previous frames. At block 816, pairs of arrays are identified. For example, each pair may include at least one array that detected all sources. To illustrate how the pairs are selected, consider the example in FIG. 7, where two sources are active but array 3 detected only one. The pairing mechanism, in this example, creates the microphone array pairs: (1, 2), (2, 3), and (4, 1). In another example, pairs may be selected based on a distance measure or DOA values.

At block 818, the correct association can be estimated by, for example, sequentially comparing the histograms of the sources between pairs of arrays. In the case of missed detections, the estimated number of sources, and thus the number of histograms, may differ across arrays. Such comparison may be based on a correlation coefficient, which can be computed in various ways.

In one implementation, let $h_{m,p}$ denote the histogram of the $m^{th}$ array that corresponds to the source at direction $\theta_{m,p}$. In the first step, pairs of arrays are formed. Each array forms a pair with the array that is closest to it. Comparing the frequency distributions between arrays that are close together may be helpful as these arrays are expected to provide more similar features (i.e., histograms) to associate. Using the histograms from the two arrays in a pair, the P×P matrix is calculated as:

$$R=\begin{bmatrix} r_{1,1} & \cdots & r_{1,P} \\ \vdots & \ddots & \vdots \\ r_{P,1} & \cdots & r_{P,P} \end{bmatrix} \tag{31}$$

where $r_{i,j}$ denotes the correlation coefficient of the $i^{th}$ histogram of first array in the pair with the $i^{th}$ histogram of the second array in the pair, which is bounded in the range of [−1,1]. At block 820, for each pair, $S_1=\{1, 2, \ldots, \hat{P}_1\}$ and $S_2=\{1, 2, \ldots, \hat{P}_2\}$ are defined that include the indices of the estimated DOAs of the first and second array, respectively. Then, DOA $\theta_k$ of the first array is associated with DOA $\theta_l$ of the second array iff:

$$(k, l) = \underset{(p,q)}{\operatorname{argmax}}\, r_{p,q} \tag{32}$$

At block 820, the associated DOAs are removed from further processing. In one implementation, the associated DOA indices k and l are then removed from their corresponding sets $S_1$ and $S_2$ in order to ensure that each DOA is associated only once. The DOA association of the next source is then performed through the use of (32), until either $S_1$ or $S_2$ becomes empty, as shown in block 824.

When an array exhibits missed detections, thus underestimating the number of sources, it can have less than P histograms to compare. The cardinality of $S_1$ and $S_2$ can then differ and the corresponding elements of R are assigned the lowest possible value (i.e., −1). In this way, the histogram module 118 and the data association method therein are capable of handling missed detections and identifying that the given array has not estimated a DOA for a given source. In one implementation, the procedure is repeated in all pairs of arrays. Finally, by comparing the association of the common DOAs in all pairs, the final association over all arrays can be derived.

In another implementation, data association and source counting can be implemented using hierarchical clustering methods with unknown number of clusters. In one implementation, the central processing node may receive the estimated histograms (one histogram per estimated source)

or histogram related data, from each node. Based on the histograms, the correct association of sources can be estimated. Moreover, as the sensors may underestimate or overestimate the number of sources, source counting based on the individual estimation of the number of sources in the sensors may also be performed for more accurate results.

In one implementation, the data association method includes:

1. At initialization, the histogram module, such as histogram module 118, allows each histogram to form its own cluster.
2. A distance measure may be defined to describe the similarity of two individual histograms. In one implementation, histograms that originate from the same sensor cannot be clustered together as they correspond to different sources and thus their distance can be set to infinity. Moreover, another distance measure may be defined to describe the similarity of two clusters that include more than one histogram.
3. The distance between all pairs of histograms may then be calculated. The histograms with the smallest distance can be merged together into a new cluster.
4. Step 3 may be repeated in the new set of clusters, until a termination condition is met.

In one implementation, the distance between two histograms may be defined as (1−r)/2, where r is the correlation coefficient between the two histograms, ranging from [−1, 1], as defined above. The distance between two clusters can be defined as the distance of the histograms of the two clusters with the maximum distance; it will be understood other distance measures, such as Hellinger distance, Earth movers Distance (EMD), and Kullback-Liebler Divergence, can be used.

In one implementation, the termination condition in Step 4, can determine the resulting number of clusters and thus the estimated number of sources. After each iteration, the pair of clusters with the minimum distance can be chosen. This pair contains the clusters that are the most similar in the set. If their distance is higher than a predefined threshold, it is assumed that no other merging of clusters is possible and the clustering is terminated, resulting in the final clusters and their number.

This method is particularly useful in situations where no sensor has detected the true number of sources, as the presented source counting approach may still identify the correct number of active sources. Thus, in contrast to certain methods, it can provide superior performance in situations where some sensors may overestimate the number of sources or all the sensors have underestimated the number of sources.

In the above procedure, the histograms may be formed according to the method described previously; however, modifications in the histogram formation can also be applied. For example, a modification that may increase the performance of the method is the following. As described with reference to FIGS. 8A and 8B, each frequency is assigned to a specific source according to the conditions in Equations (29) and (30). Thus, each source assignment may contribute to the histogram by increasing the specific frequency count by one. An alternative approach is to also account for the accuracy of the DOA estimation in each frequency, by incrementing the frequency count by the error between the DOA of the source and the DOA estimate in that frequency.

Alternatively, a plurality of source localization can be applied by applying the single-source grid-based method, or, in general, any single source location estimator, per frequency bin based on the DOA estimates from the sensors for that specific frequency bin. Then, a 2D histogram can be formed from the location estimates of the current and B previous frames, where the peaks of the histogram represent the sources' locations. An extension of the matching-pursuit method to 2D can be used to identify the sources' locations as well as their number. An extension of the matching pursuit to 2D or the watershed method, or other clustering method can be used to identify the sources' locations as well as their number.

Tracking Potential:

Due to their real-time nature, the IP method, the GB method, or in general, any DOA estimation method, disclosed herein can be integrated with a tracking system, according to an embodiment. In one implementation, a tracking module (not shown) can be implemented based on particle filtering. In one implementation, the tracking system can use the location estimates of the grid-based estimator 112 described with reference to FIGS. 1-6 to assign weights to the particles through the following likelihood function:

$$p_{tr}(\hat{p}_s^{(t)}|x_{j,i}^{(t)})=\mathcal{N}(\hat{p}_s^{(t)},x_{j,i}^{(t)};\Sigma) \tag{33}$$

Where $\hat{p}_s^{(t)}$ is the $s^{th}$ source location estimate from the GB estimator 112 at time t, $x_{j,i}^{(t)}$ is the location of particle i associated with the tracked source j at time t and $\mathcal{N}$ denotes the two-dimensional Gaussian distribution with mean $x_{j,i}^{(t)}$ and covariance matrix Σ, evaluated at $\hat{p}_s^{(t)}$.

Assuming that the measurements are independent in the x- and y-coordinates, the covariance matrix can be written as $\Sigma=\mathrm{diag}(\sigma_x^2, \sigma_y^2)$ where the variances $\sigma_x^2$ and $\sigma_y^2$ are used to quantify the location error that the localization system is expected to produce in the x- and y-coordinates.

Figures 10, 24:
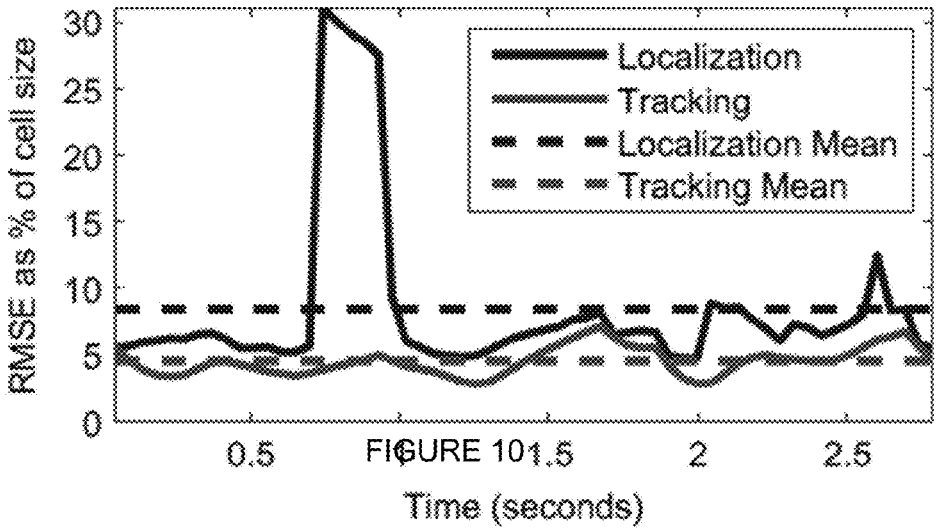
FIG. 24 is an exemplary plot of position estimation error in time as a percentage of the cell size V for three moving sources in a square 4-node cell with a MASS of 15° and signals having 20 dB SNR at the center of the cell, according to an embodiment of SSL.

Tracking is now discussed with the help of an example. In the 4 m×4 m square cell considered in the simulations, three sources were set to move in straight lines at different velocities. In this example, the MASS was set as 15°. To implement (31), $\sigma_x$ and $\sigma_y$ both are set as 0.15. The RMSE over time for 250 runs is shown later in FIG. 24. It is evident that the tracking system consistently improves the localization performance. Also note that the region between 0.5 s and 1 s where the sources are located such that due to the MASS the localization is able to detect only two out of three sources. In that region, the tracking is able to keep the track of the lost source and significantly improve the performance.

Experimental Results

In order to investigate the performance of SSL, simulations and real measurements were run on a square 4-node cell of a WASN, similar to that of FIG. 5. Although this may be a study of a cell in a larger sensor network, it is a reasonable assumption that the performance in each cell can dominate the performance of the whole network, as the other sensors not belonging to this cell can receive the source signals with low SNR or not be able to detect the sources' DOAs at all. Sensors that detect the sources' DOAs but do not belong to the cell can be excluded by a higher-layer sensor selection methodology.

In one implementation, source localization using DOAs contaminated by noise of different levels, is examined. Assume a 4-node cell of a WASN where the sources are located inside the cell. Non-directional isotropic environmental noise and sensor noise may contaminate the sources' signals received at the microphones of each sensor. This noise can be modeled as white Gaussian noise of equal power at all microphones, uncorrelated with the source signal and the noise at the other microphones, resulting in a certain level of SNR for each source signal at the sensors. As circular arrays of the same number of omnidirectional microphones are being considered, the accuracy of the DOA estimates of a source at each sensor can be assumed to be determined by the SNR of that source's signal at that sensor.

By defining the SNR at each sensor when the source is at the center of the cell (reference SNR), SSL can estimate SNR at the sensors when the source is located at any location within the cell based on the attenuation of the source signal at that location compared to the center of the cell. Assume that the signal of a source radiates as a spherical wave, and the attenuation experienced by the source signal traveling from $r_1$ meters from the source to $r_2$ meters from the source is given by:

$$a = 20\log_{10}\frac{r_2}{r_1}dB \tag{34}$$

The attenuation can either be positive or negative, resulting in SNR at the sensors which is lower or higher than the reference SNR. Thus, given a reference SNR at the center of the cell, the SNR of a source signal at the sensors when the source is located at a given location can be calculated through geometry and the use of (34). The source's SNR at each sensor can then define the standard deviation of the DOA error of (6). Thus, to proceed with the simulations, SSL models the DOA error as a function of SNR. In one implementation, the exemplary framework results in a different SNR and, therefore, a different DOA estimation error standard deviation at each sensor. Moreover, in order to simulate a plurality of simultaneous sources within the MASS, the effect of the MASS on the DOA estimation is studied.

Figure 9:
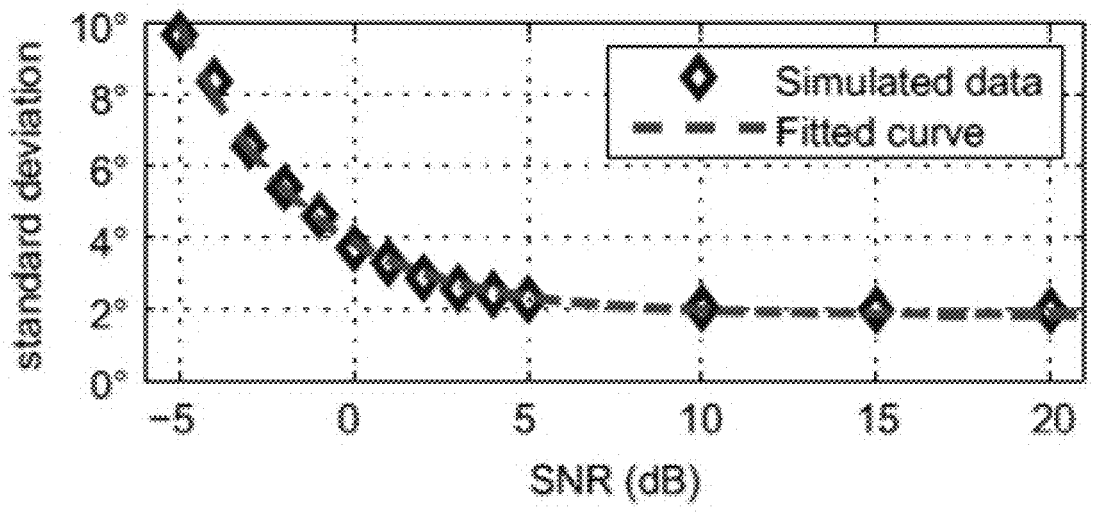
FIG. 9 is an exemplary plot of the standard deviation obtained when the DOA estimation error at each signal-to-noise ratio (SNR) is fitted with a Gaussian distribution, according to an embodiment of SSL.

DOA Estimation and Error Modeling:

The DOA estimation error at each sensor was assumed to be normally distributed with a zero mean and a variance that was assumed to be dependent only upon the SNR at each sensor, which was in turn determined by the length of the path from the source to the sensor. Following one of the DOA estimation method, simulations were performed to characterize the DOA estimation error, using a sensor consisting of a 4-element circular microphone array with a radius of 2 cm. An anechoic environment was assumed and a speech source (male speaker) contaminated by white Gaussian noise at various SNR cases ranging from −5 dB to 20 dB, was used in the simulations. The noise at each microphone is uncorrelated with the speech source and with the noise at all the other microphones. For each signal-to-noise ratio, the simulation was repeated with the source rotated in 1° increments around the array to avoid any orientation biasing effects. FIG. 9 shows the standard deviations obtained when the DOA estimation error at each SNR was fitted with a Gaussian distribution. The fitted curve in FIG. 9 is given by:

$$\mathrm{std}(\mathrm{SNR})=1.979e^{-0.2815(SNR)}+1.884 \tag{35}$$

Figure 10:
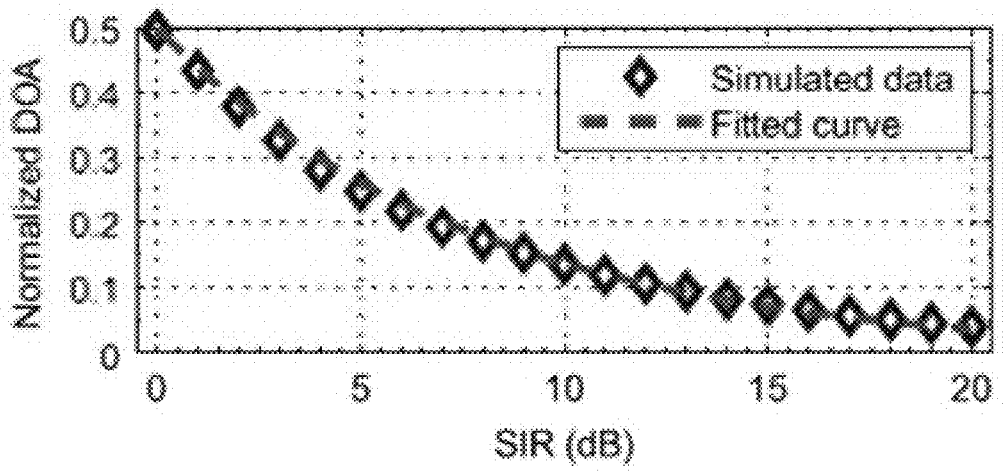
FIG. 10 is an exemplary plot of the effect of MASS and SIR on DOA estimation error for a circular sensor array, according to an embodiment of SSL.

As mentioned earlier, in order to simulate a plurality of simultaneous sources, the effect on DOA estimation when two sources were within the MASS of a sensor needed to be studied. A simulation study was performed where two speech sources (one male, one female) were set at various separations of up to 20° below typical MASS, and the energy of the second source was incrementally decreased so the signal-to-interferer ratio (SIR) seen by the first source varied from 0 dB to 20 dB. These simulations were then repeated with the sources being rotated around the array in 1° increments while preserving their angular separation to avoid any orientation biasing effects. In all simulations, only one source was detected and FIG. 10 shows the results of these simulations, where the DOA offset has been normalized by the separation between the sources. The fitted curve of the normalized DOA estimate, $\mathrm{DOA}_n$ (FIG. 10) is given by:

$$\mathrm{DOA}_n(\mathrm{SIR})=0.5e^{-0.12987(SIR)} \tag{36}$$

It is clear that the detected source's DOA is estimated exactly in the middle of the true DOAs when the sources have equal energy and moves gradually towards the dominant source as the weaker source decreases in energy. The fitted curve of FIG. 10 was used in all simulations involving more than one source.

Simulation Results:

In all simulations, the sources were located anywhere within the cell with independent uniform probability and the error measurement used was the root mean square error (RMSE) between the estimated positions and the true source positions. For each run, i.e., a different positioning of the sources, the sources' true DOAs to the sensors were calculated using (5) and zero-mean Gaussian DOA noise was added. The standard deviation of the DOA noise was taken from FIG. 9, according to the sources' SNRs at the sensors which in turn was estimated based on the reference SNR at the middle of the cell. For a plurality of sources, when the sources were within the MASS, one DOA was estimated through the use of (36).

In the first simulation, the single-source case is considered and compared with the performance of the method implemented by GBM estimator 114 when an exhaustive search over all grid points is performed against the iterative version of the method. For the iterative version, an initial grid and a final grid with grid point spacings of 12.5% and 0.25% of the sensor spacing, respectively, are used. In each iteration, the grid point spacing is reduced to one half of the previous one (r=2). For the exhaustive search version, the same grid (i.e., 0.25% of the sensor spacing) is used and an exhaustive search is performed over all grid points to find the source location according to (18).

Figure 8B:
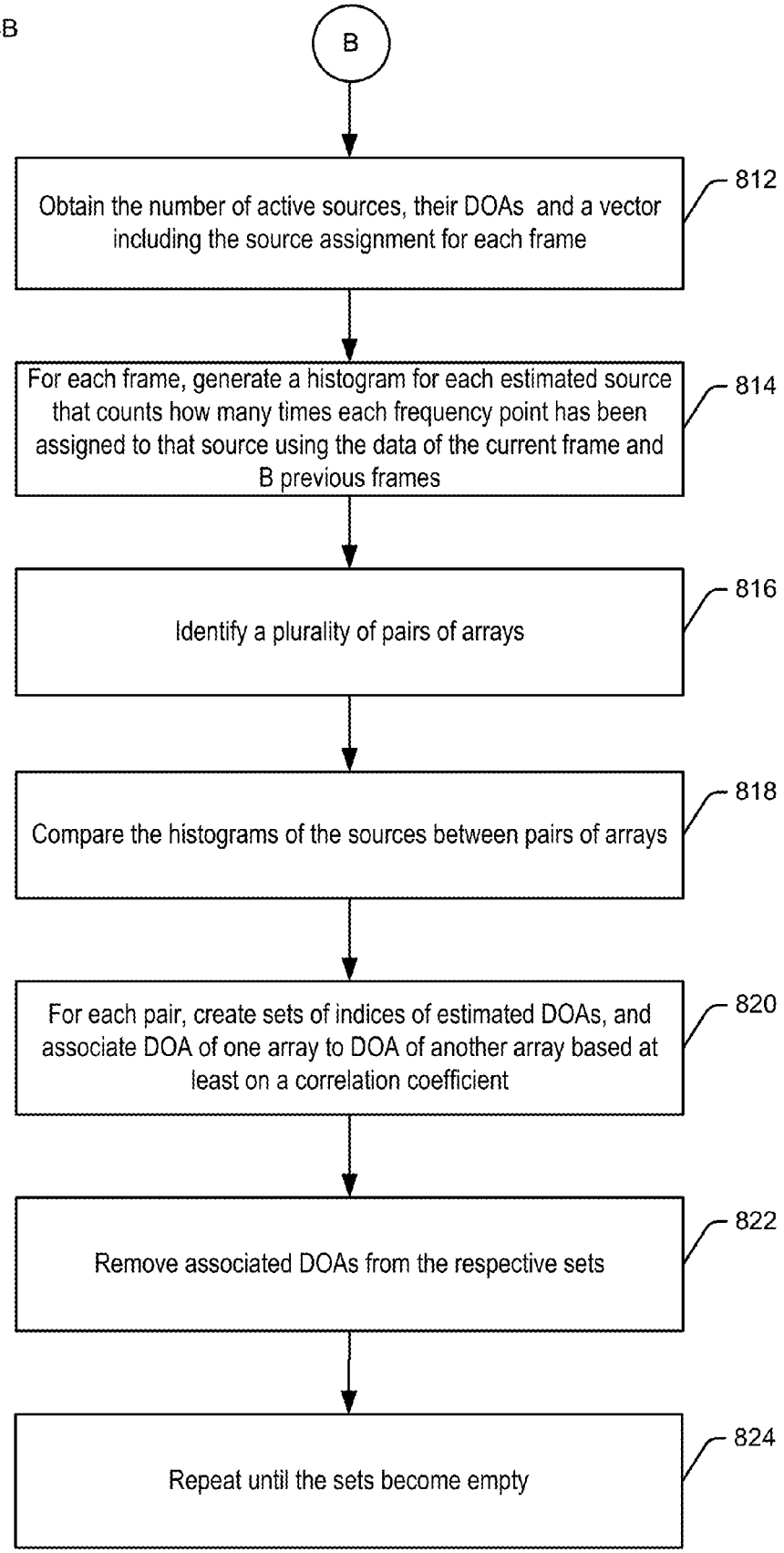
Figure 11:
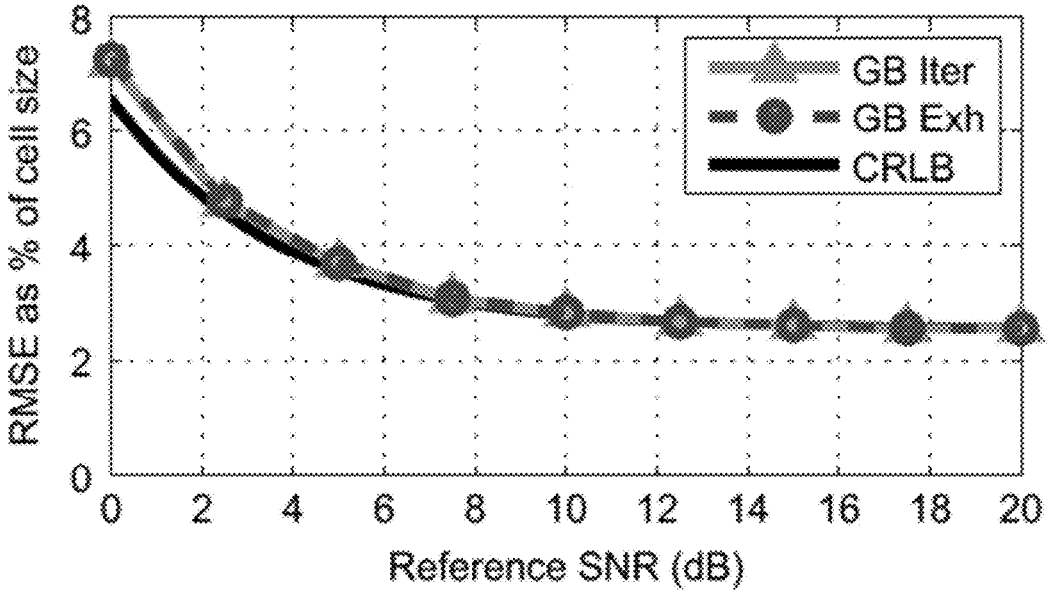
FIG. 11 is an exemplary plot of position estimation error of two versions of the grid-based method (exhaustive search and iterative) as a percentage of cell size V for a single source in a square 4-node cell, according to an embodiment of SSL.

FIG. 11 shows the results over 10,000 runs for each reference SNR case. It is evident that the iterative version achieves the same performance without requiring an exhaustive search over all grid points of the final resolution grid, thus being more computationally efficient. For all the results presented in the remainder of this disclosure, method described in FIGS. 7, 8A and 8B is used with initial and final grids of 12.5% and 0.25% of the sensor spacing, respectively, and r=2.

Figure 12:
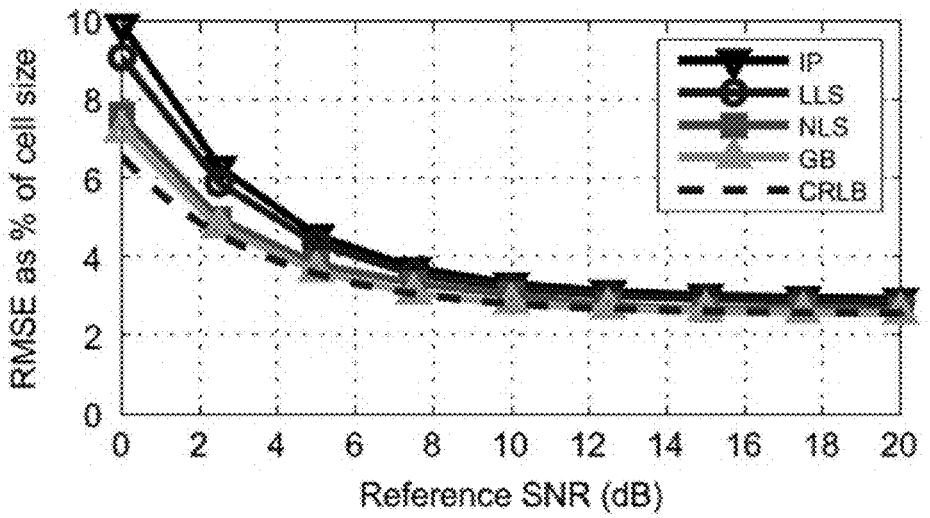
FIG. 12 is an exemplary plot of position estimation error as a percentage of cell size V for a single source in a square 4-node cell, for various values of SNR measured at the center of the cell, according to an embodiment of SSL.

FIG. 12 presents the results of the simulations of a single source, with the five curves representing the methods implemented by the LLS estimator, NLS estimator, IPM estimator, the GBM estimator, and the CRLB bound. The RMSE is calculated over 10,000 runs for each reference SNR case. It is clear that all the methods perform close to the bound, with the NLS and GB methods being the closest. However, as shown in the subsequent section, the GB method is significantly more efficient in terms of computation time. For the IP method, $\gamma$=20° is set for all the results presented in this disclosure. Through several simulations, these parameters for the IP and GB methods were found to achieve good performance.

The performance of localization methods for a plurality of sources implemented by the P-NLS estimator, and exemplary IPM and GBM estimators for two and three sources were also evaluated through simulations. For all the simulations with a plurality of sources presented hereafter, the RMSE is calculated over 5000 runs.

Figure 13:
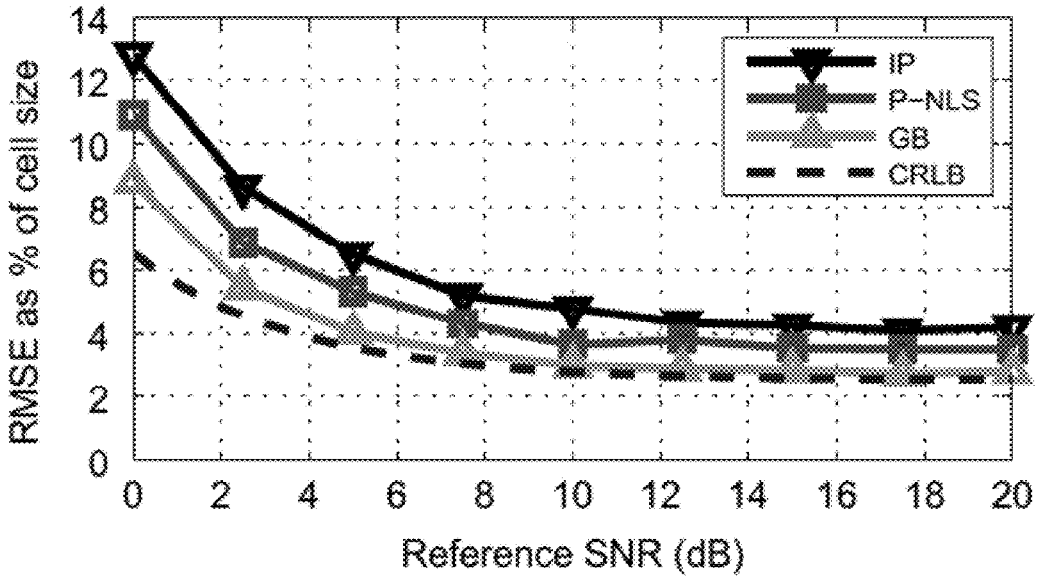
FIG. 13 is an exemplary plot of position estimation error as a percentage of cell size V for two sources in a square 4-node cell with a MASS of 0°, for various values of SNR measured at the center of the cell, according to an embodiment of SSL.
Figure 14:
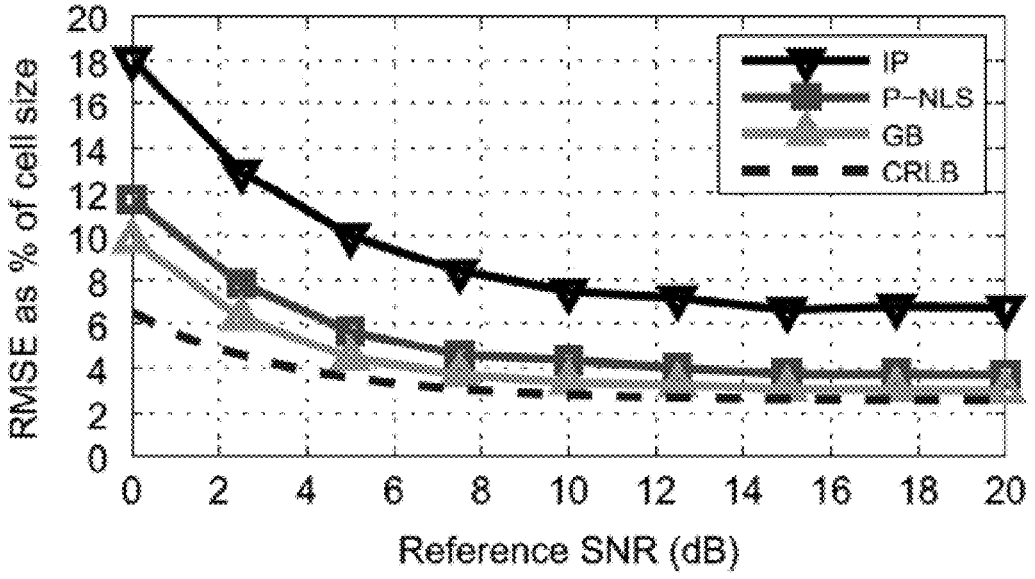
FIG. 14 is an exemplary plot of position estimation error as a percentage of cell size V for three sources in a square 4-node cell with a MASS of 0°, for various values of SNR measured at the center of the cell, according to an embodiment of SSL.
Figure 15:
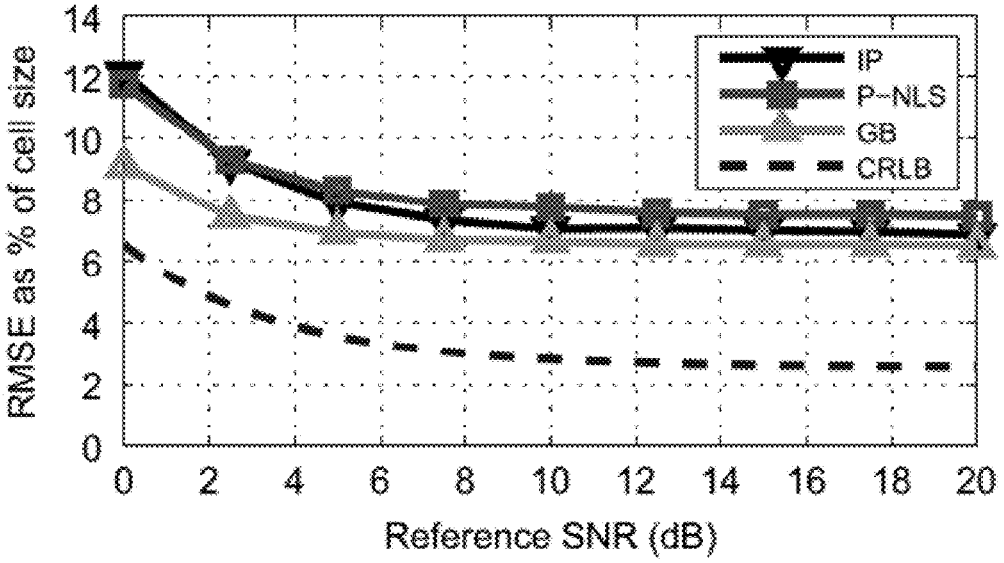
FIG. 15 is an exemplary plot of position estimation error as a percentage of cell size V for two sources in a square 4-node cell with a MASS of 20°, for various values of extra DOA error standard deviation, according to an embodiment of SSL.
Figure 16:
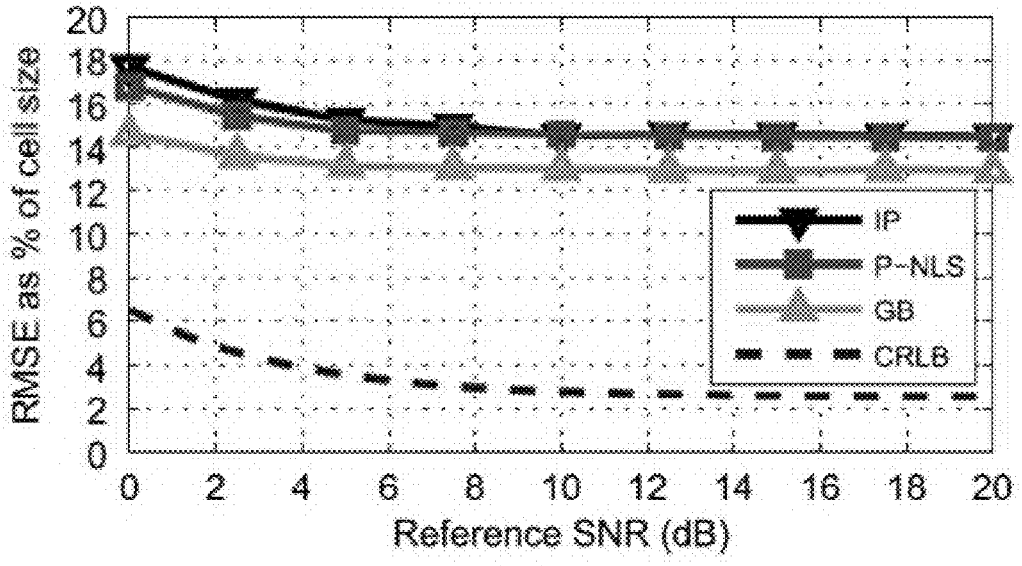
FIG. 16 is an exemplary plot of position estimation error as a percentage of cell size V for three sources in a square 4-node cell with a MASS of 20° at the center of the cell, for various values of extra DOA error standard deviation, according to an embodiment of SSL.

The performance of the methods for two and three sources for the case of 0° MASS is displayed in FIGS. 13 and 14, respectively. Both the P_NLS and GB methods used the brute force approach for the final source location selection. These results are for the idealized case of 0° MASS, nonetheless, it can be seen how close the performance of the GB method gets to the lower bound. However, the performance of the IP method degrades with three sources.

Any realistic sensors and DOA estimation method may have a non-zero MASS, and the performance of all localization methods is expected to degrade significantly as the MASS increases. This is due to the fact that the accuracy of the methods degrades as $C_S$ decreases, and an increasing MASS directly decreases $C_S$, especially as the number of sources increases. Alternatively, as the MASS increases, the accuracy of the DOA estimates from each sensor is much more likely to degrade significantly, due to the "merging" effect illustrated in FIG. 10. In the extreme case, $C_S$ will be zero, i.e., no sensors will detect the true number of sources, and the localization method can underestimate the number of source locations. A more realistic case of 20° MASS is presented in FIGS. 11 and 12, and the degrading effect of the increased MASS is clear, particularly for the three source case. Note again that the exemplary GB method consistently performs the best.

Figure 17:
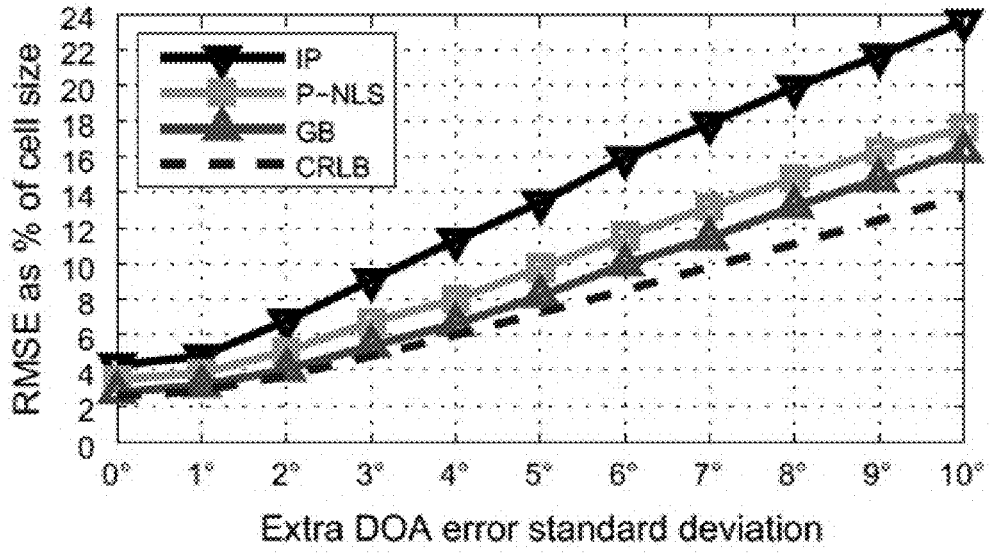
FIG. 17 is an exemplary plot of position estimation error as a percentage of cell size V for two sources in a square 4-node cell with a MASS of 0° for 20 dB SNR at the center of the cell, for various values of extra DOA error standard deviation, according to an embodiment of SSL.
Figure 18:
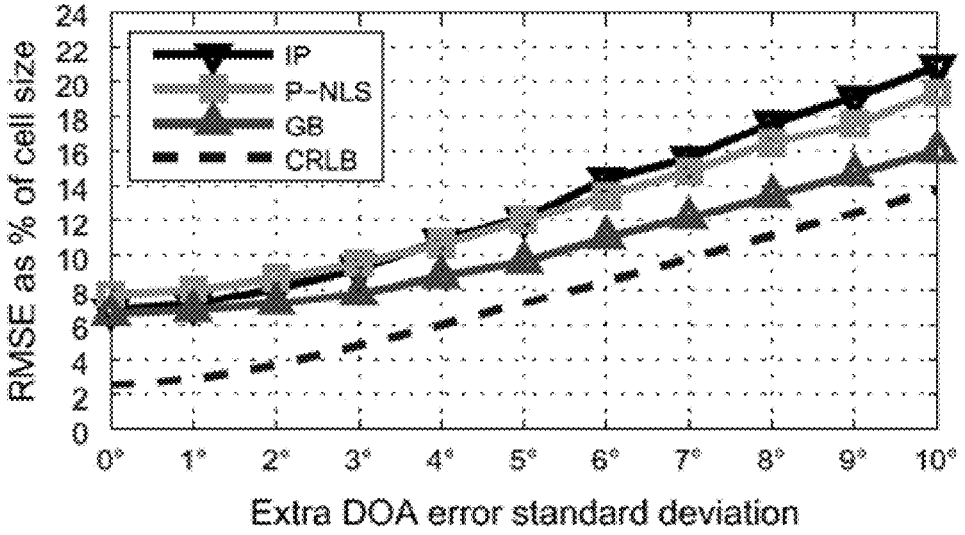
FIG. 18 is an exemplary plot of position estimation error as a percentage of cell size V for two sources in a square 4-node cell with a MASS of 0° for 20 dB SNR at the center of the cell, for various values of extra DOA error standard deviation, according to an embodiment of SSL.

All the previous results have considered the DOA estimation error at the sensors to be modeled as in FIG. 9. In FIGS. 17 and 18, the position error for two sources with increased DOA estimation error when the reference SNR is 20 dB, are considered. This is modeled by taking the result of FIG. 9 and adding an additional Gaussian noise term with a zero-mean and standard deviation of 1°-10° at each sensor node. Again, in the 0° MASS case, the methods show a reasonable agreement with the lower bound, and as the MASS moves to 20°, the performance of all the methods suffers. Once again, the exemplary GB method performs the best with the added DOA estimation error.

Figure 19:
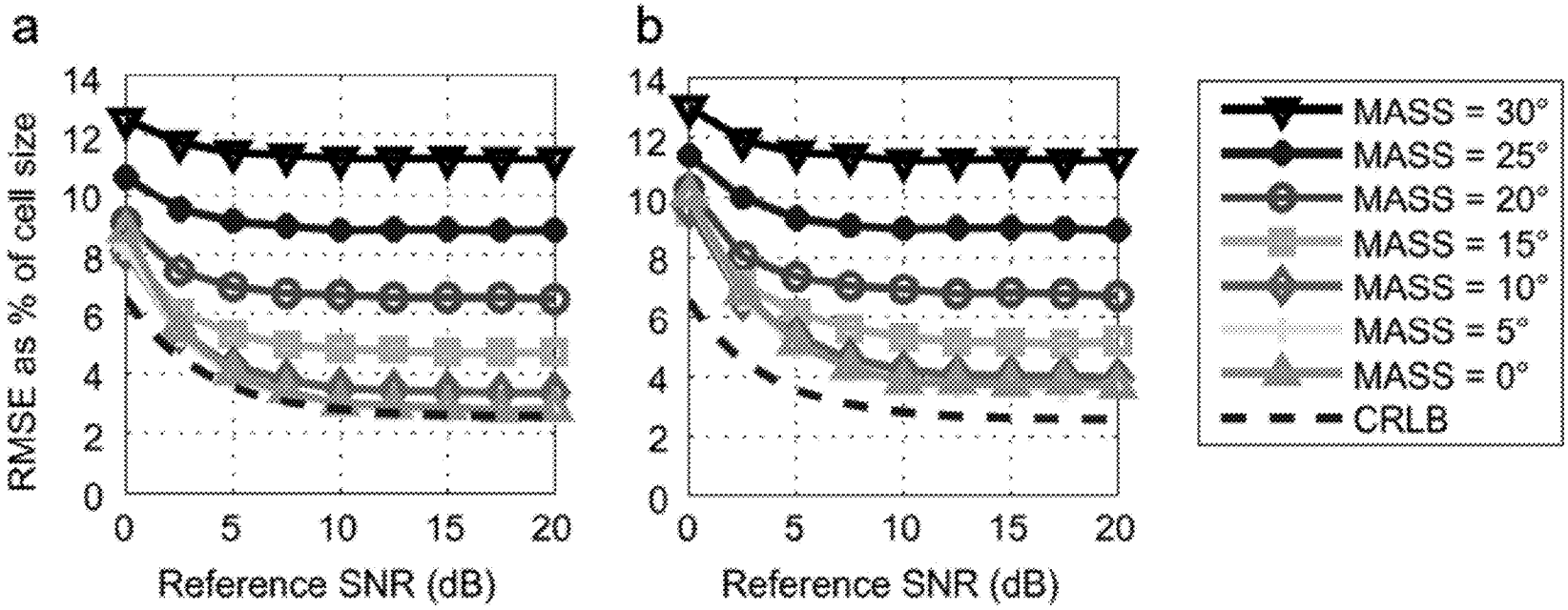
FIG. 19 is an exemplary plot of position estimation error as a percentage of cell size V for two sources in a square 4-node cell using the grid-based method and the final step approaches of (a) brute force method and (b) sequential method, with various values of MASS and SNR measured at the center of the cell, according to an embodiment of SSL.
Figure 20:
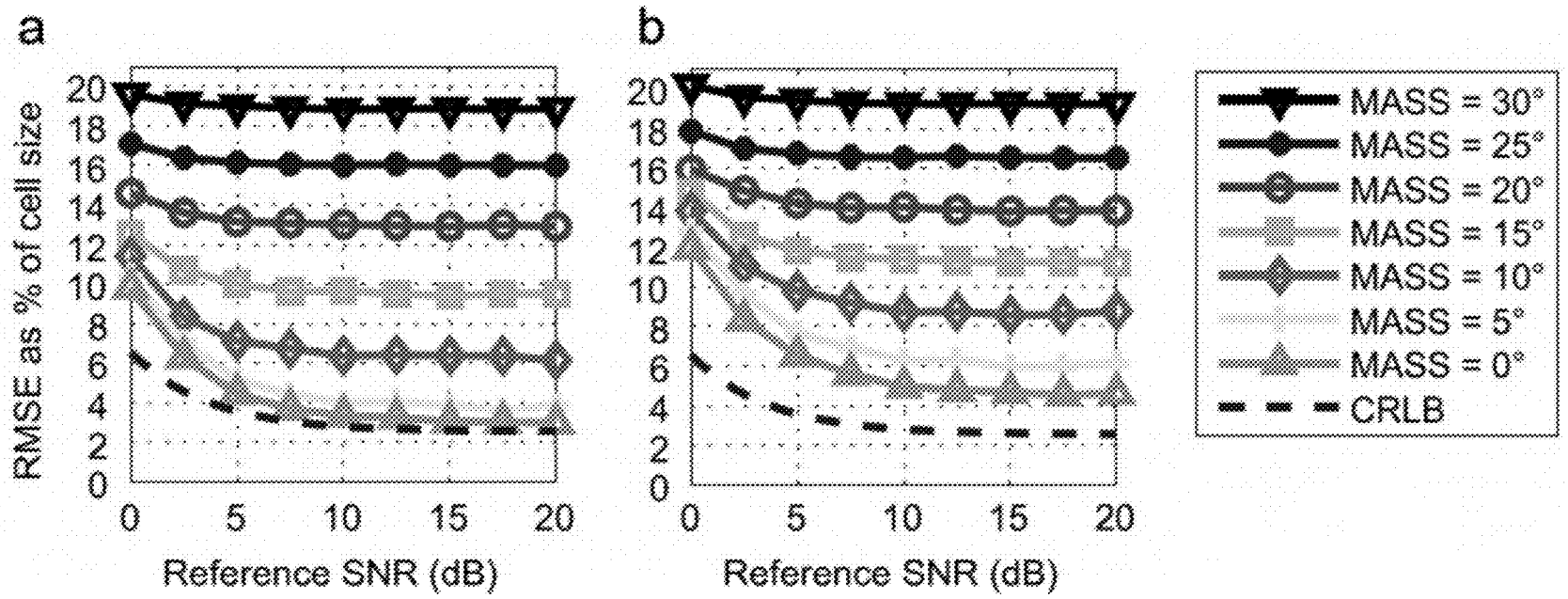
FIG. 20 is an exemplary plot of position estimation error as a percentage of cell size V for three sources in a square 4-node cell using the grid-based method and the final step approaches of (a) brute force method and (b) sequential method, with various values of MASS and SNR measured at the center of the cell, according to an embodiment of SSL.

With the sequential approach in FIG. 7, a solution was presented to the high complexity brute force approach, while acknowledging that, in some cases, its performance may be worse than the brute force approach. FIGS. 19 and 20 illustrate the difference in performance for the two approaches with the exemplary GB method for two and three sources, respectively. It is clear that little performance is lost using the sequential approach particularly at the higher, and more realistic values of MASS. The loss in performance is higher at low values of MASS, and for the three source case. Although it is not shown here due to space considerations, because the P-NLS method can use either the brute force or the sequential approach, it too suffers a very similar performance loss to that of the GB method. FIGS. 19 and 20 also illustrate the effect of MASS on the RMSE, highlighting that the DOA estimation used has a low MASS.

Complexity:

In one implementation, all the localization methodologies of SSL were implemented in MATLAB on a Windows laptop with a Core i5 CPU running at 2.53 GHz with 4 GB RAM, and their mean execution times are presented in Table 1.

TABLE 1

Mean execution times in milliseconds for localization methods for one set of DOA estimations

| | | MASS = $0^0$ | | MASS = $20^0$ | |
|---|---|---|---|---|---|
| Method | One Source | Two sources | Three sources | Two sources | Three sources |
| LLS | 0.12 | — | — | — | — |
| IP | 0.69 | 6.89 | 44.49 | 5.31 | 16.16 |
| GB (& BF) | 1.72 | 36.03 | 2961.57 | 19.18 | 214.34 |
| GB (& Seq.) | 1.72 | 29.39 | 162.79 | 16.79 | 26.69 |
| P-NLS (& BF) | 18.88 | 381.95 | 5033.43 | 205.12 | 509.59 |
| P-NLS (& Seq.) | 18.88 | 375.32 | 2238.82 | 202.72 | 322.08 |

Note that while the absolute execution times may be highly dependent on the machine, only the relative times between the methods may be of interest. In the single source case, the LLS method is clearly the fastest, while the IP method is the fastest in the a plurality of source cases. The P_NLS methods are clearly the slowest methods, due to non-linear optimization they require. Table 1 also shows the dramatic reduction in complexity when using the sequential rather than the brute force approach, particularly in the three source case. These results, together with the previous section, suggest that the GB method with the sequential approach may be the best choice given its accuracy and moderate complexity. To further verify this suitability, the GB method with the sequential approach was implemented in C++ and measured that it only consumed 25% of the available processing time, making it an excellent candidate for a real-time system.

Results of Real Measurements

Real recordings of acoustic sources in a 4-node square cell with sides 4 m long. The sensors on the nodes were circular 4-element microphone arrays with a radius of 2 cm, and the DOA estimation was performed a real-time system. The sources were recorded speech, sampled at 44.1 kHz, played back simultaneously through loudspeakers at different locations, and their SNR at the center of the cell was measured to be about 10 dB. DOA estimation and source localization was performed on frames of 2048 samples with 50% overlap. Although a 4×4 m square is not a particularly large area, since the reference SNR is measured at the center of the cell, these results can be scalable to larger cells.

Figure 21:
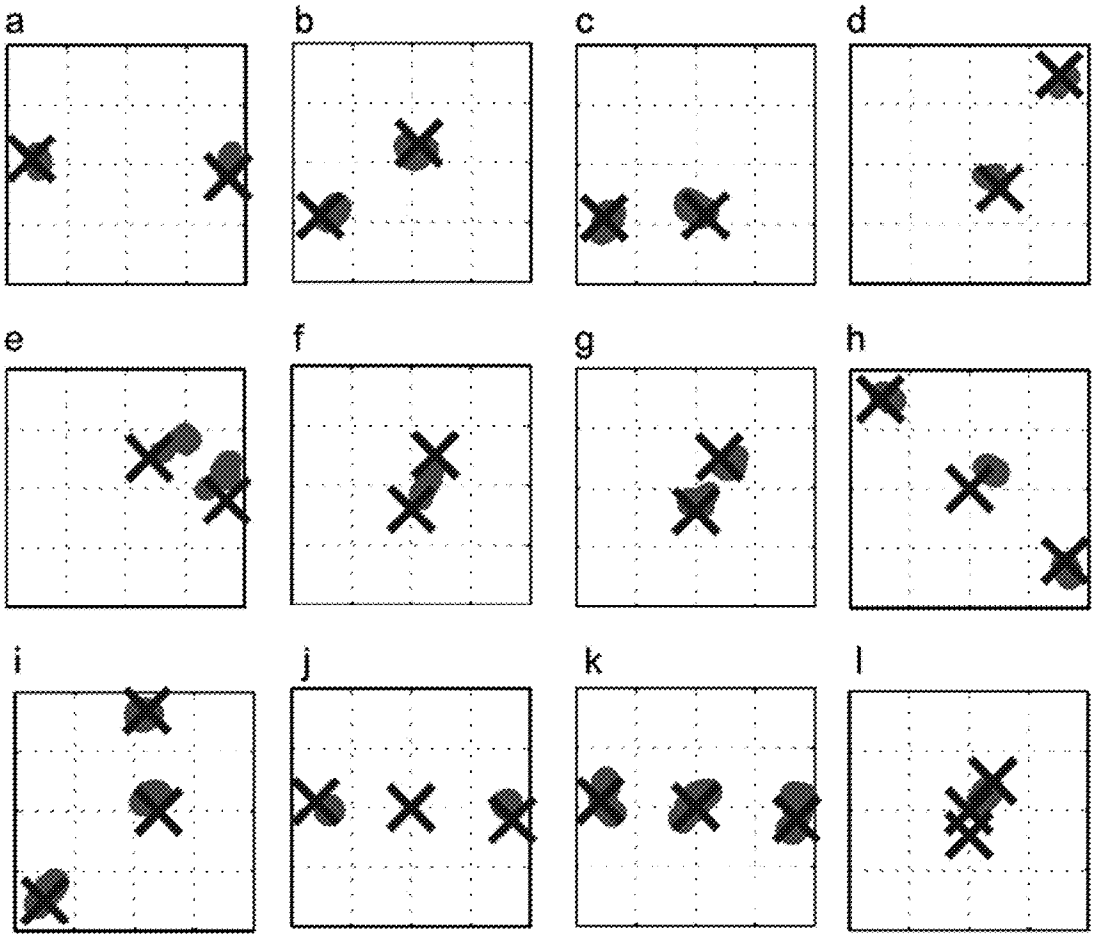
FIG. 21 is an exemplary plot of position estimates (represented by the clouds) using the exemplary grid-based method in a square 4-node cell, for real recordings of two [(a)-(g)] or three [(h)-(l)] simultaneous sources (represented by the X's), where (a) C2=4, (b) C2=2, C1=2, (c) C2=2, C1=2, (d) C2=2, C1=2, (e) C2=1, C1=3, (f) C1=4, (g) C2=2, C1=2 (h) C3=2, C1=2, (i) C3=1, C2=2, C1=1, (j) C2=4, (k) C3=3, C2=1 and (l) C1=4, according to an embodiment of SSL.

FIG. 21 shows the position estimates from the real recordings using the exemplary grid-based method for different layouts of two and three sources. The dots show the cloud of estimates over about 5 s, and show quite accurate localization. The pairs (f), (g) and (j), (k) warrant further discussion. All of the plots except (g) and (k) used the standard parameter set which has a MASS of around 20°, and it is clear that in (f) and (j) the source positions are underestimated. By modifying some of the parameters of the DOA estimation, the system's MASS could have been decreased so that all the sources in (g) and (k) could be localized, albeit with a greater variance in the estimates.

Figure 22:
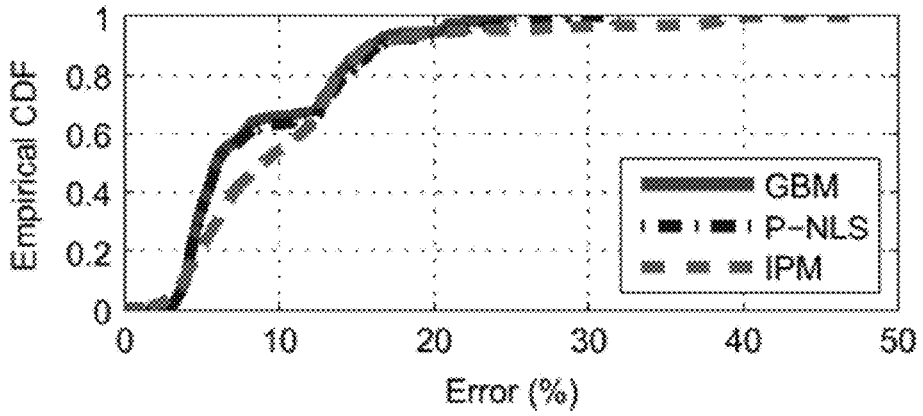
FIG. 22 is an exemplary plot of Empirical Cumulative Distribution Functions (CDFs) of the error between the estimated and true source positions using real recorded data, according to an embodiment of SSL.

The performance of the P-NLS and the disclosed grid-based and intersection point methods was also compared on the real recorded data. Again, for DOA estimation, a real-time system was used. FIG. 22 shows the empirical Cumulative Distribution Functions (CDFs) of the error between the estimated and true source positions for the three localization methods. The error was calculated using all frames for all the source positionings of FIG. 21. It is evident that the P-NLS and GB methods perform the best. However, note that while the P-NLS and GB methods have similar performance, the disclosed exemplary GB method is much more computationally efficient.

It should be noted that these recordings took place outdoors, and as such did not have many reflections, but there was a significant level of distant noise sources, such as cars and dogs barking. Furthermore, the orientations of the sensors were not finely calibrated, and the DOA estimates likely have unintended offsets of a few degrees. Thus the conditions were far from ideal, making the results of the disclosed localization method even more encouraging.

Figure 23:
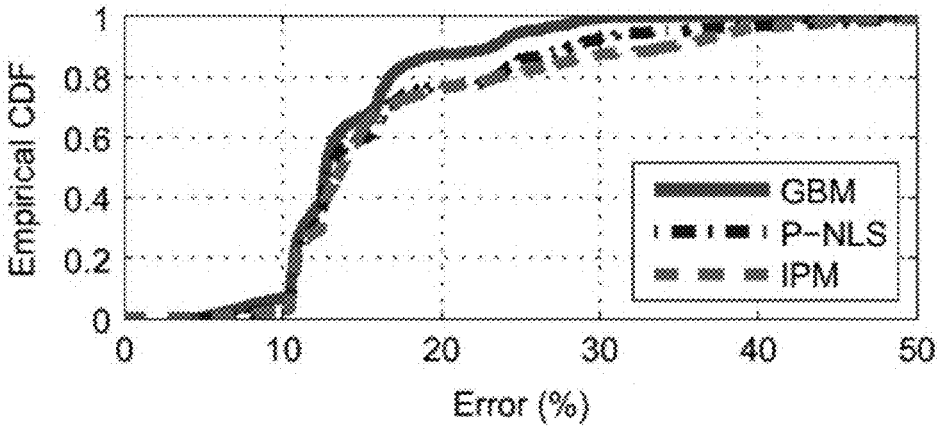
FIG. 23 is an exemplary plot of Empirical Cumulative Distribution Functions (CDFs) of the error between the estimated and true source positions in a simulated room with $T_{60}$=400 ms, according to an embodiment of SSL.

Results in Reverberant Environments:

The efficiency of the localization methods in reverberant environments was also tested. Any Image-Source method may be used to simulate a reverberant room of dimensions of 6×6×3 m with reverberation time $T_{60}$=400 ms. A 4-node cell of sides 4 m long was placed in the middle of the room. Thus, the nodes' centers are located in (1,1), (5,1), (5,5), and (1,5) m. Again, the nodes consist of circular 4-element microphone arrays with a radius of 2 cm. Consider the same source positionings and the same speech signals that were used for the real recordings in FIG. 21. For DOA estimation, the system of [20,21] on frames of 2048 samples with 50% overlap was used. FIG. 23 shows the CDFs of the error between the estimated and true source positions using all frames and all source positionings. Once again, the grid-based method performs the best. A performance degradation for all methods is evident compared to the results in FIG. 22. This is because reverberation affects the DOA estimation algorithm providing more erroneous DOA estimates.

Table 2 shows the RMSE over all frames for each position layout of FIG. 21. The results of the table agree with FIGS. 22 and 23 as the performance degradation due to reverberation is evident, and the GB method generally performs the best. It is of note that in layouts (f) and (l), the outdoor recordings have greater RMSE than the reverberant ones. These layouts correspond to the cases where the DOA estimation algorithm in all arrays always detects one source. The DOA estimation of this practically single source case is the one least affected by reverberation. This fact combined with the fact that outdoor recordings were performed in a real rather than a simulated environment can explain this small difference in the RMSE between the two scenarios.

TABLE 2

RMSE as a percentage of cell size for the real recordings (outdoors) of FIG. 21 and their corresponding reverberant simulations with $T_{60}$ = 400 ms.

| | Outdoor | | | Reverberant | | |
|---|---|---|---|---|---|---|
| Layout | GBM | P-NLS | IP | GBM | P-NLS | IP |
| (a) | 4.33 | 4.33 | 3.80 | 12.13 | 32.05 | 31.58 |
| (b) | 6.33 | 6.33 | 10.83 | 18.60 | 19.07 | 23.28 |
| (c) | 7.45 | 9.99 | 3.66 | 24.47 | 23.64 | 32.23 |
| (d) | 4.53 | 4.52 | 9.84 | 16.30 | 17.85 | 20.81 |
| (e) | 14.92 | 17.03 | 12.15 | 14.64 | 16.51 | 15.08 |
| (f) | 13.39 | 13.39 | 13.42 | 12.81 | 12.81 | 13.22 |
| (g) | 5.41 | 5.41 | 11.93 | 15.70 | 15.71 | 18.24 |
| (h) | 7.71 | 7.70 | 8.87 | 11.77 | 12.49 | 13.91 |
| (i) | 4.61 | 4.61 | 6.02 | 20.64 | 24.43 | 19.91 |
| (j) | 20.69 | 21.39 | 33.04 | 23.20 | 23.02 | 37.27 |
| (k) | 12.99 | 14.15 | 18.64 | 24.07 | 24.45 | 23.69 |
| (l) | 12.38 | 12.37 | 12.85 | 10.72 | 10.72 | 10.70 |

Data Association Results

To evaluate the efficiency of the method and system disclosed in FIGS. 7, 8A and 8B in finding the correct association of sources, simulations on a cell of a WASN with dimensions of V=4 m, with four nodes arranged according to the setup depicted in FIG. 1, were run. The nodes' locations are respectively, (2, 0), (4, 2), (2, 4), and (0, 2). Each node consists of a uniform circular microphone array with N=8 microphones and a radius r=0.05 m. In each simulation the sound sources were speech recordings of 2 seconds sampled at 44.1 kHz and had equal power when located at the center of the cell. The SNR was measured as the ratio of the power of each source signal when located at the center of the cell to the power of the noise signal. To simulate different SNR values, the system added white Gaussian noise at each microphone, uncorrelated with the source signals and the noise at the other microphones. Note that this framework results in different SNR at each array depending on how close the source is to the arrays.

Scenarios of two and three simultaneously active sources were considered. Each simulation was repeated 30 times and the sources were located within the cell with independent uniform probability. For processing, frames of 2048 samples with 50% overlap were used. The FFT size was set to 2048. The spatial-aliasing cutoff frequency for the given array geometry is approximately at 4 kHz and defines the frequencies that belong to set Ω. The same frequency range was also used for the method that was used for comparison purposes. Finally, for the method, $\epsilon$=10° and B=5 previous frames for the construction of the frequency distributions of sources.

The method's ability to handle missed detections is further discussed. Moreover, the method's association algorithm was extended to more than two arrays. For the exemplary method, the DOA estimation in each frequency point was performed. In this first simulation, it was assumed that no errors in the estimation of the directions of the sources. Thus the DOA vectors $\theta_m$, m=1, . . . , M at each array are assumed known. To evaluate the efficiency, the method was compared with a source localization method for multiple sources using low complexity non-parametric source separation and clustering, hereinafter referred to as non-parametric method.

Figure 25:
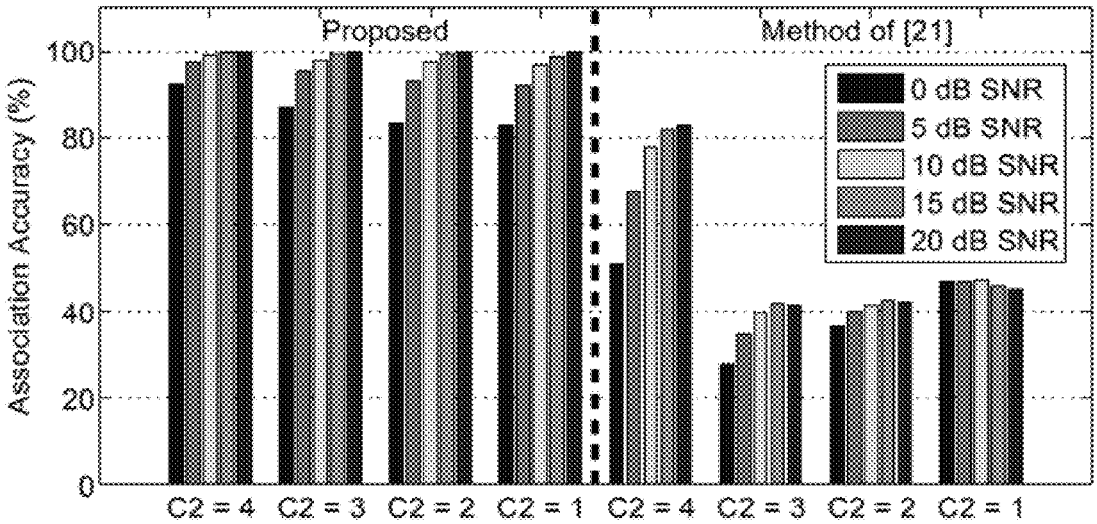
FIG. 25 is an exemplary plot of microphone array placement (numbered 1-4) and locations of active sound sources (circles) used for the listening test, according to an embodiment of SSL.

To simulate missed detections, $C_S$ is defined as the number of microphone arrays that detected s sources. The number of $C_S$ is fixed and some DOA estimates are removed from some arrays until the desired value of $C_S$ is reached. The sources whose DOAs are removed as well as the arrays that exhibit the missed detection are selected at random in every frame. FIG. 25 shows the association accuracy of the exemplary method of FIGS. 8A and 8B, and an alternate method for two sources and different SNR cases, for all possible values of $C_2$, i.e., the number of arrays that detected two sources. In each frame, the association is correct if all active sources in that frame are assigned with the correct DOAs from the arrays. Note that in the case of missing DOAs, the association algorithm must also identify the sources whose DOAs are missing.

From FIG. 25 it is clear that the exemplary method outperforms non-parametric method for all SNR cases, being also robust to missed detections. The accuracy of the non-parametric method when missed detections are present ($C_2$<4) is severely degraded, showing the method's inability to handle missed detections. This is because the association procedure relies on the binary masks in the frequency domain of the sources, which are constructed during a source separation stage. When a sound source is not detected, its frequencies are erroneously assigned to the masks of the other sources, thus degrading the association performance. In the exemplary method, such erroneous assignments are avoided through the use of (30). Moreover, the use of the distribution of frequencies provides a more reliable feature in the association method, being more robust to noise for all values of $C_2$.

Figure 26:
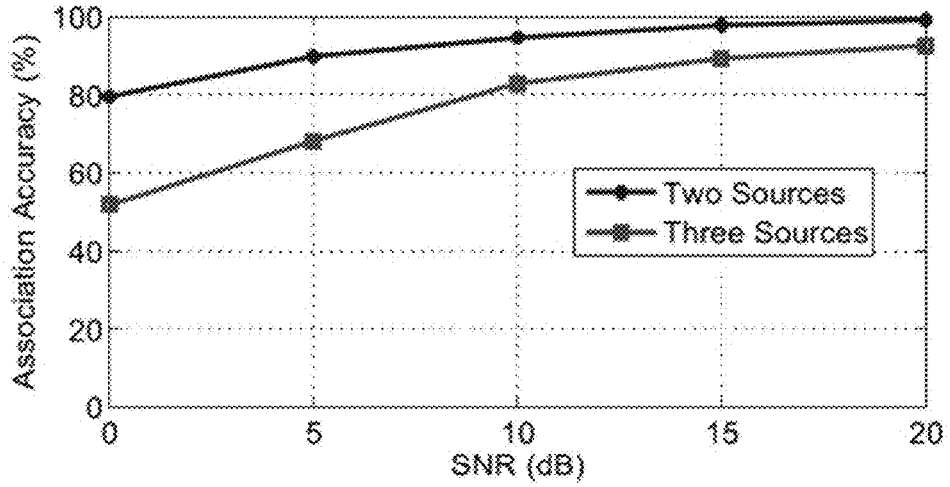
FIG. 26 are exemplary plots of preference test results that indicate the percentage of listeners that preferred the cooperative method over the closest array method for the three test locations, according to an embodiment of SSL.

In the next simulation, the association accuracy of the exemplary method in a more practical setting where the number of active sources and their corresponding DOAs are also estimated. The association accuracy for two and three simultaneously active sources and different SNR values is shown in FIG. 26. It can be observed that the exemplary method results in accurate associations especially when the SNR is 10 dB or higher. Note that in these results the values of $C_2$ and $C_3$ varies, as the number of sources is now estimated. The DOA estimation method in a given array can underestimate the number of source when the angular separation of the sources is small or when a source is located at a larger distance from the array than the other sources.

It was observed that for the two source case in approximately only 22% of the frames all four arrays detected two sources ($C_2$=4), in 35% of the frames $C_2$=3, in 38% of the frames $C_2$=2 and in 5% of the frame only one array detected two sources ($C_2$=1). The values were approximately constant for all SNR cases. The problem of missed detections is more evident in the case of three sources, where there was no case that all three sources were detected by more than two arrays, and with the value of $C_2$ being either two or three for approximately 75% of the frames in all SNR cases. Taking these numbers into consideration, FIG. 26 shows that the exemplary method is efficient against missed detections for both the two and three source cases.

Since the final goal of any data-association algorithm is to improve the location estimation accuracy, the method is evaluated in terms of localization accuracy and compare it with other methods. The localization performance was measured in terms of the root-mean square error (RMSE) over all sources, all 30 different source configurations for two and three active sources, and for all frames that at least one array was able to detect the true number of sources. The localization error using the estimated DOAs and assuming that the correct association of DOAs to the sources is known, is also included to represent the best-case scenario. It can be observed that the disclosed methods outperform the others providing location estimates very close to the best-case, especially at higher SNR values. The non-parametric method is unable to handle realistic scenarios with missed detections.

Transmission Requirements:

Finally, the transmission requirements of the method are quantified. Apart from the DOA estimates, the $m^{th}$ array has to transmit the DOA index that each frequency point was assigned to. For each frame, given $\hat{P}_m$ estimated sources, each frequency belongs to one of the sources or it is considered erroneous. Thus, for each frequency $\log_2(\hat{P}_m+1)$ bits are required to encode the DOA indices, with $\lceil . \rceil$ denoting the ceiling operator. The alternative methods require the transmission of a binary mask for each sound source. However, a similar encoding scheme can be used where each frequency requires $\log_2(\hat{P}_m)$ bits. Thus, the exemplary method results in improved data association and localization accuracy, while its transmission requirements remain at low levels.

Sound Source Isolation/Separation

Spatial audio refers to the reproduction of a soundscape by preserving the spatial information. The soundscape is usually encoded into multiple channels and reproduction is performed using multiple loudspeakers or headphones. The use of microphone arrays for spatial audio recording has attracted attention, due to their ability to perform operations, such as DOA estimation and beamforming.

Different approaches for recording spatial audio with microphone arrays have been investigated, such as high-order differential arrays, and DOA estimation combined with Head-Related Transfer Functions (HRTFs) for binaural spatial audio. Microphone arrays have also been exemplary as a recording option for Directional Audio Coding (DirAC).

The conventional techniques either restrict the loudspeaker configuration according to the microphone configuration, or ignore the spatial-aliasing that occurs in microphone arrays. The latter makes the accurate estimation of spatial features (direction and/or diffuseness) very challenging across the whole spectrum of frequencies, and degrades the quality of reproduction.

To this end, in one implementation, a real-time method for spatial audio recording using one or more microphone arrays are disclosed that mitigates some of these problems by counting the number of active sources and estimating their DOAs for each time-frame and not individually for each frequency. Based on the estimated DOAs, the source signals from one or more sources are separated through spatial filtering with a superdirective beamformer. Finally, all source signals and thus the entire soundscape are down-mixed into one monophonic signal and side-information. In one implementation, the microphone arrays are configured to cooperate in order to design a single post-filter that separates all source signals. In this scheme, each microphone array remains responsible for the sources that are closest to it, but it does not individually estimate its own post-filter.

In one implementation, embodiments of SSL include ImmACS (Immersive Audio Communication System). In one implementation, ImmACS can capture the soundscape at the recording side using a microphone array and reproduce it using a plurality of loudspeakers or headphones in real-time. The capturing and reproducing sides of ImmACS can be located far apart, so the encoded sound-scape can be transferred through a communication network. ImmACS also gives the listeners the ability to select the directions they want to hear and attenuate the sources that come from other directions. For these features, source isolation provides accurate spatial impression or reproduce specific sources while attenuating others in the soundscape.

Exemplary embodiments of ImmACS are now described in the foregoing paragraphs, followed by variations to include the use of a plurality of microphone arrays for recording spatial audio. Motivated by situations where a single microphone array cannot provide sufficient spatial coverage, such as when the angular separation of sources is very small or the sources have the same DOA with respect to the array, ImmACS can be extended to a plurality of arrays by allowing a plurality of arrays to cooperate in order to provide better and more robust source isolation.

To describe the architecture and operation of SSL, and ImmACS therein, for a plurality of microphone arrays, SSL 2700 for a single microphone array is first described. In one implementation, SSL 2700 includes a plurality of microphone arrays 1, 2, . . . M, where each of the array may include a plurality of sound sensing devices labeled $m_1$, $m_2$, . . . $m_N$, capable of detecting mechanical waves, such as sound signals, from one or more sound sources. In some embodiments, the devices may be microphones. Some embodiments may be configured to work with various types of microphones (e.g., dynamic, condenser, piezoelectric, MEMS and/or the like) and signals (e.g., analog and digital). The microphones may or may not be equispaced and the location of each microphone relative to a reference point and relative to each other may be known. Some embodiments may or may not comprise one or more sound sources, of which the position relative to the microphones may be known. Furthermore, the microphones may be arranged in the form of an array. The microphone array can be, for example, a linear array of microphones, a circular array of microphones, or an arbitrarily distributed coplanar array of microphones. The description hereinafter may relate to circular microphone arrays; however, similar methodologies can be implemented on other kind of microphone arrays.

Although mostly discussing audible sound waves, SSL 2700 may be configured to accommodate signals in the entire range of frequencies and may also accommodate signals in the entire range of frequencies and may also accommodate other types of signals (e.g., electromagnetic waves and/or the like).

The exemplary systems receive the signals captured by the plurality of sensing devices, and process received signals/data based at least on one or more parameters, such as array geometry, type of environments, and the like, to either estimate the number of the active sources, or their corresponding DOAs or both.

Each of the sound signals received by the microphones in the microphone array can include the sound signal from a sound source(s) located in proximity to the microphone or preferred spatial direction and frequency band among other unsuppressed sound signals from the disparate sound sources and directions, and ambient noise signals. In one implementation, the mixture of signals received at each of the microphones $m_1, m_2, \ldots m_M$ can be represented by $x_1(t)$, $x_2(t), \ldots, x_M(t)$, respectively. According to an implementation, each $x_i(t)$ can be represented by equation (28). The signals are received by a time-frequency (TF) transform module 2702, which provides a time-frequency representation of the observations/received signals that can be represented as $X_1(k,\omega), X_2(k,\omega), \ldots, X_M(k,\omega)$.

In an embodiment, the TF transform module 2702 divides the received signals into time frames and then implements a short-term Fourier transform (STFT) as a sparsifying transform to partition the overall time-frequency spectrum into both time and frequency domains as a plurality of frequency bands ("slices") extending over a plurality of individual time slots ("slices") on which the Fourier transform is computed. Other sparsifying transforms may be employed in a similar manner. The frequency signals are transmitted to a DOA estimator and source counter 2704.

In some embodiments, the DOA estimator and source counter 2704 provides localization information, including but not limited to, an estimated number of sources and estimated directions of arrival with a high degree of accuracy in reverberant environments. In one embodiment, the DOA estimator and source counter 104 receives localization information, directly or indirectly, from a user and temporarily or permanently stores such information as user-specified locations. In another embodiment, the DOA estimator and source counter 2704 may use previously stored localization information. In one embodiment, the DOA estimator and source counter 2704 provides localization information by detecting single-source analysis zones or single-source constant time analysis zones. In such an implementation, for each source, there is assumed to be at least one single-source analysis zone (SSAZ) where a single source is isolated, i.e., a zone where a single source is dominant over others. The sources can overlap in TF domain except in one or more of such SSAZs. Further, in one implementation, if several sources are active in the same SSAZ, they vary such that the moduli of at least two observations are linearly dependent. This allows processing of correlated sources, contrary to classical statistic-based DOA methods. In one implementation, the DOA estimator and source counter 104 detects one or more single-source analysis zones by determining cross-correlations and auto-correlations of the moduli of the time-frequency transforms of signals from pairs of sensing devices. In one implementation, correlation between all possible pairs of sensing devices are considered and the DOA estimator and source counter 2704 can identify all zones for which a predetermined correlation coefficient condition is satisfied. In another implementation, average correlation between adjacent pairs of sensing devices is considered. Additionally or alternatively, the DOA estimator and source counter 2704 can identify all zones for which the autocorrelation coefficient is based on a system or user defined threshold. In yet another implementation, a desired combination of microphones may be used for calculation of correlation coefficient to detect SSAZs. In one example, such a selection can be made via a graphical user interface. In another example, the selection can be adaptively changed as per environment or system requirements. In one implementation, the detected SSAZs may be used by the DOA estimator and source counter 2704 to derive the DOA estimates for each source in each of the detected SSAZs based at least on a cross-spectrum over all or selected few microphone pairs. Since the estimation of the DOA occurs in an SSAZ, the phasor of the cross-power spectrum of a microphone pair $\{m_i\ m_{i+1}\}$, or $\{m_i\ m_j\}$ as the case may be, is evaluated over a frequency range of the specific zone. In one implementation, the DOA estimator and source counter 2704 then computes phase rotation factors and a circular integrated cross spectrum (CICS). Based on the CICS, the estimated DOA associated with a frequency component $\omega$ in the single-source analysis zone with frequency range $\Omega$ can be given by:

$$\hat{\theta}_\omega = \arg\max_{0 \le \phi < 2\pi} |CICS^{(\omega)}(\phi)| \tag{37}$$

In one implementation of the DOA estimator and source counter 2704, a selected range or value(s) of $\omega$ are used for estimation of DOA in a single-source analysis zone. For example, in one implementation, $\omega_i^{max}$ frequency, which corresponds to the strongest component of the cross-power spectrum of the microphone pair $\{m_i\ m_{i+1}\}$ in a single source zone. By definition, $\omega_i^{max}$ is the frequency where the magnitude of cross-power spectrum reaches its maximum. In an example, $\omega_i^{max}$ gives a single DOA corresponding to each SSAZs.

In another implementation, d frequency components are used in each single-source analysis zone. For example, frequencies that correspond to the indices of the d highest peaks of the magnitude of the cross-power spectrum over all or selected microphone pairs $\{m_i\ m_j\}$ are used. The DOA estimator and source counter 2704 thus yields d estimated DOAs from each SSAZ, thereby improving the accuracy of the system 100 as more frequency components lead to lower estimation error. The selection of d frequency components may be based on desired level of accuracy and performance and can be modified based on the real-time application where the system is implemented.

It will be understood that several single-source analysis zones may lead to the same DOA estimate, as the same isolated source may exists in all such zones. In one implementation, the DOA estimator and source counter 2704 derives DOA for each source by clustering the estimated DOAs, which can be done by creating a histogram for a particular time segment; and then finding peaks in the histogram. In other implementations, DOAs and other such data-distribution can be represented in other ways, such as bar charts, etc.

Alternatively or additionally, once all the local DOAs have been estimated in each of the identified single-source analysis zones, the DOA estimator and source counter 2704 creates a histogram from the set of estimations, for example in a block of B consecutive time frames. Any erroneous estimates of low cardinality, due to noise and/or reverberations only add a noise floor to the histogram. Further, in some embodiments, a smoothed histogram is obtained from the histogram.

In other implementations, the DOA estimator and source counter 104 applies one or more methods that robustly estimate the number of active sources. To this end, the DOA estimator and source counter 2704 may include at least one of a peak search module (not shown), a linear predictive coding (LPC) module (not shown), and/or a matching pursuit module (not shown) to count the number of active sources under the constraint that the maximum number of active sources may not exceed a user or system defined upper threshold $P_{max}$.

In one implementation, the peak search module, the LPC module, or a matching pursuit module can be implemented to estimate the number of sources. It will be understood for one source, one may get several DOAs from difference single-source analysis zones because of noisy estimation procedure while using cross-power spectrum over zones. But by using histogram, as per some embodiments, a more accurate value of DOA among all the estimates can be obtained. Furthermore, the estimation of DOAs does not happen per individual time-frequency element (or for each frequency bin) but for groups of frequencies which are found to be good candidates for the DOA estimation, i.e., those groups that will give robust estimation are selected. Once DOAs are obtained, each frequency bin may be assigned to one of these DOAs.

In said implementations, the DOA estimator and source counter 2704 is capable of detecting all the sources, resulting in sufficiently accurate and smooth source trajectories. In the case of moving sources, some erroneous estimates may occur before and after the two sources meet and cross each other. However, since there are no active sources present in these directions, the subsequent operations, such as beamforming and post-filtering, are expected to cancel the reproduction of the signals from erroneous directions. Thus, as long as all the active sources are identified, individual erroneous estimates caused by an overestimation of the number of active sound sources cannot degrade the spatial audio reproduction.

In one embodiment, the output of the DOA estimator and source counter 2704, such as the estimated number of sources $\hat{P}_k$ and a vector with the estimated DOA for each source $\theta_k=[\theta_1 \ldots \theta_{\hat{P}_k}]$ per time frame k, is transferred to a source separation unit 106. The source separation unit 2706, in one implementation, may include for example, a beamformer, e.g., the fixed filter-sum superdirective beamformer. In one implementation, the beamformer is designed to maximize the array gain while maintaining a minimum constraint on the white noise gain. The frequency domain output of such a beamformer may be given by:

$$Y(\omega) = \sum_{m=1}^{M} w_m^*(\omega, \theta_s) X_m(\omega) \tag{38}$$

where $w_m(\omega, \theta_s)$ is a complex filter coefficient for the $m^{th}$ microphone to steer the beam to the desired steering direction $\theta_s$ and $(.)^*$ denotes the complex conjugate operation. Superdirective beamformers aim to maximize the directivity factor or array gain, which measures the beamformer's ability to suppress spherically isotropic noise (diffuse noise). The array gain is defined as:

$$G_a(\omega) = \frac{|w(\omega, \theta_s)^H d(\omega, \theta_s)|^2}{w(\omega, \theta_s)^H \Gamma(\omega) w(\omega, \theta_s)} \tag{39}$$

where $w(\omega, \theta_s)$ is the M×1 vector of filter coefficients for ω and steering direction $\theta_s$, $(\omega, \theta_s)$ is the steering vector of the array, $\Gamma(\omega)$ is the M×M noise coherence matrix, $(.)^T$ and $(.)^H$ denote the transpose and the Hermitian transpose operation, respectively, I is the identity matrix, ϵ controls the white noise gain constraint, and j is the imaginary unit. Under the assumption of a diffuse noise field, $\Gamma(\omega)$ can be modeled as:

$$\Gamma_{ij}(\omega) = B_0\left(\frac{2\pi f_\omega d_{ij}}{c}\right) \tag{40}$$

with being $B_0(.)$ the zeroth-order Bessel function of the first kind, c is the speed of sound, and $d_{ij}$ the distance between microphones i and j, which in the case of a uniform circular array with radius r is given by:

$$d_{ij} = 2r\left|\sin\left(\frac{2\pi(i-j)}{2M}\right)\right| \tag{41}$$

In one implementation, the optimal filter coefficients for the superdirective beamformer can be found by maximizing $G_a(\omega)$, while maintaining a unit-gain constraint on the signal from the steering direction; that is, $$w(\omega,\theta_s)^H d(\omega,\theta_s)]=1 \tag{42}$$

In one implementation, a constraint is placed on the white noise gain (WNG), which expresses the beamformer's ability to suppress spatially white noise, since some beamformers are susceptible to extensive amplification of noise at low frequencies. The WNG is a measure of the beamformer's robustness and is defined as the array gain when $\Gamma(\omega)=1$, where I is the M×M identity matrix. Thus, the WNG constraint can be expressed as:

$$\frac{|w(\omega, \theta_s)^H d(\omega, \theta_s)|^2}{w(\omega, \theta_s)^H w(\omega, \theta_s)} \geq \gamma \tag{43}$$

where γ represents the minimum desired WNG.

In one implementation, the optimal filters given the constraints of equations (42) and (43) are given by:

$$w(\omega, \theta_s) = \frac{|\in I + \Gamma(\omega)|^{-1} d(\omega, \theta_s)}{d^H(\omega, \theta_s)|\in I + \Gamma(\omega)|^{-1} d(\omega, \theta_s)} \tag{44}$$

where the constant $\epsilon$ is used to control the WNG constraint. WNG increases monotonically with increasing $\epsilon$. However, there is a trade-off between robustness and spatial selectivity of the beamformer, as increasing the WNG decreases the directivity factor.

In one implementation, to calculate the beamformer filter coefficients, an iterative procedure may be used to determine $\epsilon$ in a frequency-dependent manner. In one implementation, $\epsilon$ is iteratively increased by a predetermined factor, say 0.005, starting from $\epsilon$=0, until the WNG becomes equal or greater than $\gamma$.

Some beamformers are signal independent and may therefore be computationally efficient to implement, since the filter coefficients for all steering directions need to be estimated only once and then stored offline. In one implementation, an adaptive version of a beamformer may be implemented in which the filter coefficients are estimated at run time.

In one implementation, for each time frame k, the beamforming process employs $\hat{P}_k$ concurrent beamformers. Each beamformer steers its beam to one of the directions specified by vector, $\theta_k$ yielding in total $\hat{P}_k$ signals:

$$B_s = (k, \omega) = \sum_{m=1}^{M} w_m(\omega, \theta_s) X_m(k, \omega) s = 1, \ldots, \hat{P}_k \tag{45}$$

Where $X_m$ (k, ω) is the STFT of the signal recorded at the m-th microphone of the array and $w_m(\omega, \theta_s)$ denotes the m-th component of $w(\omega, \theta_s)$.

In some embodiments, for example in cases where the number of sound sources is large (e.g., orchestra) or the sound sources are spatially wide, or far apart, the beamformer may scan the sound field at user-defined locations instead of real-time location estimates provided by a DOA estimation algorithm, to yield an equal number of beamformed signals. In some embodiments, the beamformer may use both types of localization information, i.e., user defined and localization estimates from another module, in parallel and then combine the results. In yet another embodiment, the beamformer may use a combination of localization information from the module and user, by identifying dominant directional sources and less directional or spatially-wide sound sources. In some other embodiments, the beamformer may completely eliminate the source counting and DOA estimation method and rely only on user-defined or previously stored location estimates and source count.

In one implementation, a post-filter 2708 is implemented following the beamformer output. The goal of the post-filter is at least twofold: it produces the final separated source signals and it allows downmixing of the source signals into a monophonic signal. In one implementation, a post-filter 2708 is applied to the beamformer output, for example to enhance the source signals and cause significant cancellation of interference from other directions. In one implementation, Wiener filters that are based on the auto and cross-power spectral densities between microphones are applied to the output of the beamformer. In another implementation, a post-filter configured for overlapped speech may be used to cancel interfering speakers from the target speakers' signals. During post-filtering the WDO assumption may be made, which also allows the separated source signals to be downmixed into one audio signal. As per this implementation, it is assumed that in each time-frequency element there is only one dominant sound source (i.e., there is one source with significantly higher energy than the other sources). In speech signals this is a reasonable assumption, since the sparse and varying nature of speech makes it unlikely that two or more speakers will carry significant energy in the same time-frequency element (when the number of active speakers is relatively low). Moreover, it is known that the spectrogram of the additive combination of two or more speech signals is almost the same as the spectrogram formed by taking the maximum of the individual spectrograms in each time-frequency element.

Under this assumption, the post-filter constructs $\hat{P}_k$ binary masks as follows:

$$U_s(k, \omega) = \begin{cases} 1, \text{ if } \ldots s = \underset{p}{\operatorname{argmax}} |B_P(k, \omega)|^2, p = 1, \ldots, \hat{P}_k \\ 0 \ldots \text{ otherwise.} \end{cases} \tag{46}$$

Equation (46) implies that for each frequency element, only the corresponding element from one of the beamformed signals is retained, that is, the one with the highest energy with respect to the other signals at that frequency element, and all the other sources at that frequency element are set to zero. It may be noted that even though the notation hereinafter may include (ω) however the entities continue to be in time-frequency domain unless specified otherwise. In some embodiments, the beamformer outputs are multiplied by their corresponding mask to yield the estimated source signals:

$$\hat{S}_S(k,\omega) = U_s(k,\omega) B_s(k,\omega), s = 1, \ldots, \hat{P}_k \tag{47}$$

In some embodiments, the post-filter can also be viewed as a classification procedure, as it assigns a time-frequency element to a specific source, based on the energy of the signals. The orthogonality property of the binary masks allows efficient downmixing of the source signals into one full spectrum signal by summing them up. It also allows keeping only the corresponding element of the source with the highest energy for each frequency element, while setting others to zero.

In some embodiments, the diffuse sound may be incorporated. In one implementation, the beamforming and post-filtering procedure can be realized across the whole spectrum of frequencies or up to a specific beamformer or a user-defined cutoff frequency. Processing only a certain range of the frequency spectrum may have several advantages, such as reduction in the computational complexity, especially when the sampling frequency is high, and reduction in the side information that needs to be transmitted, since DOA estimates are available only up to the beamformer cutoff frequency. Moreover, issues related to spatial aliasing may be avoided if the beamformer is applied only to the frequency range which is free from spatial aliasing. While the DOA estimation process does not suffer from spatial aliasing as it only considers frequencies below the spatial-aliasing cutoff frequency, the beamformer's performance may theoretically be degraded. There are spatial audio applications, which would tolerate this suboptimal approach. For example, a teleconferencing application, where the signal content is mostly speech and there is no need for very high audio quality, could tolerate using only the frequency spectrum up to 4 kHz (treating the rest of the spectrum as diffuse sound), without significant degradation in source spatialization.

For the frequencies above the beamformer or user-defined cutoff frequency, the spectrum from an arbitrary microphone may be included in the downmixed signal, without additional processing. As there are no DOA estimates available for this frequency range, it is treated as diffuse sound in the decoder and reproduced by all loudspeakers, in order to create a sense of immersion for the listener. However, extracting information from a limited frequency range can degrade the spatial impression of the sound. For this reason, including a diffuse part is optional. In another implementation, the beamformer cutoff frequency may be set to f/2; such that there is no diffuse sound.

The estimated source signals either with or without the incorporated diffuse sound are then received by a reference signal and side-information generator 110. In one implementation, the reference signal is based at least on the post-filtered source signals. In one implementation, only the non-diffuse part of the signals are used to form the reference signal. Additionally or alternatively, one or more of the original time-frequency signals may be used as reference. This is indicated by a dashed line. In other implementations, weights may be used for different post-filtered signals. In yet another implementation, certain post-filtered signals may be muted or ignored for reference signal generation.

According to one implementation, the post-filtered signals may be processed and/or combined into one signal, for example by summing the beamformed and post-filtered signals in the frequency domain to form a reference signal. The masks implemented by the post-filter are orthogonal with respect to each other This means that if $U_s(\omega)=1$ for some frequency index ω, then $U_{s'}(\omega)=0$ for $s'\neq s$, which is also the case for the signals $\hat{S}_s$. Using this property, the signals may be integrated to generate a reference signal indicative of the spatial characteristics of the sound field or part of the sound field desired by the user. In one implementation, the reference or downmixed signal can be expressed as:

$$E(\omega) = \sum_{s=1}^{\hat{P}_k} \hat{S}_s(\omega) \tag{48}$$

together with the side information for each frequency element given by, $$I(\omega)=\theta_s, \text{ for the } s \text{ such that } \hat{S}_s(\omega)\neq 0 \tag{49}$$

As mentioned above, in other implementations, some other operators besides the sum operator, may be used with or without weights for generating the reference signal. In another implementation, background information of one or more signals may be used for reference.

In one implementation, the reference signal E(ω) is transformed back to the time domain as e(t) and is transmitted to the decoder, along with the side information as specified by (49). In one implementation, the signal e(t) can also be encoded as monophonic sound with the use of some coder (e.g., MP3, AAC, WMA, or any other audio coding format) in order to reduce bitrate. Furthermore, in one implementation, the side information may be encoded. For example, in one implementation, side information can be encoded based on binary masks, since the DOA estimate for each time-frequency element depends on the binary masks. The active sources at a given time frame are sorted in descending order according to the number of frequency bins assigned to them. The binary mask of the first (i.e., most dominant) source is inserted to the bit stream. Given the orthogonality property of the binary masks, the mask for the $s^{th}$ source at the frequency bins where at least one of the previous s−1 masks is one (since the rest of the masks are zero) may or may not be encoded. These locations can be identified by a simple OR operation between the s−1 previous masks. Thus, for the second up to the $(\hat{P}_k-1)^{th}$ mask, only the locations where the previous masks are all zero are inserted to the bitstream. The mask of the last source may or may not be encoded, as it contains ones in the frequency bins that all the previous masks had zeros. In one implementation, a look-up table that associates the sources and/or masks with their DOAs is also included in the bitstream. In this implementation, the number of required bits does not increase linearly with the number of sources. On the contrary, for each next source lesser bits are used than the previous one. It is computationally efficient, since the main operations are simple OR and NOR operations. The resulted bitstream may be further compressed with Golomb entropy coding applied on the run-lengths of ones and zeros.

Reproduction is possible using either headphones, an arbitrary loudspeaker configuration, or any other means. The reproduction of the a plurality of sources can include an interface where the listener can attenuate selected sources while enhancing others. Such selections may be based on estimated directions in the original sound field. Additionally, in some embodiments, the reproduction may include a mode where only one of the sources is reproduced, and all others are muted. In that case, in order to avoid musical noise, all other muted sources could be present in the background at a lower level compared to the main or non-muted sound signal so as to eliminate musical or any other type of noise.

For loudspeaker reproduction, the reference or downmixed signal and side information may be used in order to create spatial audio with an arbitrary loudspeaker setup. The non-diffuse and the diffuse parts (if the latter exists) of the spectrum are treated separately. First, the signal is divided into small overlapping time frames and transformed to the STFT domain using a transform module, as in the analysis stage.

In one implementation, the non-diffuse part of the spectrum is synthesized for example, using amplitude panning, such as vector-base amplitude panning (VBAP) module 304 at each frequency index, according to its corresponding DOA from I(w). Even though the description is based on VBAP panning, it will be understood that other kinds of amplitude panning or methods or reproducing spatial sound may be used. By adjusting the gains of a set of loudspeakers, a VBAP module (not shown) positions a sound source anywhere across an arc defined by two adjacent loudspeakers, in a 2-dimensional case or inside a triangle defined by three loudspeakers in the 3-dimensional case. If a diffuse part is included, then it is simultaneously played back from all loudspeakers.

Assuming a loudspeaker configuration with L loudspeakers, the $1^{th}$ loudspeaker signal is given by:

$$Q_l(\omega) = \begin{cases} g_l(\omega)E(\omega) \ \ldots \text{ for } \omega \leq \omega_{cutoff} \\ \frac{1}{\sqrt{L}} E(\omega) \text{ for } \omega > \omega_{cutoff} \end{cases} \tag{50}$$

where $\omega_{cutoff}$ is the beamformer cutoff frequency index, $g_1(\omega)$ is the gain for the $1^{th}$ loudspeaker at frequency index $\omega$, as computed from a VBAP module, and the diffuse part is divided by the square root of the number of loudspeakers to preserve the total energy. If $\omega_{cutoff}=f_s/2$, then the full spectrum processing method is applied and no diffuse part is included.

In one implementation, for Binaural Reproduction, head-related transfer functions (HRTFs) may be implemented in order to position each source in a certain direction. To this end, the reference signal and side information are received at the decoder or synthesis side for reproduction of spatial sound. Such information may or may not be encoded. The non-diffuse and the diffuse parts (if the latter exists) of the spectrum are again treated separately. First, the signal is divided into small overlapping time frames and transformed to the STFT domain using TF Transform Module.

According to one implementation, after transforming the downmixed or reference signal e(t) into the STFT domain, the non-diffuse part is filtered in each time-frequency element with the HRTF using HRTF Filtering Module (not shown), based at least on the side information available in I(w). Thus, the left and right output channels for the non-diffuse part, at a given time frame, are produced by:

$$Y_L(\omega)=E(\omega)\mathrm{HRTF}_L(\omega,I(\omega)),\omega_{cutoff}$$

$$Y_R(\omega)=E(\omega)\mathrm{HRTF}_R(\omega,I(\omega)),\omega_{cutoff} \tag{51}$$

where $\mathrm{HRTF}_{\{L,R\}}$ is the head-related transfer function for the left or right channel, as a function of frequency and direction, and $Y_L/Q_L$ and $Y_R/Q_R$ are signals from both the left and right channels, respectively.

In one implementation, the diffuse part is filtered with a diffuse field HRTF filtering module, in order to make its magnitude response similar to the non-diffuse part. In one implementation, diffuse field HRTFs can be produced by averaging HRTFs from different directions across the whole circle around the listener. The filtering process in this case becomes the following:

$$Y_L(\omega)=E(\omega)\mathrm{HRTF}_L^{diff}(\omega),\omega>\omega_{cutoff}$$

$$Y_R(\omega)=E(\omega)\mathrm{HRTF}_R^{diff}(\omega)\omega,\omega_{cutoff} \tag{52}$$

The method described above, that is the one used for single sensor array is referred to as non-cooperative post filter-based (NPFB) isolation method.

Sound Separation Using a Plurality of Microphone Arrays:

The systems and methods described above may be based on the assumption that the microphone array is placed in the middle of the acoustical environment that is encoded. While this is suitable for applications like teleconferencing where people are located around a room, or recording a music performance where the orchestra is placed in the front area of the microphone array, there are other scenarios where a single array cannot provide sufficient spatial coverage. In such scenarios, the sound sources may be located such that their angular separation is too small for the array to isolate them, or the sources may even be located such that they have the same DOA with respect to the array, making the discrimination of the sources impossible.

For these reasons, embodiments of SSL include a plurality of microphone arrays 1, 2, . . . M. In one implementation, SSL uses the information from the microphone arrays combined with location information about the sound sources in order to isolate them and encode the soundscape. Source isolation or separation provides accurate spatial impression, and for that each source signal that is reproduced from a specific direction may not contain interfering sources. Moreover, it enables listeners to "focus" the reproduction on a specific sound source by choosing to reproduce that source only and attenuate all the other sources present in the soundscape through a communication network 2802.

On the recording side, a plurality of arrays are placed to monitor the area. Assuming that the locations of the sources are known or can be estimated for example by fusing DOA estimates from the different arrays, where each microphone array can calculate the DOAs of the sources with respect to that array by:

$$\theta_{n,s}=\arctan\frac{p_{y,s}-q_{y,n}}{p_{x,s}-q_{x,n}} \tag{53}$$

Where $\theta_{n,s}$ is the DOA of the s-th source with respect to the n-th microphone array, are the locations of the s-th sound source and the n-th microphone array, $p_s=[p_{x,s}\ p_{y,s}]^T$ and $q_n=[q_{x,n}\ q_{y,n}]^T$ respectively. It is also assumed that the microphone arrays are connected to a central node (CN) that carries the spatial audio capturing operations, providing synchronized signals. In one implementation, DOA estimator and source counter 2804, similar to 2704, may be used.

In one implementation, exemplary method and system includes beamforming and post-filtering from the closest array for each source. As the locations of the sources are known or estimated, one approach can be to isolate each source using the closest array to the source, as it is expected that this array would have the highest SNR for the source of interest. This approach works in the following way. In one implementation, the microphone array closest to a source is selected, based on the source's location. In other implementations, the array in which the sources are most separated in terms of the direction may be used as beamformers could provide better spatial separation.

The DOAs of all the active sources to that array are found via (53) so as to perform beamforming and post-filtering through (45)-(47) using the signals from that array. From the $\hat{P}_k$ final separated source signals, only those of the sources that are closest to that array are maintained, while the separated signals of the other sources are discarded, as they will be estimated from the array that is closest to them. Finally, each microphone array will contribute with the separated signals of the sources that are closest to it.

In this scheme, each microphone array estimates its own post-filter. This method is hereinafter referred to as Post-Filter based (PFB) isolation method Thus, the binary masks are no longer orthogonal which does not allow the encoding of the soundscape in one audio signal. Moreover, each array has to beamform to all sources in order to estimate and apply the post-filter, even though only the closest ones are maintained. As a result, unnecessary beamforming operations are carried out and the computational complexity increases proportionally to the number of microphone arrays. Some gaps may arise when the sources are far apart or at a small angular separation with respect to an array. As the post-filter compares energies and energy decreases with distance, the array aiming to separate its closest source will provide poor beamformed signals for the sources that are far away, and act as interferers, degrading the source isolation performance.

To this end, in one implementation, the exemplary method and system includes beamforming and cooperative post-filter 2806. In one implementation, each microphone array remains responsible for the sources that are closest to it, but it does not individually estimate its own post-filter. This method works in the following way:

Based on the sources' locations, the closest microphone array for each source is selected and the DOA for that source with respect to that array is calculated using (53).

In contrast to the closest-array method, each array beamforms only to the sources that are closest to it using (45). The beamformed signals $B_s(k, \omega)$, s=1, . . . , $\hat{P}_k$ that now come from different arrays are used to estimate a single post-filter using (46). The final separated signals are then estimated via (47).

This scheme is more computationally efficient than the closest array method, as for $\hat{P}_k$ number of sources only $\hat{P}_k$ beamforming operations are needed. Moreover, as a single post-filter is used, the orthogonality property holds, which allows SSL to encode the entire soundscape into one monophonic audio signal and side-information. Note that, as the locations of the sources are known, the side-information can contain the locations—and not DOAs only—of the sources. The encoding scheme for the side-information channel in single microphone array can also support the encoding of location information. Therefore, a transform module 2810 and a filtering module 2812 may be used to reconstruct sound signals. Finally, this approach is expected to perform better isolation, as the beamformed signals that take part in the post-filtering stage are all beamformed from the closest array (i.e., with the highest SNR) in contrast to the closest array method.

Experimental Results

Figure 29:
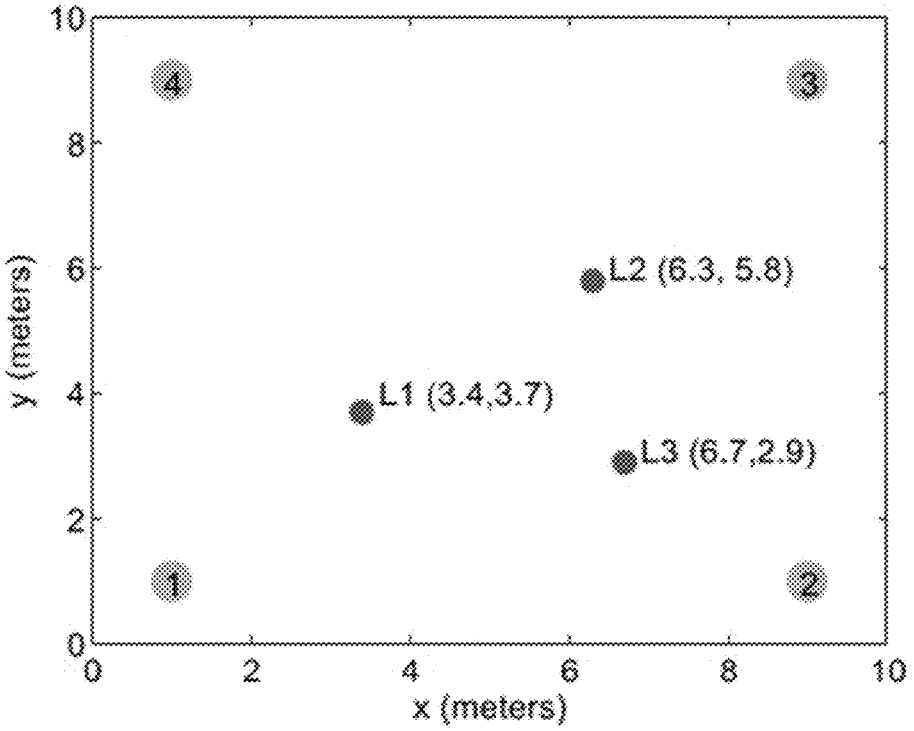
FIGS. 29 and 30 are exemplary graphs of an exemplary method and system configured for plurality of sound sources coupled with a plurality of microphone arrays, according to an embodiment of SSL.

In order to evaluate the source isolation performance of the two methods described above, a listening test was performed. The test scenario is described in FIG. 29 and consists of three simultaneously active sources at locations $L_1$, $L_2$, and $L_3$. In a room of dimensions 10×10×3 meters there are N=4 circular microphone arrays at locations (1, 1), (9, 1), (9, 9), (1, 9) meters. Each microphone array has a radius of 2 cm and consists of M=4 omnidirectional microphones. The DOAs of the sources at the three locations with respect to the 4 microphone arrays are shown in Table 3. Note that the sources are located close together in terms of angular separation with respect to all arrays (Table 3) making the source isolation problem quite challenging.

TABLE 3

DOAs for source locations used in the listening test with respect to each microphone array

| | L1 | L2 | L3 |
|---|---|---|---|
| Mic. array 1 | 48° | 42° | 18° |
| Mic. array 2 | 154° | 119° | 140° |
| Mic. array 3 | 223° | 229° | 249° |
| Mic. array 4 | 294° | 328° | 313° |

A known image-source method was used to produce simulated signals of omnidirectional sources in a room with reverberation time $T_{60}$=0.4 seconds. The signals were processed using frames of 2048 samples with 50% overlap, windowed with a von Hann window. The FFT size was 4096. The approaches of Figures x and Y were used in order to isolate the three source signals. The experiment was repeated 6 times with different speakers at locations $L_1$, $L_2$, and $L_3$ (FIG. 29), resulting in 18 isolated source signals for each method.

A preference test was also employed, where listeners used headphones to listen to the reverberant source signal of the target source and the output of the two methods (NPFB isolation method and PFB isolation method) and they were asked to indicate which method of the two they preferred in terms of speech quality, intelligibility, and source isolation (always comparing to the original reverberant source). The samples were randomized and the subjects did not know to which method they belonged. Eleven volunteers participated in the listening test (authors not included).

Figure 30:
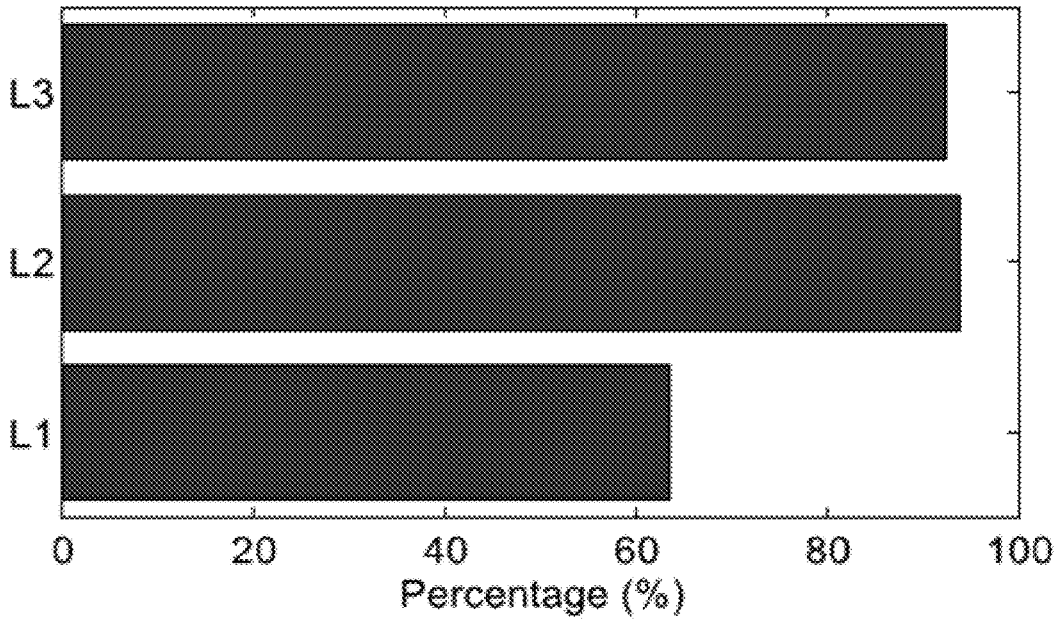

FIG. 30 shows the percentage of listeners that preferred the beamforming with cooperative post-filtering approach of Fig y. for each location. It is clear that this approach outperforms the NPFB isolation method. The PFB isolation method results in better source isolation and maintains better speech quality and intelligibility, while keeping all the attractive properties for downmixing into a single audio signal and being computationally efficient (the same number of beamforming operations as in the SSL for one array is required).

The binary masks during the post-filtering operation can create musical distortions in the isolated source signals. For spatial audio reproduction, the source signals are played back together albeit from different directions which eliminates the musical distortion. However, when the goal is to "focus" on the source signal from a specific location, attenuating the sources from the other locations, is key to maintaining low distortion in the isolated source signal. To evaluate speech distortion, the Log-Likelihood Ratio (LLR) was calculated by comparing the signal of the target source as received at the closest microphone and the methods' output. Note that, as the reference signal contains reverberant parts, high values of LLR do not necessarily indicate high distortion. However, in this way, a fixed reference signal can be obtained and the LLR values for the two methods can be compared.

The LLR values, averaged over the different speakers, at target locations $L_1$, $L_2$, and $L_3$ are shown in Table 4. For each speaker, the LLR was computed using 23 ms frames with 75% overlap and a Hamming window. The mean LLR value of each speaker was then computed by taking the mean over the 95% of the frames with the smallest LLR values. In good agreement with the listening test results, Table 4 shows that the beamforming with NPFB isolation method maintains lower distortion in the separated signals. It is of note that for the isolated signals at location $L_1$ both methods have similar distortion values, which can explain the discrepancy in listeners' preference between location $L_1$ and locations $L_2$ and $L_3$ (FIG. 28).

TABLE 4

Figure 28:
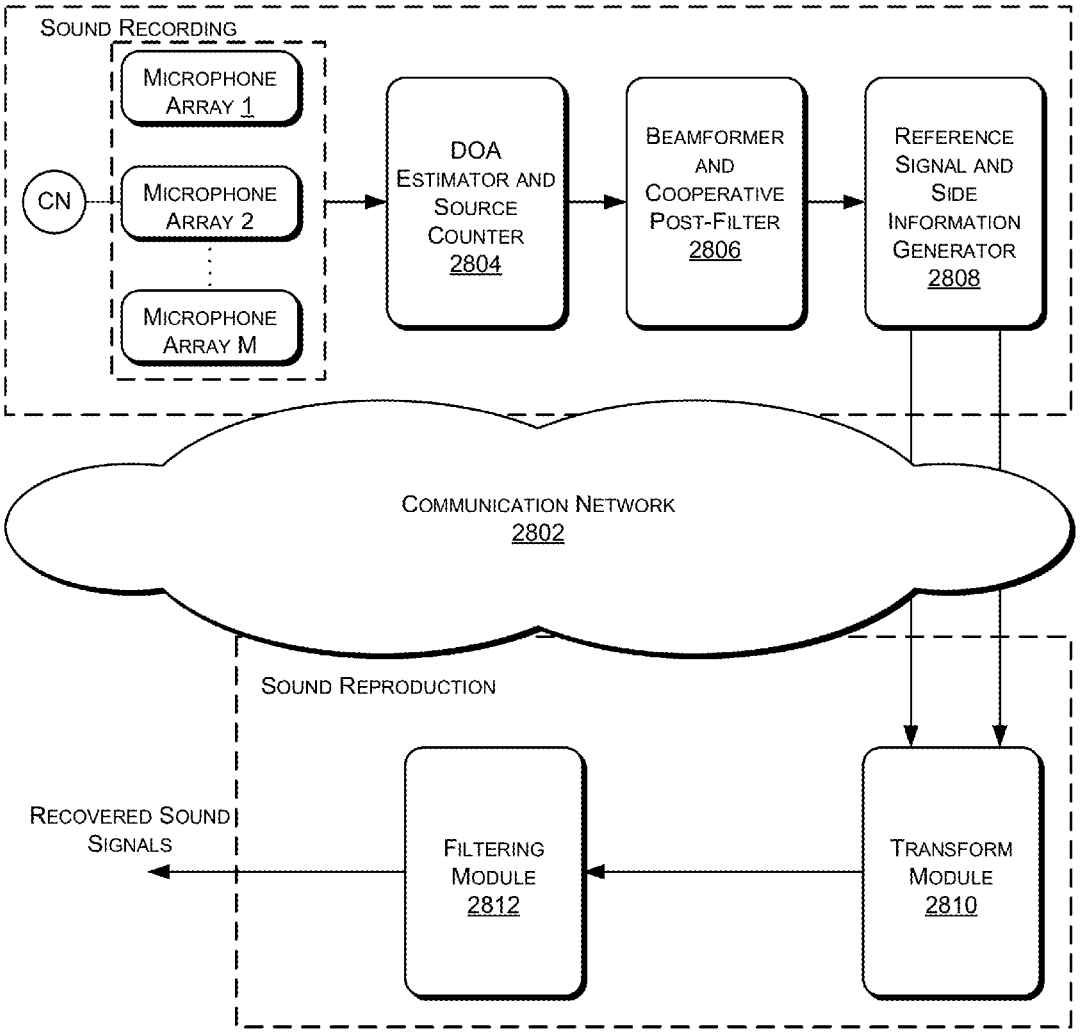
FIG. 28 is an exemplary block diagram of an SSL system configured to obtain sound signals from a plurality of sound sources coupled with a plurality of microphone arrays, according to an embodiment of SSL.

Log-Likelihood Ratio averaged over different speakers for locations L1, L2, and L3 of Fig. 28.

Figure 27:
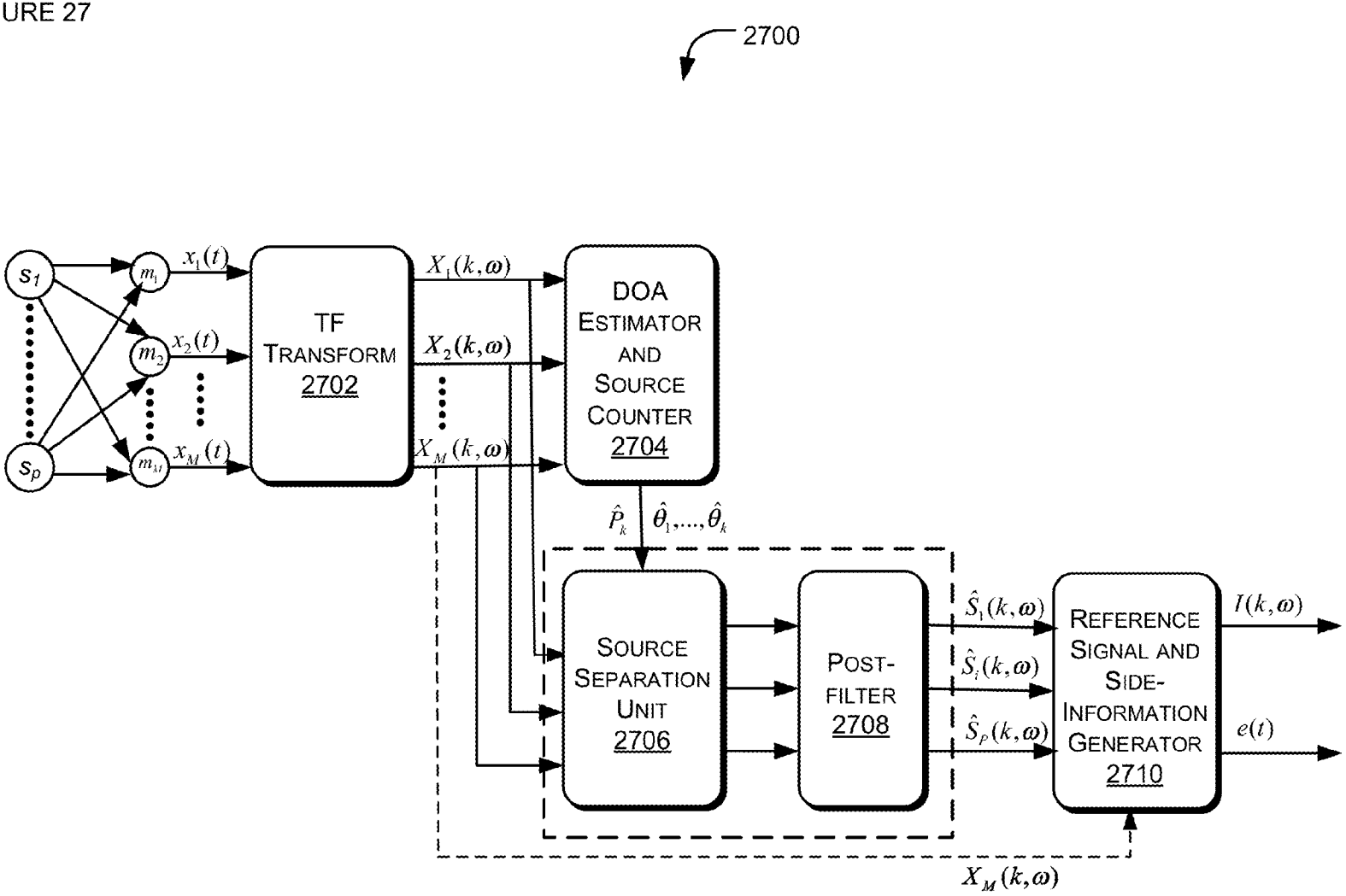
FIG. 27 is an exemplary block diagram of an SSL system configured to obtain sound signals from a plurality of sound sources coupled with a single microphone array, according to an embodiment of SSL.

| | Method of Fig. 27 | Method of Fig. 28 |
|---|---|---|
| L1 | 0.4080 | 0.3921 |
| L2 | 0.6177 | 0.4226 |
| L3 | 0.5838 | 0.3724 |

Therefore, in one implementation, embodiments of SSL allow the use of a plurality of microphone arrays to perform sound source isolation in the context of spatial audio recording and reproduction. One or more methods for incorporating a plurality of microphone arrays for real-time spatial audio capturing and reproduction are disclosed herein. Listening test results and objective measures for speech distortion show that the beamforming with cooperative post-filtering offers better source isolation and speech quality. The results show promise in the use of a plurality of microphone arrays for spatial audio recording, and warrant further investigation of the performance of these methods in the presence of DOA and location estimation errors and for other types of signals, such as musical instruments.

SSL Controller

Figure 31:
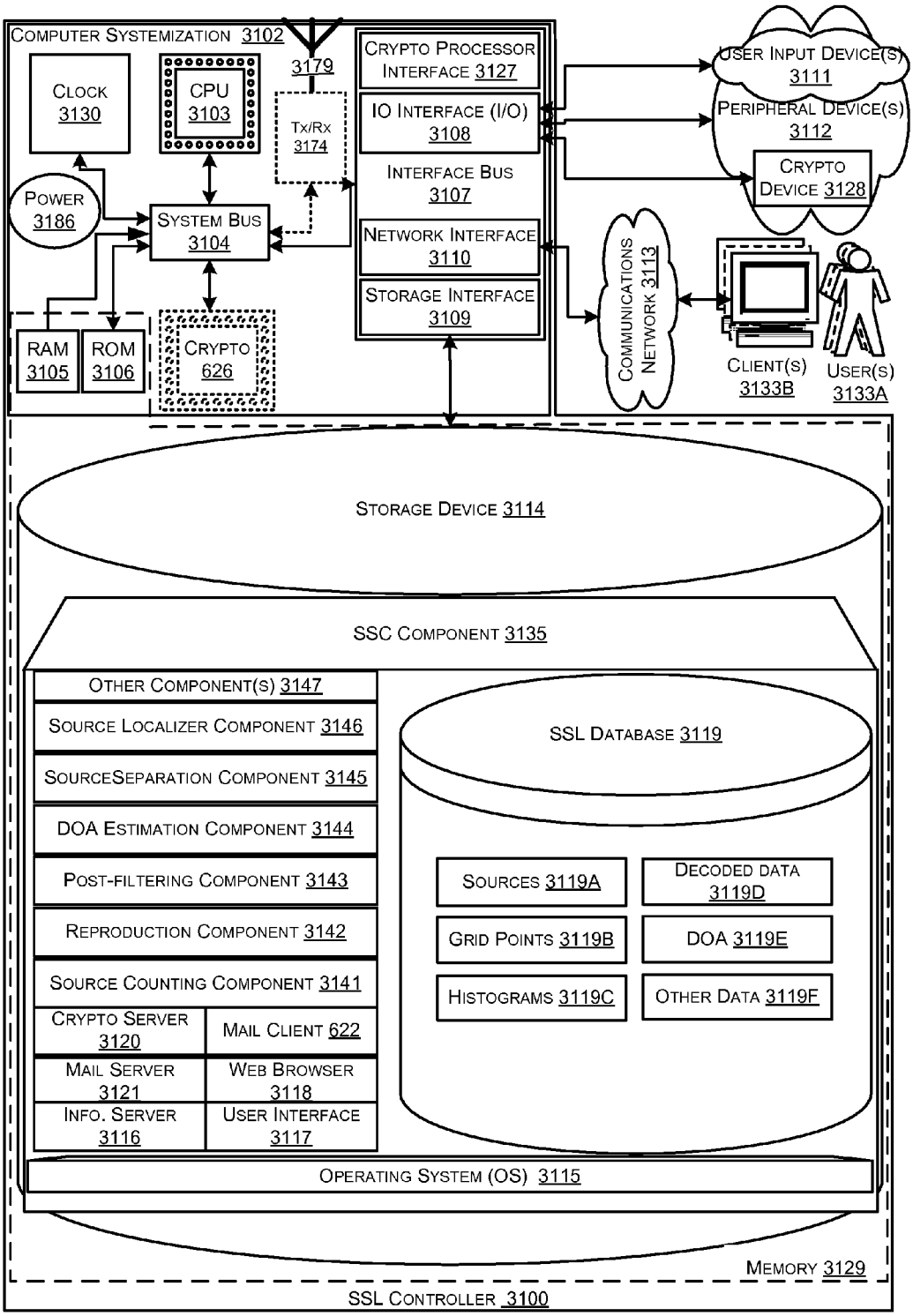
FIG. 31 is a block diagram of an SSL controller, according to an embodiment of SSL.

FIG. 31 shows a block diagram illustrating exemplary embodiments of an SSL controller 3100. In this embodiment, the SSL controller 3100 may serve to aggregate, process, store, search, serve, identify, instruct, generate, match, and/or facilitate interactions with a computer through technologies, and/or other related data.

Users, e.g., 3113A, which may be people and/or other systems, may engage information technology systems (e.g., computers) to facilitate information processing. In turn, computers employ processors to process information; such processors 3103 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 3129 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by the CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the SSL controller 3100 may be connected to and/or communicate with entities such as, but not limited to: one or more users from user input devices 3111; peripheral devices 3112; an optional cryptographic processor device 3128; and/or a communications network 3113 (hereinafter referred to as networks).

Networks 3113 are understood to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The SSL controller 3100 may be based on computer systems that may comprise, but are not limited to, components such as: a computer systemization 3102 connected to memory 3129.

Computer Systemization

A computer systemization 3102 may comprise a clock 3130, central processing unit ("CPU(s)" and/or "processor(s)" (these terms are used interchangeable throughout the disclosure unless noted to the contrary)) 3103, a memory 3129 (e.g., a read only memory (ROM) 606, a random access memory (RAM) 3105, etc.), and/or an interface bus 3107, and most frequently, although not necessarily, are all interconnected and/or communicating through a system bus 3104 on one or more (mother)board(s) having conductive and/or otherwise transportive circuit pathways through which instructions (e.g., binary encoded signals) may travel to effectuate communications, operations, storage, etc. The computer systemization may be connected to a power source 3186; e.g., optionally the power source may be internal. Optionally, a cryptographic processor 3126 and/or transceivers (e.g., ICs) 3174 may be connected to the system bus. In another embodiment, the cryptographic processor and/or transceivers may be connected as either internal and/or external peripheral devices 3112 via the interface bus I/O. In turn, the transceivers may be connected to antenna(s) 3179, thereby effectuating wireless transmission and reception of various communication and/or sensor protocols; for example the antenna(s) may connect to: a Texas Instruments WiLink WL5283 transceiver chip (e.g., providing 802.11n, Bluetooth 3.0, FM, global positioning system (GPS) (thereby allowing SSL controller 200 to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that may increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves may incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 529 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the SSL controller and beyond through various interfaces. Should processing requirements dictate a greater amount of speed and/or capacity, distributed processors (e.g., Distributed SSL system), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the SSL system may be achieved by implementing a microcontroller such as CAST's R8051XC2 microcontroller; Intel's MCS 51 (i.e., 8051 microcontroller); and/or the like. Also, to implement certain features of the SSL system, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the SSL system component collection (distributed or otherwise) and/or features may be implemented via the microprocessor and/or via embedded components; e.g., via ASIC, coprocessor, DSP, FPGA, and/or the like. Alternately, some implementations of the SSL system may be implemented with embedded components that are configured and used to achieve a variety of features or signal processing.

Depending on the particular implementation, the embedded components may include software solutions, hardware solutions, and/or some combination of both hardware/software solutions. For example, SSL system features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of SSL system features. A hierarchy of programmable interconnects allow logic blocks to be interconnected as needed by the SSL system designer/administrator, somewhat like a one-chip programmable breadboard. An FPGA's logic blocks can be programmed to perform the operation of basic logic gates such as AND, and XOR, or more complex combinational operators such as decoders or mathematical operations. In most FPGAs, the logic blocks also include memory elements, which may be circuit flip-flops or more complete blocks of memory. In some circumstances, the SSL system may be developed on regular FPGAs and then migrated into a fixed version that more resembles ASIC implementations. Alternate or coordinating implementations may migrate SSL controller 500 features to a final ASIC instead of or in addition to FPGAs. Depending on the implementation all of the aforementioned embedded components and microprocessors may be considered the "CPU" and/or "processor" for the SSL system.

Power Source

The power source 3186 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 3186 is connected to at least one of the interconnected subsequent components of the SSL system thereby providing an electric current to all subsequent components. In one example, the power source 3186 is connected to the system bus component 3104. In an alternative embodiment, an outside power source 3186 is provided through a connection across the I/O 608 interface. For example, a USB and/or IEEE 1394 connection carries both data and power across the connection and is therefore a suitable source of power.

Interface Adapters

Interface bus(ses) 3107 may accept, connect, and/or communicate to a number of interface adapters, conventionally although not necessarily in the form of adapter cards, such as but not limited to: input output interfaces (I/O) 3108, storage interfaces 3109, network interfaces 66, and/or the like. Optionally, cryptographic processor interfaces 3127 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 3109 may accept, communicate, and/or connect to a number of storage devices such as, but not limited to: storage devices 3114, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 3110 may accept, communicate, and/or connect to a communications network 3113. Through the communications network 3113, the SSL controller 3100 is accessible through remote clients 3133B (e.g., computers with web browsers) by users 3133A. Network interfaces may employ connection protocols such as, but not limited to: direct connect, Ethernet (thick, thin, twisted pair 10/500/5000 Base T, and/or the like), Token Ring, wireless connection such as IEEE 802.11a-x, and/or the like. Should processing requirements dictate a greater amount speed and/or capacity, distributed network controllers (e.g., Distributed SSL system), architectures may similarly be employed to pool, load balance, and/or otherwise increase the communicative bandwidth required by the SSL controller 3100. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, a plurality of network interfaces 3110 may be used to engage with various communications network types 3113. For example, a plurality of network interfaces may be employed to allow for the communication over broadcast, multicast, and/or unicast networks.

Input Output interfaces (I/O) 3108 may accept, communicate, and/or connect to user input devices 3111, peripheral devices 3112, cryptographic processor devices 3128, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division a plurality of access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 3111 often are a type of peripheral device 3112 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 3112 may be connected and/or communicate to I/O and/or other facilities of the like such as network interfaces, storage interfaces, directly to the interface bus, system bus, the CPU, and/or the like. Peripheral devices may be external, internal and/or part of the SSL controller 3100. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 3126), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the SSL controller 3100 may be embodied as an embedded, dedicated, and/or monitor-less (i.e., headless) device, wherein access would be provided over a network interface connection.

Cryptographic units such as, but not limited to, microcontrollers, processors 3126, interfaces 3127, and/or devices 3128 may be attached, and/or communicate with the SSL controller 200. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: Broadcom's CryptoNetX and other Security Processors; nCipher's nShield; SafeNet's Luna PCI (e.g., 7500) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2500, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 3129. However, memory is a fungible technology and resource, thus, any number of memory embodiments may be employed in lieu of or in concert with one another. It is to be understood that the SSL controller 3100 and/or a computer systemization may employ various forms of memory 3129. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 3129 may include ROM 3106, RAM 3105, and a storage device 3114. A storage device 3114 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 3129 may contain a collection of program and/or database components and/or data such as, but not limited to: operating system component(s) 3115 (operating system); information server component(s) 3116 (information server); user interface component(s) 3117 (user interface); Web browser component(s) 3118 (Web browser); SSL database(s) 3119; mail server component(s) 3121; mail client component(s) 3122; crypto graphic server component(s) 3120 (cryptographic server); the SSL component(s) 3135; the source counting component 3141; the reproduction component 3142; the post-filtering component 3143; the DOA estimation component 3143; the DOA estimation component 3144, the source separation component 3145; the source localizer component 3146; and the other component(s) 3147, and/or the like (i.e., collectively a component collection). These components may be stored and accessed from the storage devices and/or from storage devices accessible through an interface bus. Although non-conventional program components such as those in the component collection, typically, are stored in a local storage device 3114, they may also be loaded and/or stored in memory such as: peripheral devices, RAM, remote storage facilities through a communications network, ROM, various forms of memory, and/or the like.

Operating System

The operating system component 3115 is an executable program component facilitating the operation of the SSL controller 3100. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NTNista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the SSL controller to communicate with other entities through a communications network 3113. Various communication protocols may be used by the SSL controller 3100 as a subcarrier transport mechanism for interaction, such as, but not limited to: multicast, TCP/IP, UDP, unicast, and/or the like.

Information Server

An information server component 3116 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C(++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the SSL controller 200 based on the remainder of the HTTP request. For example, a request such as http://123.124.125.526/myInformation.html might have the IP portion of the request "123.124.125.526" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the SSL database 3119, operating systems, other program components, user interfaces, Web browsers, and/or the like.

Access to the SSL system database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the SSL system. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the SSL system as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 3117 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 3118 is a stored program component that is executed by a CPU. The Web browser may be a conventional hypertext viewing application such as Microsoft Internet Explorer or Netscape Navigator. Secure Web browsing may be supplied with 528 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Also, in place of a Web browser and information server, a combined application may be developed to perform similar operations of both. The combined application would similarly affect the obtaining and the provision of information to users, user agents, and/or the like from the SSL system enabled nodes. The combined application may be nugatory on systems employing standard Web browsers.

Mail Server

A mail server component 3121 is a stored program component that is executed by a CPU 203. The mail server may be a conventional Internet mail server such as, but not limited to sendmail, Microsoft Exchange, and/or the like. The mail server may allow for the execution of program components through facilities such as ASP, ActiveX, (ANSI) (Objective-) C(++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the SSL system.

Access to the SSL system mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 3122 is a stored program component that is executed by a CPU 503. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 3120 is a stored program component that is executed by a CPU 503, cryptographic processor 3126, cryptographic processor interface 3127, cryptographic processor device 3128, and/or the like. Cryptographic processor interfaces may allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component may facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash operation), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the SSL system may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the SSL system component to engage in secure transactions if so desired. The cryptographic component facilitates the secure accessing of resources on the SSL system and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

SSL Database

The SSL database component 3119 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the SSL database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. If the SSL database is implemented as a data-structure, the use of the SSL database 519 may be integrated into another component such as the SSL system component 535. Also, the database may be implemented as a mix of data structures, objects, and relational structures. Databases 3119 may be consolidated and/or distributed in countless variations through standard data processing techniques. Portions of databases, e.g., tables, may be exported and/or imported and thus decentralized and/or integrated.

In one embodiment, the SSL database component 3119 includes data tables 3119A-F. In one embodiment, the sources table 3119A may include fields such as, but not limited to: source_location, source_count, source_DOA and/or the like.

A grid points table 3119B may include fields such as, but not limited to: grid points, gridarea, shape_of_microphones_array, number_of_microphones, microphones_relative_positions, microphones_sensitivities, microphones_gains, microphones_electronics_delays, filters, and/or the like.

A histogram table 3119C may include fields such as, but not limited to: histogram, option_ID, time-frequency_transformation_method, DOA_estimation_method, single_source_identification_method, cross_correlation_definition, frequency_range_limits, thereshold, sources_counting_methods, filters, property_ID, user_ID and/or the like.

A decoded data 3119D may include fields such as, but not limited to: timestamp, data_ID, channel, signal, estimated_DOAs, uncertainty, duration, frequency_range, moduli, noise_level, active_filters, option_ID, property_ID, user_ID and/or the like. The Decoded Data table may support and/or track a plurality of entity accounts on an SSL.

A DOA table 3119E may include fields such as, but not limited to: timestamp, DOA_ID, estimated_DOA, counted_hits, tolerance, confidence_level, event_ID and/or the like. The DOA table may support and/or track a plurality of entity accounts on a SSL.

The other data table 3119F includes all other data generated as a result of processing by modules within the SSL component 3135. For example, the other data 3119F may include temporary data tables, aggregated data, extracted data, mapped data, etc., encoded data, such as estimated number of sources and their DOAs. In one embodiment, the SSL database 3119 may interact with other database systems. For example, employing a distributed database system, queries and data access by search SSL system component may treat the combination of the SSL database 3119, an integrated data security layer database as a single database entity.

In one embodiment, user programs may contain various user interface primitives, which may serve to update the SSL system. Also, various accounts may require custom database tables depending upon the environments and the types of clients the SSL system may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 3119A-F. The SSL system may be configured to keep track of various settings, inputs, and parameters via database controllers.

The SSL database 3119 may communicate to and/or with other components in a component collection, including itself, and/or facilities of the like. Most frequently, the SSL database communicates with the SSL system component, other program components, and/or the like. The database may contain, retain, and provide information regarding other nodes and data.

The SSL Systems

The SSL system component 3135 is a stored program component that is executed by a CPU. In one embodiment, the SSL system component incorporates any and/or all combinations of the aspects of the SSL system that was discussed in the previous figures. As such, the SSL system affects accessing, obtaining and the provision of information, services, transactions, and/or the like across various communications networks.

The SSL component may transform sound signals via SSL components into sound source(s) characterization information, and/or the like and use of the SSL. In one embodiment, the SSL component 3135 takes inputs (e.g., sound signals, and/or the like) etc., and transforms the inputs via various components (e.g., Source Counting Component 3141, Reproduction Component 3142, Post Filtering Component 3143, DOA Estimation Component 3144, Source Separation Component 3145, Source Localizer Component 3146 and/or the like), into outputs (e.g., DOAs, number_of_sources, tolerance, confidence and/or the like).

The SSL component 3135 enabling access of information between nodes may be developed by employing standard development tools and languages such as, but not limited to: Apache components, Assembly, ActiveX, binary executables, (ANSI) (Objective-) C(++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the SSL system server employs a cryptographic server to encrypt and decrypt communications. The SSL system component may communicate to and/or with other components in a component collection, including itself, and/or facilities of the like. Most frequently, the SSL system component communicates with the SSL system database, operating systems, other program components, and/or the like. The SSL system may contain, communicate, generate, obtain, and/or provide program component, system, user, and/or data communications, requests, and/or responses.

Distributed SSL Systems

The structure and/or operation of any of the SSL system node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. A plurality of instances of any one of the program components in the program component collection may be instantiated on a single node, and/or across numerous nodes to improve performance through load-balancing and/or data-processing techniques. Furthermore, single instances may also be distributed across a plurality of controllers and/or storage devices; e.g., databases. All program component instances and controllers working in concert may do so through standard data processing communication techniques.

The configuration of the SSL controller 3100 may depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c -post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration may depend upon the context, environment, and requirements of system deployment.

For example, in some implementations, the SSL controller may be executing a PHP script implementing a Secure Sockets Layer ("SSL") socket server via the information sherver, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address = '192.1318.0.500';
$port = 255;
// create a server-side SSL socket, listen for/accept incoming
communication
$sock = socket_create(AF_INET, SOCK_STREAM, 0);
socket_bind($sock, $address, $port) or die('Could not bind to address');
socket_listen($sock);
$client = socket_accept($sock);
// read input data from client device in 5024 byte blocks until end of
message
do {
        $input = "";
        $input = socket_read ($client, 5024);
        $data .= $input;
} while($input != "");
// parse data to extract variables
$obj = json_decode($data, true);
// store input data in a database
mysql_connect("201.408.185.132",$DBserver,$password); // access
database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
?>
```

Also, the following resources may be used to provide example embodiments regarding SOAP parser implementation:

http://www.xav.com/perl/site/lib/SOAP/Parser.html
http://publib.boulder.ibm.com/infocenter/tivihelp/v2r1/index.jsp?topic=/com.ibm.IBMDI.doc/referenceguide295.htm and other parser implementations:

http://publib.boulder.ibm.com/infocenter/tivihelp/v2r1/index.jsp?topic=/com.ibm.IBMDI.doc/referenceguide259.htm all of which are hereby expressly incorporated by reference.

In order to address various issues and advance the art, the entirety of this application for SPATIAL SOUND LOCALIZATION AND ISOLATION APPARATUSES, METHODS, AND SYSTEMS (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the present subject matter, and inapplicable to others. The disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a SSL system individual and/or enterprise user, database configuration and/or relational model, data type, data transmission and/or network framework, syntax structure, and/or the like, various embodiments of the SSL system, may be implemented that enable a great deal of flexibility and customization. While various embodiments and discussions of the SSL system may have included reference to sound source characterization, it is to be understood that the embodiments described herein may be readily configured and/or customized for variety of other applications and/or implementations.

What is claimed is:

1. A processor-implemented method for spatial sound localization, the method comprising:

obtaining, via a processor, a plurality of direction of arrival (DOA) estimates from a plurality of sensors;

determining, via the processor, a set of intersection points based on the DOA estimates;

receiving, via the processor, a number of sources in a current time frame;

if the number of sources is more than 1, obtaining via the processor, a plurality of regions by dividing a plurality of possible locations of sources into a predefined number of combinations of DOA estimates;

from amongst the plurality of regions, selecting, via the processor, a region having maximum number of intersection points;

obtaining via the processor, a centroid of the intersection points in the selected region;

estimating location of one of the plurality of sources based on the centroid;

selecting the remaining region and obtaining a centroid of intersection points in the remaining region to yield location of the remaining source.

2. The method of claim 1, wherein the region is selected from amongst the plurality of regions based on a minimum value of variance.

3. The method of claim 1, wherein the possible locations are based at least on the intersection points of a pair of DOA estimates that are not substantially parallel, and wherein the pair of DOA estimates belong to distinct sensors.

4. The method of claim 1 further comprising:

determining one or more intersection point outliers based at least on a parallelness threshold; and removing the intersection point outliers from the set of intersection points to yield an updated set of intersection points.

5. The method of claim 4 further comprising:

determining a centroid of the intersection points remaining after removing the intersection point outliers, if the number of sources is equal to one; and estimating location of the source based on the centroid.

6. The method of claim 4, wherein determining one or more intersection point outliers comprises comparing an angular distance between the plurality of sensors to the parallelness threshold.

7. A system for spatial sound localization, the system comprising:

a processor;

a memory coupled to the processor, the memory comprising, a sound source localizer configured to, obtain a plurality of direction of arrival (DOA) estimates from a plurality of sensors;

determine a set of intersection points based on the DOA estimates;

determine one or more intersection point outliers based at least on a parallelness threshold;

remove the intersection point outliers from the set of intersection points to yield an updated set of intersection points;

determine a centroid of the intersection points remaining after removing the intersection point outliers; and estimate location of one or more sources based on the centroid.

8. The system of claim 7, wherein the sound source localizer includes a region determination module configured to:

determine via the processor, a plurality of regions by dividing a plurality of possible locations for each of the plurality of sources into a predefined number of unique combinations of the DOA estimates, wherein the possible locations are based at least on the intersection points of the pair of estimates that are not substantially parallel;

arrange the plurality of regions in a list according to descending number of intersection points;

from amongst the plurality of regions, select, via the processor, a region having maximum number of intersection points;

obtain via the processor, a centroid of the intersection points in the selected region;

estimate location of one of the plurality of sources based on the centroid;

select another region from the list; and obtain a centroid of intersection points in the another region to yield location of the remaining source.

9. A method for sound source localization, the method comprising:

segmenting, via a processor, each of a plurality of source signals detected by a plurality of sensors, into a plurality of time frames;

for each time frame, obtaining, via a processor, a plurality of direction of arrival (DOA) estimates from the plurality of sensors;

discretizing an area of interest into a plurality of grid points;

calculating, via the processor, a computed DOA for each sensor at each of the plurality of grid points;

obtaining via the processor, a plurality of unique combinations of DOA estimates;

from amongst the plurality of combinations, estimating, via the processor, one or more initial candidate locations corresponding to each of the combinations by comparing the DOA combinations with the computed DOAs at each of the plurality of grid points; and selecting location of one or more sources from which the plurality of source signals originates from amongst the initial candidate locations.

10. The method of claim 9, wherein selecting location of the sources includes searching a plurality of 5-tuples of DOA combinations.

11. The method of claim 9, wherein selecting location of the sources includes:

determining a residual value based on a relationship between the DOA estimates and DOA estimates at the initial candidate location; and evaluating DOA combinations that approximate the residual.

12. The method of claim 9, wherein obtaining DOA estimates includes:

obtaining DOA estimates for each frequency of at least a current time frame;

and a plurality of a predefined number of previous frames.

13. The method of claim 9, wherein selecting a location of one or more sources from which the plurality of source signals originates includes:

generating histograms using the frequency distribution at a plurality of time frames;

comparing histograms based on a correlation coefficient; and associating a DOA estimate with a source based on the comparison.

14. The method of claim 13 further comprising removing the associated DOA and determining association of another DOA estimate with another source.

15. The method of claim 9 further comprising:

determining whether the number of sources is equal to one;

if the number of sources is equal to one, selecting a grid point, wherein the computed DOA at the selected grid point matches with its DOA estimate; and estimating the location of the source based on the grid point.

16. The method of claim 15, wherein angular distance between the plurality of sensors is compared to determine a match.

17. The method of claim 9, wherein selecting a grid point further comprises:

receiving a resolution coefficient;

determining an updated grid point based on the resolution coefficient, wherein the updated grid point is centered on the grid point.

18. An apparatus for localizing a plurality of sound sources using direction of arrival (DOA) estimates from a plurality of sensors, the apparatus comprising:

a memory;

a network;

a processor in communication with the memory and the network, and configured to issue a plurality of processing instructions stored in the memory, wherein the processor issues instructions to:

(a) obtain, via at least one of the network and the memory, the DOA estimates from the plurality of sensors;

(b) form pairs of DOA estimates, wherein each pair includes DOA estimates from distinct sensors;

(c) for each pair of the DOA estimates, determine, by the processor, whether the pair of DOA estimates are substantially parallel;

discard, by the processor, the pair of DOA estimates if they are substantially parallel; and determine, by the processor, the intersection point of the pair of DOA estimates if they are not substantially parallel;

(d) determine, by the processor, a plurality of regions by dividing possible locations for each of the plurality of sources into a predefined number of unique combination of the DOA estimates, wherein the possible locations are based at least on the intersection points of the pair of estimates that are not substantially parallel;

(e) select, by the processor, a first one of the plurality of regions containing the most intersection points;

(f) determine, by the processor, the centroid of the intersection points in the selected region, wherein a location of one of the plurality of sound sources is given by the centroid;

(g) select, by the processor, a next one of the plurality of regions containing the most intersection points;

(h) determine, by the processor, the centroid of the intersection points in the next selected region, wherein a location of a next one of the plurality of sound sources is given by the centroid; and (i) repeat g) and h) until each of the plurality of sound sources have been located.

19. An apparatus for localizing a plurality of sound sources using direction of arrival (DOA) estimates from a plurality of sensors, the apparatus comprising:

a memory;

a network;

a processor in communication with the memory and the network, and configured to issue a plurality of processing instructions stored in the memory, wherein the processor issues instructions to:

(a) obtain, via at least one of the network and the memory, the DOA estimates from the plurality of sensors;

(b) form, by the processor, a set of all possible unique combinations of DOA estimates;

(c) for each unique combination of DOA estimates, determine, by the processor, a plurality of initial candidate locations of the sound sources by, discretizing an area of interest into a plurality of grid points; and determining, by the processor, a grid point whose DOA most closely matches the DOA estimates, wherein each determined grid point corresponds to an initial candidate location of a sound source;

(d) determine, by the processor, a correct association of DOA estimates that correspond to the same sound source; and (e) determine, by the processor, which of the plurality of initial candidate locations most likely correspond to true sound source locations based on the correct association of DOA estimates.

* * * * *